US007248234B2

(12) United States Patent
Hashimoto et al.

(10) Patent No.: US 7,248,234 B2
(45) Date of Patent: Jul. 24, 2007

(54) IMAGE DISPLAY APPARATUS HAVING DELTA ARRANGEMENT TYPE SCREEN AND IMAGE CONVERSION METHOD FOR DISPLAY

(75) Inventors: Yasunobu Hashimoto, Kawasaki (JP); Katsuya Irie, Kawasaki (JP); Kenji Awamoto, Kawasaki (JP)

(73) Assignee: Hitachi Plasma Patent Licensing Co., Ltd., Tokyo (JP)

( * ) Notice: Subject to any disclaimer, the term of this patent is extended or adjusted under 35 U.S.C. 154(b) by 659 days.

(21) Appl. No.: 10/814,284

(22) Filed: Apr. 1, 2004

(65) Prior Publication Data

US 2004/0233185 A1 Nov. 25, 2004

(30) Foreign Application Priority Data

May 23, 2003 (JP) ..... 2003-146880
Feb. 27, 2004 (JP) ..... 2004-055251

(51) Int. Cl.
*G09G 3/10* (2006.01)

(52) U.S. Cl. ..... 345/60

(58) Field of Classification Search ..... 345/690, 345/698, 699, 60, 204; 315/169.1; 382/162; 313/501

See application file for complete search history.

(56) References Cited

U.S. PATENT DOCUMENTS 6,905,215 B2 * 6/2005 Segler et al. ..... 353/69
2003/0067426 A1 4/2003 Awamoto et al.

FOREIGN PATENT DOCUMENTS

JP 9-50768 2/1997
JP 2003-122293 4/2003

* cited by examiner

*Primary Examiner*—Richard Hjerpe
*Assistant Examiner*—Abbas I. Abdulselam
(74) *Attorney, Agent, or Firm*—Staas & Halsey LLP

(57) ABSTRACT

In order to reduce aliasing as much as possible in a display apparatus that has a delta arrangement type screen, an image filter for performing a neighborhood operation is incorporated as a previous stage of a screen driving circuit. The image filter realizes low pass filtering including space frequency limitation in the diagonal direction that is suitable for a display on the delta arrangement type screen. Coefficients that constitute the filter matrix are optimized so that frequency components that exceed a Nyquist limit in the delta arrangement are suppressed. Coefficients that give optimal filter characteristics for any scale of filter matrix are defined by an expression.

20 Claims, 40 Drawing Sheets

● : SPECTRUM CENTER OF THE ORIGINAL SIGNAL

○ : SPECTRUM CENTER OF ALIASING

● : SPECTRUM CENTER OF THE ORIGINAL SIGNAL

○ : SPECTRUM CENTER OF ALIASING

● : SPECTRUM CENTER OF THE ORIGINAL SIGNAL

○ : SPECTRUM CENTER OF ALIASING

[Type A]

[Type B]

CASE OF DISPLAYING WHITE COLOR LINE

CASE OF DISPLAYING RED COLOR LINE

Ⓡ : POSITION OF R CELL

Ⓖ : POSITION OF G CELL

Ⓑ : POSITION OF B CELL

○ : POSITION OF DATA POINT

Ⓖ : POSITION OF G CELL

Ⓜ : IMAGINARY CELL POSITION USED FOR APPROXIMATE CALCULATION OF DATA OF R CELL AND B CELL

○ : POSITION OF DATA POINT

Ⓖ : POSITION OF R CELL

Ⓜ : IMAGINARY CELL POSITION USED FOR APPROXIMATE CALCULATION OF DATA OF R CELL AND B CELL

○ : POSITION OF DATA POINT

IMAGE DISPLAY APPARATUS HAVING DELTA ARRANGEMENT TYPE SCREEN AND IMAGE CONVERSION METHOD FOR DISPLAY

BACKGROUND OF THE INVENTION

1. Field of the Invention

The present invention relates to an image display using a delta arrangement type screen. This is suitable for driving a flat panel display.

Visual media including television broadcasting and various types of video disks have been becoming a high resolution. As the development of them, an image display apparatus having high quality and a large screen is desired to be available for an inexpensive price.

2. Description of the Prior Art

An image display apparatus using a plasma display panel has an input interface for receiving a signal from an image output device such as a television tuner or a computer, as a previous stage of a driving circuit that applies a voltage for generating discharge to the plasma display panel. The input interface converts an analog image signal to digital image data, and it sends image data with gamma correction to the driving circuit.

In general, a pixel arrangement of an image that is supplied to the image display apparatus is an orthogonal arrangement (or a tetragonal arrangement). Namely, the input image signal is prepared on the precondition of a display using an orthogonal arrangement type screen having cells aligned in a row and in a column of a matrix display. Here, the orthogonal arrangement type includes one whose pixel does not have an orthogonal shape. It is not necessary that a pitch of rows is identical to a pitch of columns.

In an image display apparatus having an orthogonal arrangement type screen, resolution conversion is performed for adjusting a resolution of an input image to a resolution of the display screen. The conversion of resolution in the horizontal direction (the conversion of the number of dots) is realized by adjusting a timing of a sampling clock while converting the analog image signal to the digital image data. The conversion of resolution in the vertical direction (the conversion of the number of rows) is realized by an interpolation process in accordance with data of plural lines (rows). The number of rows can be doubled by generating a new row of data from a mean value of data of two neighboring rows and inserting the new row between the original two rows. Also, the number of rows can be reduced to a half by replacing the original two rows with the newly generated row.

On the other hand, concerning a screen structure of a flat panel display, a plasma display panel having a delta arrangement type screen is disclosed in Japanese unexamined patent publication No. 9-50768. Here, the delta arrangement means one of arrangement formats of cells that are display elements constituting a screen, in which a position of a cell is shifted between neighboring columns of cells by a half pitch. The half pitch means a half of a cell pitch between columns. A color display has pixels each of which is made of a set of red, green and blue cells. Therefore, noting one of the three colors, a center position of light emission of a pixel is shifted between neighboring columns of pixels by a half pitch in the delta arrangement. The delta arrangement in a plasma display panel has an advantage that an aperture can be larger than in the orthogonal arrangement, and it is an arrangement format that is suitable for improving luminance and light emission efficiency. Hereinafter, a plasma display panel having a delta arrangement type screen is referred to as a delta panel.

It is necessary to perform an image process that is called an arrangement conversion in a display using a delta panel. The arrangement conversion is a process for converting an orthogonal arrangement image to be displayed into an image that is adapted to the cell arrangement of the display screen. More specifically, it is an operation for distributing pixel values of the image to cells of the screen, so as to compensate the displacement between the pixel position of the image and the cell position of the screen. Japanese unexamined patent publication No. 2003-122293 discloses an image display apparatus having a conversion circuit that performs an add operation with weighting for the arrangement conversion and is disposed between the input interface and the driving circuit.

In a display apparatus having a screen in which a finite number of pixels are arranged in a discrete manner regardless of an arrangement format of pixels, a false frequency component that is called aliasing appears in an image to be displayed. In the orthogonal arrangement screen that is shown in FIG. 1 schematically, the aliasing as shown in FIGS. 2 and 3 appears. The image can be reproduced faithfully only in an area that is a vicinity of a spectrum center of the original signal. A boundary between areas in which faithful reproduction is possible and impossible in the frequency space is a Nyquist limit. The Nyquist limit in the orthogonal arrangement forms a quadrangle as shown in FIG. 2. As shown well in FIG. 3, the Nyquist limit is located at the middle position between the spectrum center of the original signal and the spectrum center of the aliasing that is adjacent to the spectrum of the original signal. When trying to display an image having a frequency component above the Nyquist limit, the image cannot be reproduced faithfully since it is overlapped with a component of the aliasing. Therefore, low-pass filtering is performed so that frequency components of the image signal in the horizontal direction and in the vertical direction are restricted within the Nyquist limit when displaying the image using an orthogonal arrangement type screen.

In general, a filtering process in a display apparatus utilizes an image filter of a neighborhood operation type for calculating luminance of a pixel in the screen by an add operation with weighting from luminance of plural data points in the input image. It is because that the image filter of such a type enables a higher speed of process than a Fourier transform type and is suitable for a display of a moving picture.

There is a problem in the conventional image display apparatus having the delta arrangement type screen. The problem is that a part of the input image signal having a high space frequency is replaced with a false signal and is overlapped with information having a low space frequency that must be inherently displayable; thereby the image information of the part is dropped out completely in the display.

The problem that a part of the input image signal is replaced with a false signal can be solved by making the screen high definition so as to enlarge the space frequency area that can be displayed. However, this solution may cause a significant rise of cost of the image display apparatus.

Detail of the false signal is as follows. In a display using a delta arrangement screen that is shown in FIG. 4 schematically, the aliasing as shown in FIG. 5 appears. Since the arrangement of the spectrum center of the aliasing in the frequency space also becomes the delta arrangement, a shape of the Nyquist limit becomes a hexagon as a characteristic of the delta arrangement screen. Therefore, in order to realize reproduction of a faithful image, band limitation in a "diagonal direction" that is a slanting direction to the vertical direction and the horizontal direction is necessary adding to the band limitation in the vertical direction and in the horizontal direction. However, in the conventional method only the band limitation in the vertical direction and in the horizontal direction is performed in the same way as the orthogonal arrangement, and the band limitation in the diagonal direction is not performed. Thus, in a display apparatus having a delta arrangement type screen, the band limitation in the diagonal direction using an image filter is not realized for the purpose of reproducing an image faithfully.

Although it is not aimed at the band limitation, a sort of operation for converting the orthogonal arrangement format of an image signal into the delta arrangement format corresponds to the filtering in the diagonal direction. The operation is a neighborhood operation (sometimes called a filter matrix operation) in which pixel information of the input image is distributed not only to the pixels in the vertical direction but also to pixels in the horizontal direction. The operation will be explained more specifically as below.

First, symbols are prepared. A gradation level of a cell of a color is denoted by $C_{n,m}$, and an image signal that corresponds to a cell of a noted color is denoted by $T_{n,m}$. The suffix "n" means a position in the vertical direction, while the suffix "m" means a position in the horizontal direction. These positions are defined as shown in FIGS. 6 and 7. Here, it should be noted that numbering of the position is different depending on a color. The position of the even cell in the horizontal direction is shifted from the position of the odd cell by a half of the cell pitch in the vertical direction.

Concerning the vertical position of a horizontal line (row) of the image signal, there are two cases supposed; one is the case (a type A) where it is the same position as the cell as shown in FIG. 8, and another is the case (a type B) where it is the middle position between the neighboring cells.

The neighborhood operation for the conventional format conversion is an operation to an interlace signal having double numbers of horizontal lines of the screen. Hereinafter, interlace image information is denoted by $T'_{n,m}$, information of even field is denoted by $T'_{2n,m}$, and information of odd field is denoted by $T'_{2n+1,m}$. The operation is expressed by the following expressions.

[For an even field in the type *A*]

$$\left.\begin{aligned} C_{2n,2m} &= \frac{1}{32}T'_{2n,2m-1} + \frac{15}{16}T'_{2n,2m} + \frac{1}{32}T'_{2n,2m+1} \\ C_{2n+1,2m+1} &= \frac{1}{64}T'_{2n,2m} + \frac{15}{32}T'_{2n,2m+1} + \\ &\quad \frac{1}{64}T'_{2n,2m+2} + \frac{1}{64}T'_{2n+2,2m} + \\ &\quad \frac{15}{32}T'_{2n+2,2m+1} + \frac{1}{64}T'_{2n+2,2m+2} \end{aligned}\right\} (R \text{ and } B \text{ cells}) \tag{1}$$

$$\left.\begin{aligned} C_{2n,2m+1} &= \frac{1}{32}T'_{2n,2m} + \frac{15}{16}T'_{2n,2m+1} + \frac{1}{32}T'_{2n,2m+2} \\ C_{2n+1,2m} &= \frac{1}{64}T'_{2n,2m-1} + \frac{15}{32}T'_{2n,2m} + \\ &\quad \frac{1}{64}T'_{2n,2m+1} + \frac{1}{64}T'_{2n+2,2m-1} + \\ &\quad \frac{15}{32}T'_{2n+2,2m} + \frac{1}{64}T'_{2n+2,2m+1} \end{aligned}\right\} (G \text{ cell}) \tag{2}$$

-continued

[For an odd field in the type *A*]

$$\left.\begin{aligned} C_{2n,2m} &= \frac{1}{64}T'_{2n-1,2m-1} + \frac{15}{32}T'_{2n-1,2m} + \frac{1}{64}T'_{2n-1,2m+1} + \\ &\quad \frac{1}{64}T'_{2n+1,2m-1} + \frac{15}{32}T'_{2n+1,2m} + \frac{1}{64}T'_{2n+1,2m+1} \\ C_{2n+1,2m+1} &= \frac{1}{32}T'_{2n+1,2m} + \frac{15}{16}T'_{2n+1,2m+1} + \\ &\quad \frac{1}{32}T'_{2n+1,2m+2} \end{aligned}\right\} (R \text{ and } B \text{ cells}) \tag{3}$$

$$\left.\begin{aligned} C_{2n,2m+1} &= \frac{1}{64}T'_{2n-1,2m} + \frac{15}{32}T'_{2n-1,2m+1} + \\ &\quad \frac{1}{64}T'_{2n-1,2m+2} + \frac{1}{64}T'_{2n+1,2m} + \\ &\quad \frac{15}{32}T'_{2n+1,2m+1} + \frac{1}{64}T'_{2n+1,2m+2} \\ C_{2n+1,2m} &= \frac{1}{32}T'_{2n+1,2m-1} + \frac{15}{16}T'_{2n+1,2m} + \frac{1}{32}T'_{2n+1,2m+1} \end{aligned}\right\} (G \text{ cell}) \tag{4}$$

[For an even field in the type *B*]

$$\left.\begin{aligned} C_{2n,2m} &= \frac{7}{32}T'_{2n-2,2m} + \frac{1}{32}T'_{2n,2m-1} + \\ &\quad \frac{23}{32}T'_{2n,2m} + \frac{1}{32}T'_{2n,2m+1} \\ C_{2n+1,2m+1} &= \frac{1}{32}T'_{2n,2m} + \frac{23}{32}T'_{2n,2m+1} + \\ &\quad \frac{1}{32}T'_{2n,2m+2} + \frac{7}{32}T'_{2n+2,2m+1} \end{aligned}\right\} (R \text{ and } B \text{ cells}) \tag{5}$$

$$\left.\begin{aligned} C_{2n,2m+1} &= \frac{7}{32}T'_{2n-2,2m+1} + \frac{1}{32}T'_{2n,2m} + \\ &\quad \frac{23}{32}T'_{2n,2m+1} + \frac{1}{32}T'_{2n,2m+2} \\ C_{2n+1,2m} &= \frac{1}{32}T'_{2n,2m-1} + \frac{23}{32}T'_{2n,2m} + \\ &\quad \frac{1}{32}T'_{2n,2m+1} + \frac{7}{32}T'_{2n+2,2m} \end{aligned}\right\} (G \text{ cell}) \tag{6}$$

[For an odd field in the type *B*]

$$\left.\begin{aligned} C_{2n,2m} &= \frac{1}{32}T'_{2n-1,2m-1} + \frac{23}{32}T'_{2n-1,2m} + \\ &\quad \frac{1}{32}T'_{2n-1,2m+1} + \frac{7}{32}T'_{2n+1,2m} \\ C_{2n+1,2m+1} &= \frac{7}{32}T'_{2n-1,2m+1} + \frac{1}{32}T'_{2n+1,2m} + \\ &\quad \frac{23}{32}T'_{2n+1,2m+1} + \frac{1}{32}T'_{2n+1,2m+2} \end{aligned}\right\} (R \text{ and } B \text{ cells}) \tag{7}$$

$$\left.\begin{aligned} C_{2n,2m+1} &= \frac{1}{32}T'_{2n-1,2m} + \frac{23}{32}T'_{2n-1,2m+1} + \\ &\quad \frac{1}{32}T'_{2n-1,2m+2} + \frac{7}{32}T'_{2n+1,2m+1} \\ C_{2n+1,2m} &= \frac{7}{32}T'_{2n-1,2m} + \frac{1}{32}T'_{2n+1,2m-1} + \\ &\quad \frac{23}{32}T'_{2n+1,2m} + \frac{1}{32}T'_{2n+1,2m+1} \end{aligned}\right\} (G \text{ cell}) \tag{8}$$

Further, averaging between the even field and the odd field, the above operations become as follows. The operation expression is common to three colors of red, green and blue. However, suffixes should be considered.

[Type A]

$$C_{n,m} = \frac{1}{128}T'_{n-1,m-1} + \frac{15}{64}T'_{n-1,m} + \frac{1}{128}T'_{n-1,m+1} + \tag{9}$$

-continued $$\frac{1}{64}T'_{n,m-1}+\frac{15}{32}T'_{n,m}+\frac{1}{64}T'_{n,m+1}+$$

$$\frac{1}{128}T'_{n+1,m-1}+\frac{15}{64}T'_{n+1,m}+\frac{1}{128}T'_{n+1,m+1}$$

[Type B]

$$C_{n,m}=\frac{7}{64}T'_{n-2,m}+\frac{1}{64}T'_{n-1,m-1}+\frac{23}{64}T'_{n-1,m}+\frac{1}{64}T'_{n-1,m+1}+\frac{1}{64}T'_{n,m-1}+\frac{23}{64}T'_{n,m}+\frac{1}{64}T'_{n,m+1}+\frac{7}{64}T'_{n+1,m-1} \quad (10)$$

These operations for the format conversion works also as low pass filters but are not designed as low pass filters. Therefore, they don't provide characteristics of band limitation filters that are adapted to the delta arrangement screen.

SUMMARY OF THE INVENTION

An object of the present invention is to reduce aliasing as much as possible, which causes dropout of image information in a display using a delta arrangement type screen.

In an aspect of the present invention, an image filter that performs an operation for narrowing a space frequency range for image data representing an input image is incorporated as a previous stage of a driving circuit. The image filter realizes low pass filtering that includes space frequency limitation in the diagonal direction adapted to a display using a delta arrangement type screen by utilizing a neighborhood operation. Coefficients of the neighborhood operation are optimized so that frequency components that exceed the Nyquist limit in the delta arrangement are cut off substantially completely. The filter characteristics depend on a scale of the neighborhood operation determined by a specification of the display apparatus, and optimal filter characteristics of any scale of the neighborhood operation are obtained by coefficients in accordance with the definition of the present invention.

By the space frequency limitation, the complete dropout of the image information in the part of the original image having a high space frequency is eliminated. When the coefficients are selected appropriately, the conversion of the arrangement from the orthogonal arrangement into a non-orthogonal arrangement and the conversion of the resolution can be performed at the same time as the space frequency limitation. By performing plural processes at the same time, a scale of the circuit can be reduced so that the device can be provided for a more inexpensive price.

According to the present invention, aliasing that causes dropout of image information in a display using a delta arrangement type screen can be reduced as much as possible.

DESCRIPTION OF THE PREFERRED EMBODIMENTS

Hereinafter, the present invention will be explained more in detail with reference to embodiments and drawings.

First Embodiment

In this embodiment, simplified low pass filtering without band limitation in the diagonal direction is performed.

Figure 9:
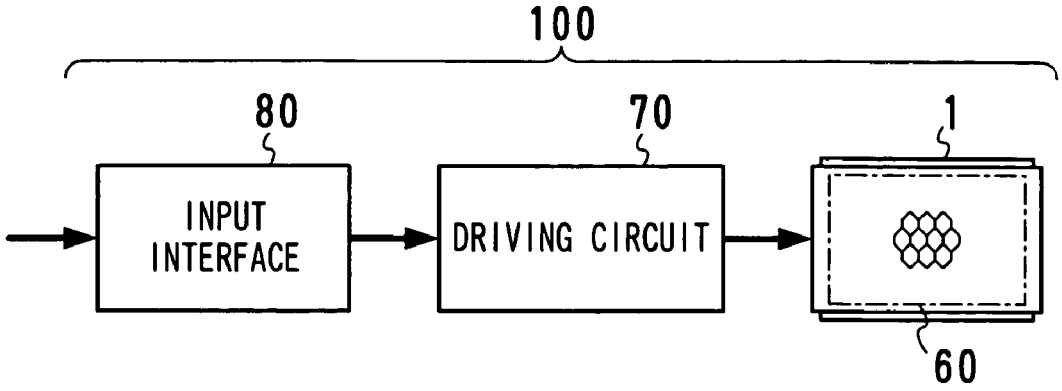
FIG. 9 is a diagram showing a structure of an image display apparatus according to the present invention.

FIG. 9 shows a structure of an image display apparatus according to the present invention. The image display apparatus 100 includes a plasma display panel 1 that is a display device having a non-orthogonal arrangement type screen 60, a driving circuit 70 for supplying a drive voltage signal for generating discharge in accordance with display contents to the plasma display panel 1, and an input interface 80 for receiving an input image signal from an image output device such as a television tuner or a computer. The input interface 80 has a filter function that is unique to the present invention.

Figure 10:
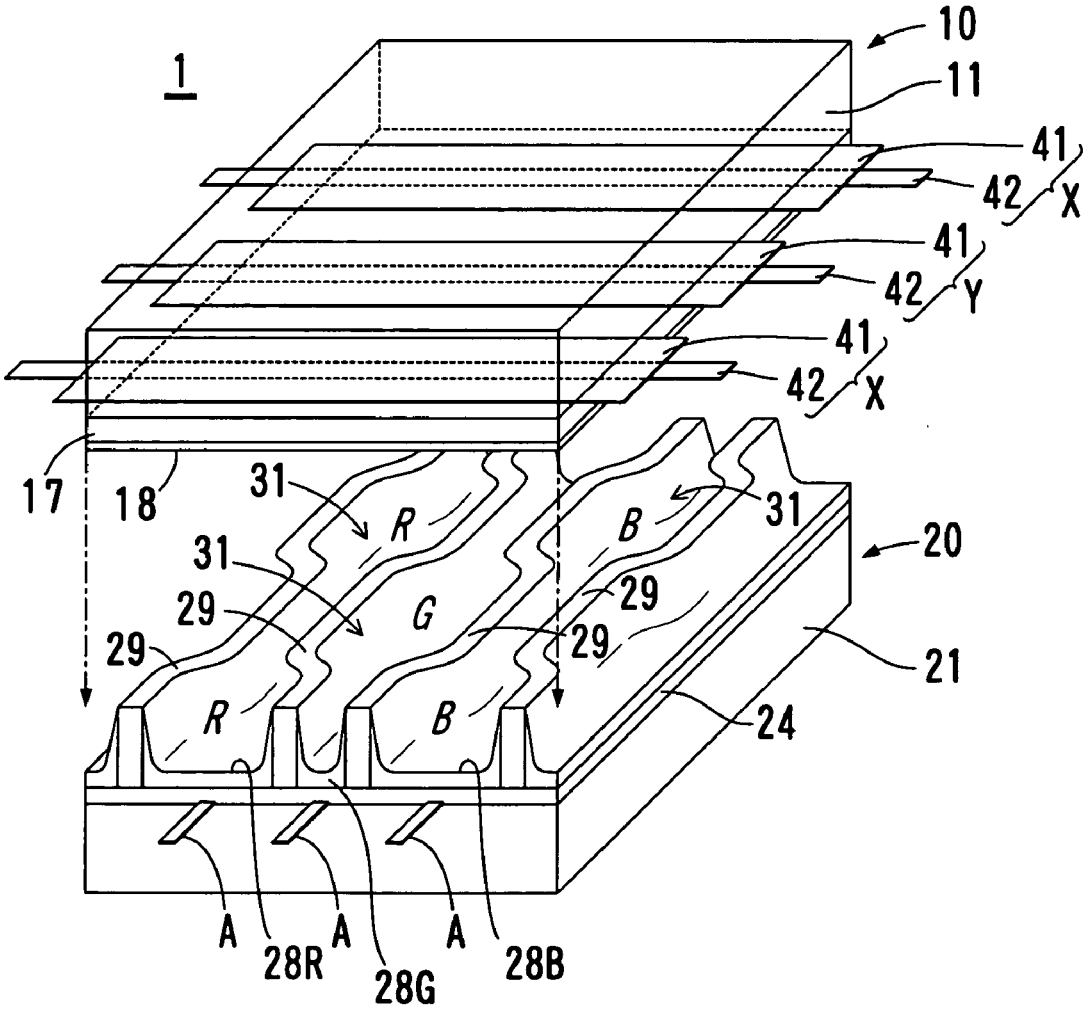
FIG. 10 is a diagram showing a cell structure of a plasma display panel.
Figure 11:
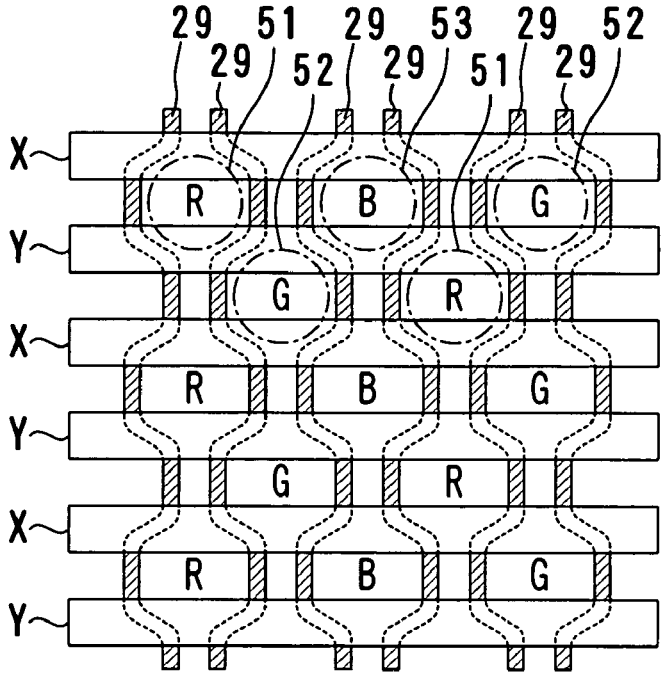
FIG. 11 is a diagram showing a partition pattern of a plasma display panel.

FIG. 10 shows a cell structure of a plasma display panel, and FIG. 11 shows a partition pattern. In FIG. 10, a part of the plasma display panel 1 corresponding to three cells for one pixel display is illustrated with a pair of substrate structural bodies 10 and 20 separated so that inner structure can be understood easily.

The plasma display panel 1 includes a pair of substrate structural bodies 10 and 20. The substrate structural body means a structure including a glass substrate on which electrodes and other structural elements are arranged. On the inner surface of a glass substrate 11 of the front substrate structural body 10, display electrodes (row electrodes) X and Y, a dielectric layer 17 and a protection film 18 are disposed. On the inner surface of a glass substrate 21 of the back substrate structural body 20, address electrodes (column electrodes) A, an insulation layer 24, partitions 29, and fluorescent material layers 28R, 28G and 28B are disposed. Each of the display electrodes X and Y includes a transparent conductive film 41 that forms a surface discharge gap and a metal film 42 as a bus conductor. The partitions 29 are arranged so that one partition 29 corresponds to one electrode gap in the address electrode arrangement, and these partitions 29 divide a discharge space into column spaces 31 for columns. Each of the column spaces 31 is continuous over all rows. The fluorescent material layers 28R, 28G and 28B are excited by ultraviolet rays emitted by a discharge gas so as to emit light. Italic letters R, G and B in FIG. 10 indicate light emission colors (red, green and blue) of fluorescent materials.

As shown in FIG. 11, all the partitions 29 are meandered so as to form column spaces in which wide portions and narrow portions are arranged in an alternating manner. A position of the wide portion in the column direction is shifted between neighboring column spaces by a half cell pitch in the column direction. Cells are formed in the wide portions. In FIG. 11, cells 51, 52 and 53 of one row are shown as representatives in circles of alternate long and short dash lines. The row is a set of cells to be lighted when displaying a straight line in the horizontal direction having a minimum width (a width of one pixel).

Figure 12:
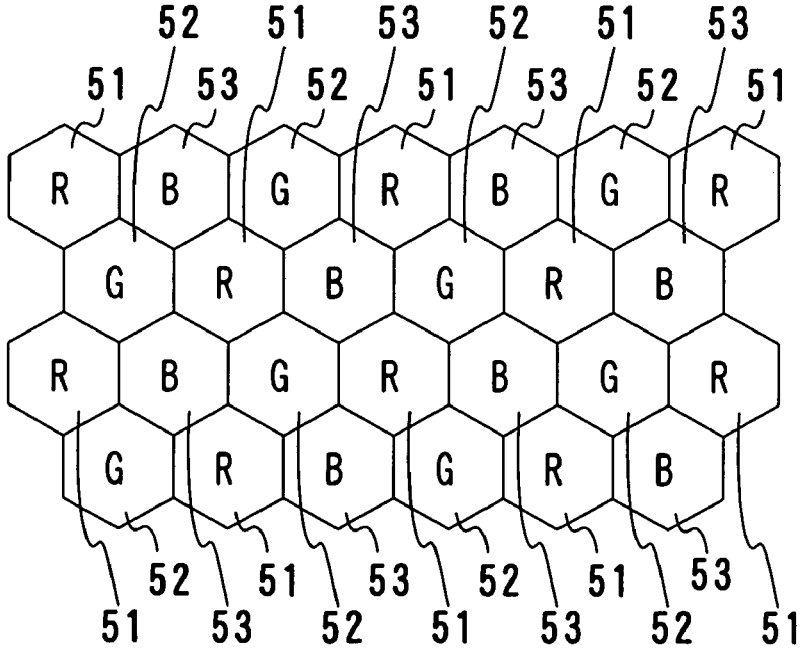
FIG. 12 is a diagram showing a cell arrangement schematically.

FIG. 12 shows a cell arrangement schematically. In FIG. 12, a light emission color of the cell 51 is R (red), a light emission color of the cell 52 is G (green), and a light emission color of the cell 53 is B (blue). As shown in FIG. 12, in the plasma display panel 1, a cell column that is a set of cells corresponding to each column space, i.e., cells aligned in the vertical direction have the same light emission color. Neighboring cell columns have different light emission colors, and a cell position in the column direction is shifted between the neighboring cell columns in a set of cell columns having the same light emission color (e.g., a set of red cells 51). The arrangement format of three colors for a color display is the delta arrangement.

Figure 13:
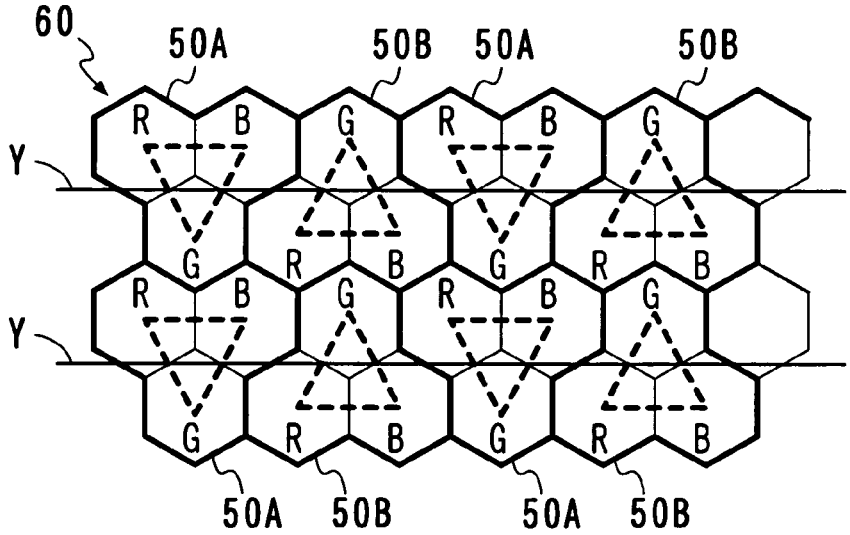
FIG. 13 is a diagram showing an example of a dot structure of a color display.

FIG. 13 shows an example of a dot structure of a color display. As shown in FIG. 13, the screen 60 is divided by continuous two cells in the vertical direction and by continuous three cells in the horizontal direction, and dots 50A and 50B each of which is a set of three cells (a light emission unit corresponding to a pixel of an input image) are structured. There are two neighboring dots 50A and 50B arranged in the horizontal direction. One of the dots 50A belongs to cells of the inverted triangle delta arrangement, while the other dot 50B belongs to cells of the regular triangle delta arrangement. In the dot 50A, the centers of the R cell and the B cell are positioned above the display electrode Y as a scan electrode, while the center of the G cell is positioned below the same. On the contrary in the dot 50B, the center of the G cell is positioned above the display electrode Y, while the centers of the R cell and the B cell are positioned below the same.

Figure 14A:
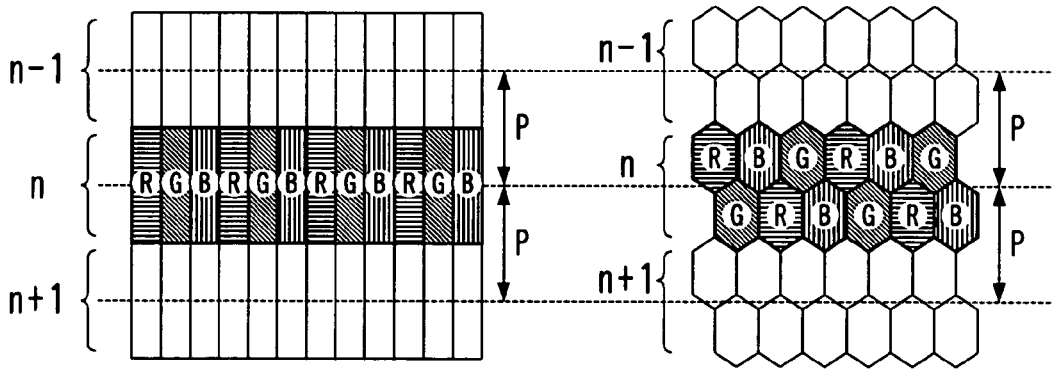
FIGS. 14A and 14B are diagrams showing lighting patterns of a simple line display.
Figure 14B:
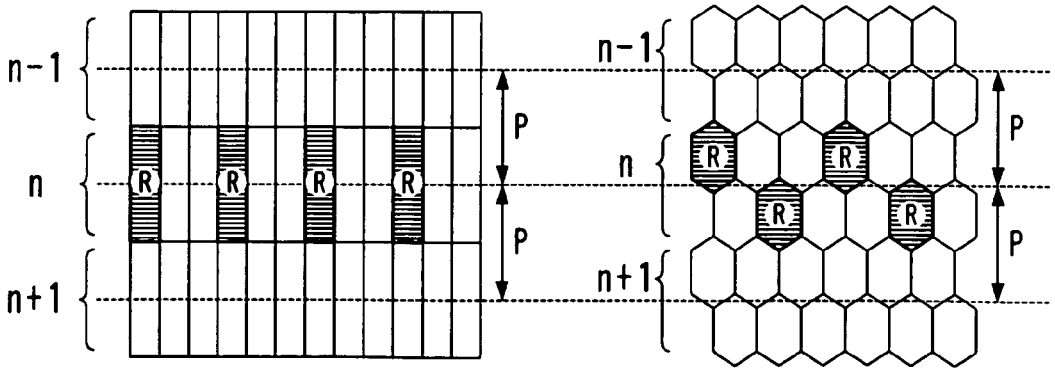

FIGS. 14A and 14B show lighting patterns of a simple line display. In FIGS. 14A and 14B, the right sides are displays in the orthogonal arrangement screen, and the left sides are displays in the delta arrangement screen. As shown in FIG. 14A, in a display of a white color horizontal line, three cells of a dot are lighted since the white color is a combination of three colors. In a display of a horizontal line with single color that is red color, green color or blue color, one of three cells of each dot is lighted as shown in FIG. 14B. In this case, the display in the delta arrangement screen is viewed in a zigzag shape. The display quality in this case can be improved by data correction.

Figure 15A:
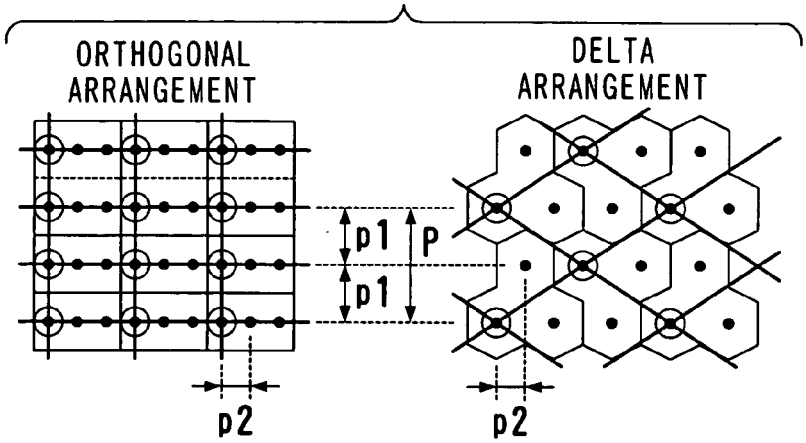
FIGS. 15A-15C are explanatory diagrams of a function of a band limitation filter.
Figure 15B:
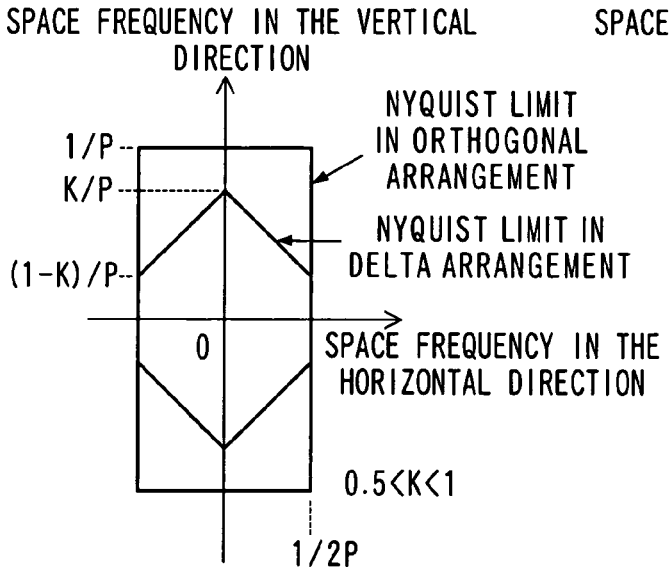

Next, a band limitation filter that is unique to the present invention will be explained. FIG. 15A shows a position relationship between cell centers in the orthogonal arrangement and in the delta arrangement. Here, a vertical cell pitch p1 in the delta arrangement is identical to that in the orthogonal arrangement, and a horizontal cell pitch p2 is also identical between the two arrangements. However, when noting one light emission color (one line aligned in the vertical direction), a distance of cells in the vertical direction in the delta arrangement, i.e., a vertical dot pitch P is twice the vertical cell pitch p1. Since the number of dots in the vertical direction in the orthogonal arrangement is larger than that in the delta arrangement, a displayable space frequency range (inside the frequency limit) is larger in the orthogonal arrangement than in the delta arrangement as shown in FIG. 15B. Namely, a fine pattern that can be reproduced in the orthogonal arrangement is replaced with a single color uniform pattern (a false signal) in the delta arrangement, which means that image information of a low space frequency that should be displayed inherently is dropped out.

Figure 15C:
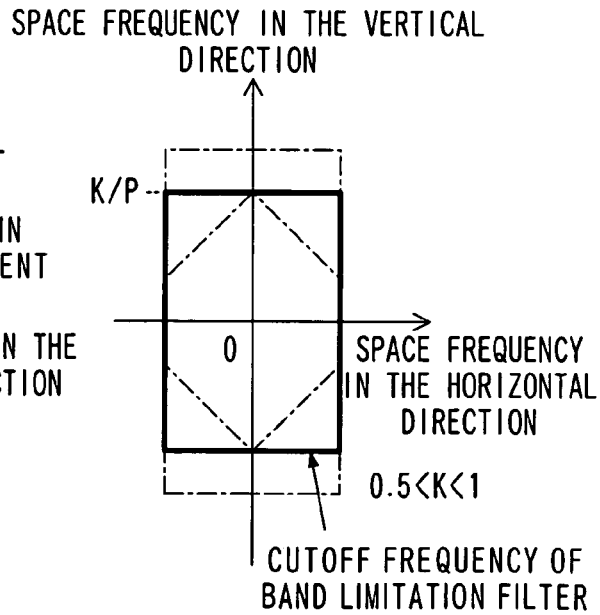

As means for suppressing the dropout of the image information due to the difference between the cell arrangements, the band limitation filter is provided. FIG. 15C shows an example of characteristics of the filter. In this example, high frequency components are cut off only in the vertical direction, so that the space frequency range of the image is close to a reproducible area in the delta arrangement. In the diagonal direction, though a cutoff frequency is higher than the frequency limit in the delta arrangement, the dropout of the image information becomes hard to occur since the space frequency range of the image is narrowed. This example has an advantage that a simple structure of the filter is sufficient. Furthermore, if optimized coefficients that will be explained later are used, the space frequency range of the image can be identical to the reproducible area in the delta arrangement.

The restriction of the space frequency for the input image can be performed at the same time as arrangement conversion for converting an image in the orthogonal arrangement into an image in the delta arrangement.

Figure 16A:
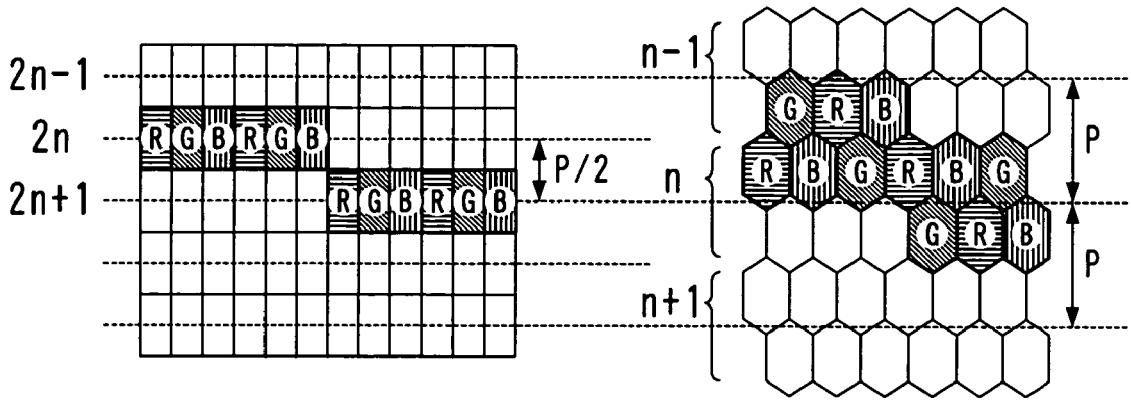
FIGS. 16A and 16B are diagrams showing examples of a process for both arrangement conversion and resolution conversion.
Figure 16B:
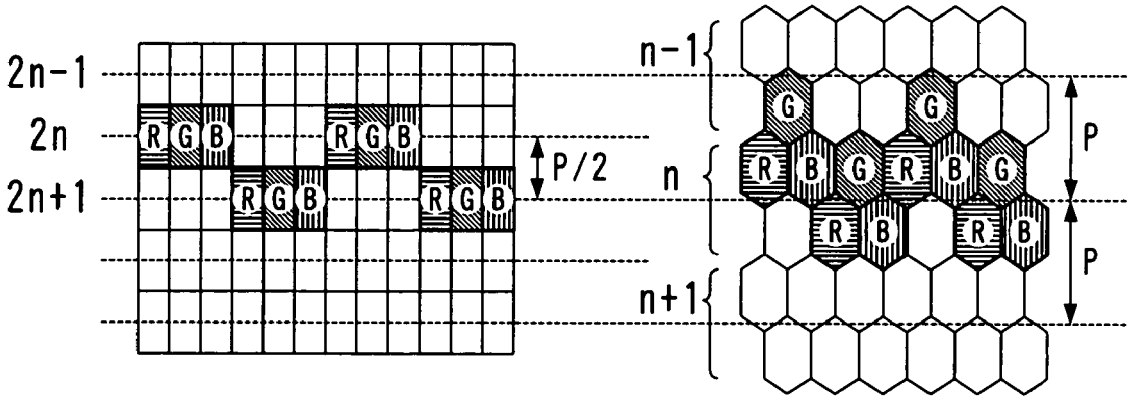

FIGS. 16A and 16B show examples of the arrangement conversion. The illustrated arrangement conversion also works as resolution conversion in the ratio of 2:1. The display pattern shown in FIG. 16A is a zigzag pattern of a two-pixel period. The display pattern shown in FIG. 16B is a zigzag pattern of a one-pixel period that is the finest pattern. The illustrated conversion is performed by assigning a pixel value to cells having most similar position relationship without performing an operation of distributing an input pixel value to plural cells. Since the cell position in the column direction is shifted between neighboring columns by a half pitch in the delta arrangement, image data in the orthogonal arrangement having a vertical pixel pitch P/2 can be displayed on the delta arrangement screen having a vertical dot pitch P while maintaining information of lighted pixel positions.

However, when displaying an image having a high frequency component as shown in FIG. 16B, location positions of three colors of the zigzag pattern that can be reproduced on the delta arrangement screen become nonuniform, so that color shift may become conspicuous. Namely, the upper portion of the zigzag pattern may be observed as green color, and the lower portion may be observed as a mixed color of red color and blue color. The color shift is a sort of false signal. As understood from the above explanation, when displaying an image in the orthogonal arrangement on the delta arrangement screen, it is necessary to perform low pass filtering for limiting the space frequency.

Figure 17:
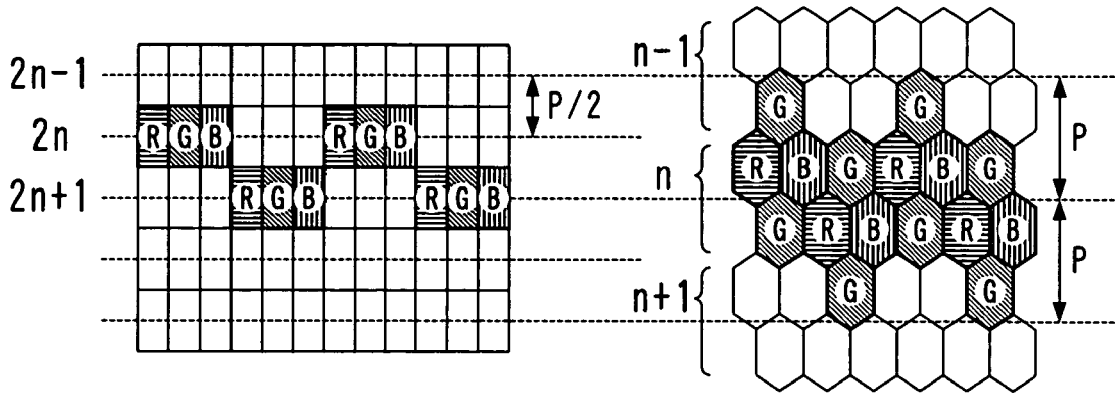
FIG. 17 is a diagram showing an example of a process for each of the arrangement conversion, the resolution conversion and band limitation that is common to three colors.

FIG. 17 shows an example of a data process for limiting the space frequency together with the conversion process shown in FIG. 16A or 16B. The limitation of the space frequency shown in FIG. 17 is common to three colors of R, G and B. Here, the limitation of the space frequency is a process for dispersing luminance to plural cells by an operation on cells neighboring in the vertical direction so as to narrow the space frequency band in the vertical direction. For example, noting cells in the delta arrangement, the add operation with weighting is performed on the luminance of the noted cell using luminance data at the corresponding position in the orthogonal arrangement image and luminance data of the closest two cells (neighboring cells) that have the same light emission color and are positioned at the upper and the lower sides of the noted cell. An example of an expression for the calculation is ((upper neighboring data)+(data of the corresponding position)×2+(lower neighboring data))/3. In FIG. 17, the light emission is dispersed in the vertical direction by the low pass filtering, so that the problem of the color shift is suppressed.

As the low pass filtering is performed, it is inevitable that sharpness is deteriorated. Particularly, if sharpness of a cell whose light emission color is green (G) is deteriorated, halation of the image becomes conspicuous. This is because of the general characteristic that sensitivity and a resolution of human vision is high for green color. It is effective against the deterioration of sharpness to perform filtering of characteristics different from other light emission colors for at least green color.

Figure 18:
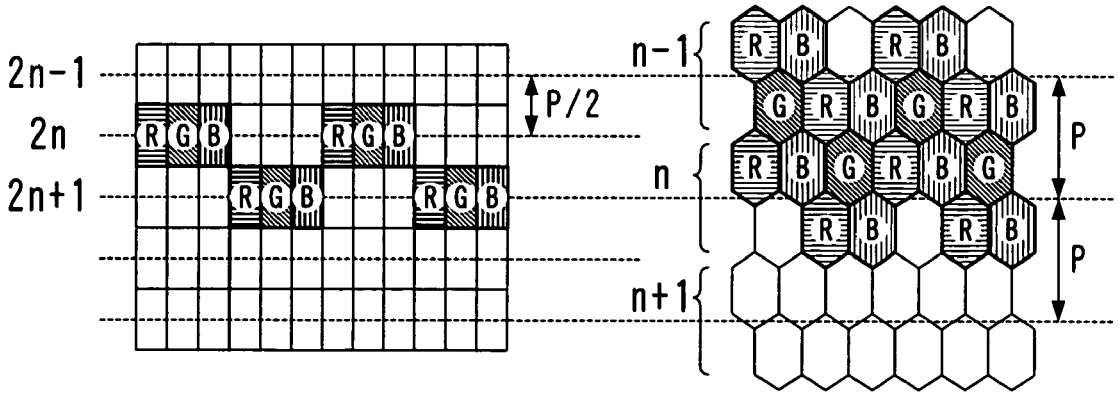
FIG. 18 is a diagram showing an example of a process for each of the arrangement conversion, the resolution conversion and band limitation for colors R and B.

FIG. 18 shows an example of a data process for limiting the space frequency of light emission colors R and B together with the conversion process shown in FIG. 16A or 16B. The limitation of the space frequency is not performed for the light emission color G. A common limitation is performed for the light emission colors R and B. Switching of filter characteristics for each light emission color can be realized easily by changing the coefficients of the add operation with weighting. An example of an expression for the calculation for the light emission colors R and B is ((upper neighboring data)×5+(data of the corresponding position)×7+(lower neighboring data))/12. In FIG. 18, sharpness of the light emission color G is maintained, and the light emission of the light emission colors R and B is dispersed so that the problem of the color shift is suppressed.

Next, a circuit structure of the image display apparatus 100 will be explained.

Figure 19:
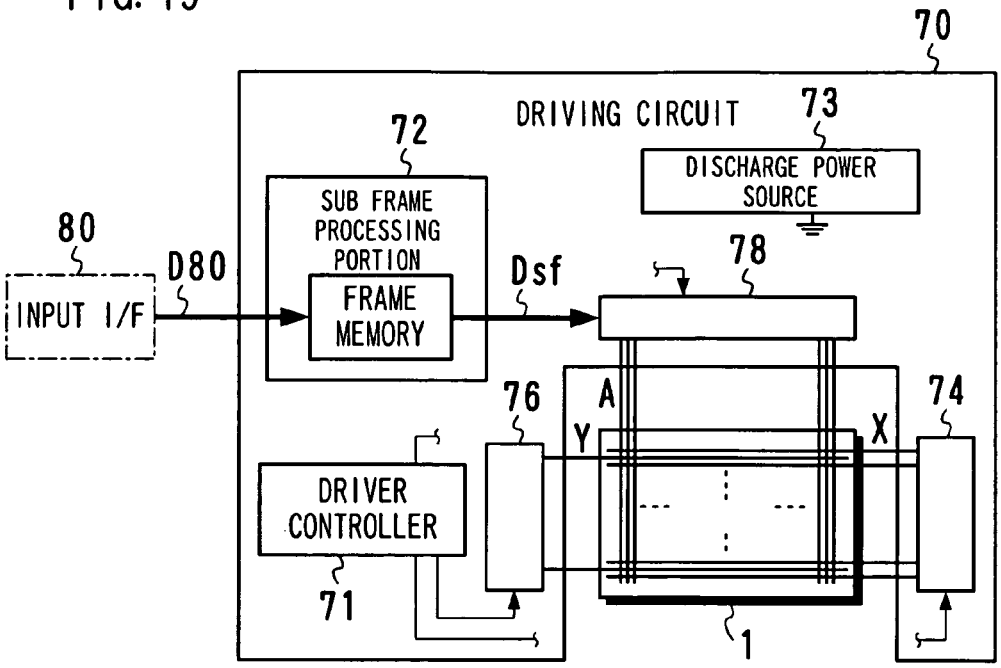
FIG. 19 is a diagram showing a structure of a driving circuit.

FIG. 19 shows a structure of the driving circuit. The driving circuit 70 includes a driver controller 71, a sub frame processing portion 72, a discharge power source 73, an X-driver 74, a Y-driver 76 and an A-driver 78. The driving circuit 70 is provided with frame data D80 that are image data in the delta arrangement from the input interface 80. The sub frame processing portion 72 converts the frame data D80 into the sub frame data Dsf for a gradation display. The sub frame data Dsf indicate whether or not the cell is lighted in each of plural sub frames (a binary image) that represent a frame (a multivalued image), more specifically whether or not address discharge is necessary. The X-driver 74 applies a drive voltage to the display electrode X, while the Y-driver 76 applies a drive voltage to the display electrode Y. The Y-driver 77 includes a scan circuit that enables individual potential control for the display electrode Y. The A-driver 78 applies a drive voltage corresponding to the sub frame data Dsf to the address electrode A.

Figure 20:
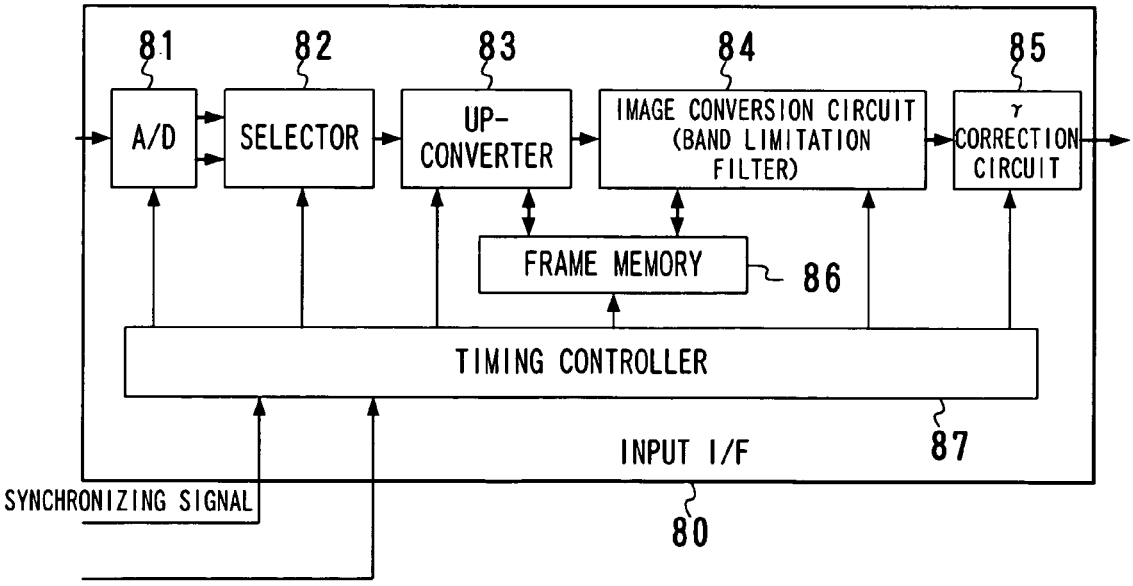
FIG. 20 is a diagram showing a structure of an input interface.

FIG. 20 shows a structure of the input interface. The input interface 80 includes an A/D converter 81, a selector 82, an up-converter 83, an image conversion circuit 84, a gamma correction circuit 85, a frame memory 86, and a timing controller 87. The input interface 80 receives both an interlace format image such as a television image and a progressive format image such as a computer output. These images are converted from analog to digital. Then, one of the images is selected by the selector 82 and is sent to the up-converter 83. The up-converter 83 enhances a resolution of the image so as to perform the filtering precisely in a later stage. On this occasion, the frame memory 86 is utilized for memorizing the image temporarily. The image conversion circuit 84 works as an image filter (a low pass filter) for limiting the space frequency, which is unique to the present invention as explained above. The gamma correction circuit 85 adjusts luminance of the image so as to adapt it to display characteristics of the plasma display panel 1. The signal process in the input interface 80 is controlled by the timing controller 87.

The timing controller 87 decides which image the input image is among a standard television image, a high definition television image, a VGA image, an XGA image or other image. When a standard of the image is determined, a resolution thereof is also determined. Since desired image quality is different between a television image and a computer image, it is better to process in a way suitable for the image. For example, in the case of a television image that is mainly a natural image, a first mode is adopted in which limitation of the space frequency (the band limitation) is performed so as to reduce a partial dropout of the image information. In the case of a computer output including a line drawing of a one-pixel width, a second mode is adopted in which the limitation of the space frequency is not performed since a higher priority is given to sharpness. It is determined which process is related to a result of deciding the image in advance by evaluating results of displays of various images. It is possible that a user selects a process in accordance with his/her taste in this example.

Figure 21:
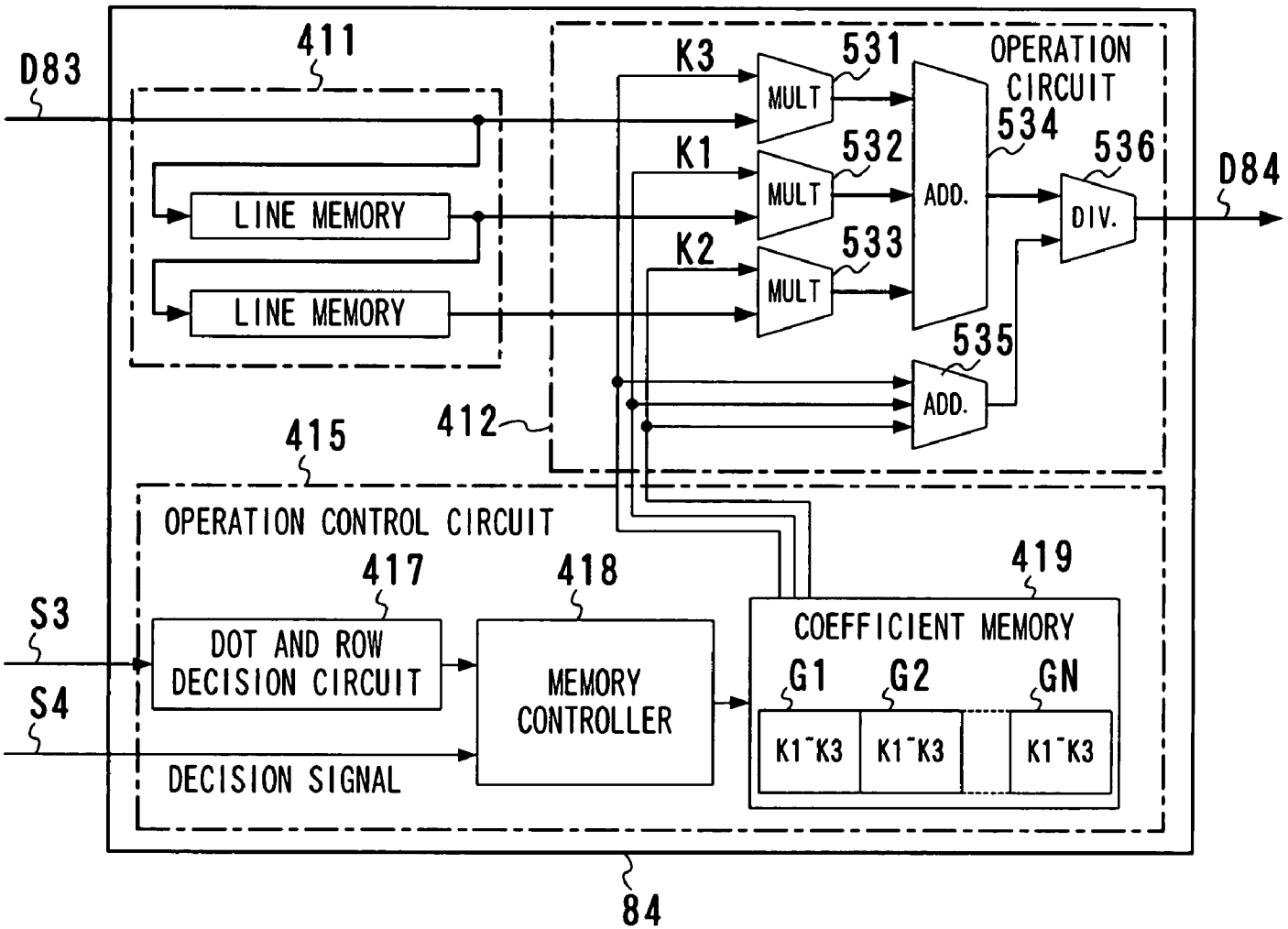
FIG. 21 is a diagram showing a structure of an image conversion circuit.

FIG. 21 shows a structure of the image conversion circuit 84. The image conversion circuit 84 includes a memory circuit 411, an operation circuit 412 and an operation control circuit 415. The memory circuit 411 includes a line memory having a two-stage structure for memorizing input data of two rows. Image data D83 entered in the order of the pixel arrangement become through outputs of the memory circuit 411. The image data D83 with a delay time of one-line transmission time and the image data D83 with a delay time of two-line transmission time are delivered simultaneously. In this way, data of pixels of total three rows at the same position in the horizontal direction are given to the operation circuit 412 simultaneously. In the operation circuit 412, multipliers 531, 532 and 533 multiply the input data by the coefficients K1, K2 and K3, respectively. An adder 534 adds three products obtained by the multipliers. The coefficients K1, K2 and K3 make a set among plural coefficient sets G1, G2, . . . GN that are stored in the coefficient memory 419 of the operation control circuit 415 in advance. In the operation control circuit 415, a dot and row decision circuit 417 decides a row position and a pixel position in the image data in accordance with a synchronizing signal S3 responding to the data input to the operation circuit 412. Corresponding to a combination of the output of the dot and row decision circuit 417 and a mode designation signal S4 that is entered via the timing controller, a memory controller 418 reads a set of coefficients K1, K2 and K3 from the coefficient memory 419. For example, when performing the above-mentioned conversion shown in FIG. 17, the coefficients (K2, K1 and K3), i.e., (1, 2 and 1) are read out. When performing the conversion shown in FIG. 18, the coefficients (K2, K1 and K3), i.e., (5, 7 and 1) are read out responding to the data input of the light emission colors R and B. Furthermore, it is possible to calculate a sum of coefficients for all coefficient sets in advance for storing the sum in the coefficient memory 419, and to read out the coefficient set and the sum of the coefficients for giving them to the operation circuit 412 when the coefficients K1, K2 and K3 are given to the multiplier, without being limited to the illustrated structure in which the sum (K1+K2+K3) of the coefficients K1, K2 and K3 is calculated by the adder 535 and is given to the divider 536. The image data D84 obtained by the operation is sent to the gamma correction circuit.

There are some variations of the above-explained circuit structure as follows.

The image data D83 includes R data, G data and B data for each one pixel. The data for one pixel is transmitted in series in the order of R, G and B, so that one operation circuit 412 can process in series. In this case, one circuit shown in FIG. 21 is sufficient. In addition, it is possible to provide three circuits shown in FIG. 21, so that R data, G data and B data can be processed in parallel. In this case, the dot and row decision circuit 417, the memory controller 418 and the coefficient memory 419 can be common to three circuits and may have a structure for performing three different operations at one time. If three circuits are provided, the operation speed can be increased three times (the operation time can be reduced to ⅓) compared with the case of one circuit.

As a variation of the memory circuit 411, there is a structure in which a frame memory is provided instead of the line memory. The structure using the frame memory can be free from limitation of the number of rows in data that are used for the operation, so that the operation can be performed in accordance with data in a wide range within the input image. If the input image has a high resolution, it is desirable to perform the operation in accordance with data in a wide range.

Figure 22:
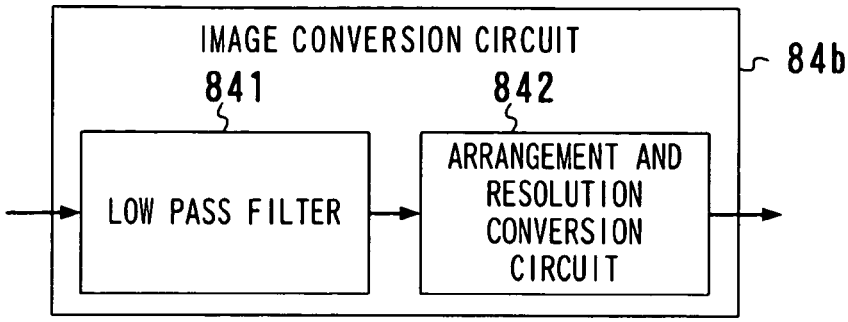
FIG. 22 is a diagram showing another structure of the image conversion circuit.

Concerning a circuit structure of the image conversion, a two-stage structure may be adopted like the image conversion circuit 84*b* shown in FIG. 22, which includes a low pass filter 841 and an arrangement and resolution conversion circuit 842. In this way, circuits that are adapted to the filtering and the arrangement and resolution conversion can be designed.

In the image conversion circuits 84 and 84*b* according to the present invention, plural operations that were set individually can be combined and be performed as one operation. Namely, it is possible to make a coefficient set for combining a smoothing process for preventing a straight line from being viewed in a zigzag shape and an operation having an effect of an edge emphasizing filter together with the band limitation (low pass filtering), the arrangement conversion and the resolution conversion.

The add operation with weighting that is related to the filtering process and the arrangement and resolution conversion (a convolution operation) can be switched in accordance with not only the resolution and the frame format but also with a type of information of the input image (e.g., a static image or a moving image, a natural image or a computer image, much or little of character information and others), and instruction of a user. This switching enables a display image to have high image quality effectively.

Figure 23A:
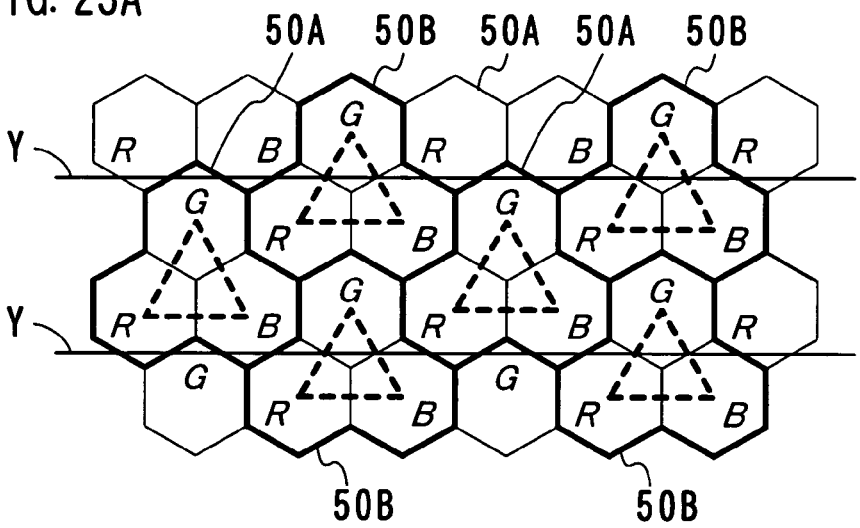
FIG. 23 is a diagram showing another dot structure in a color display.
Figure 23B:
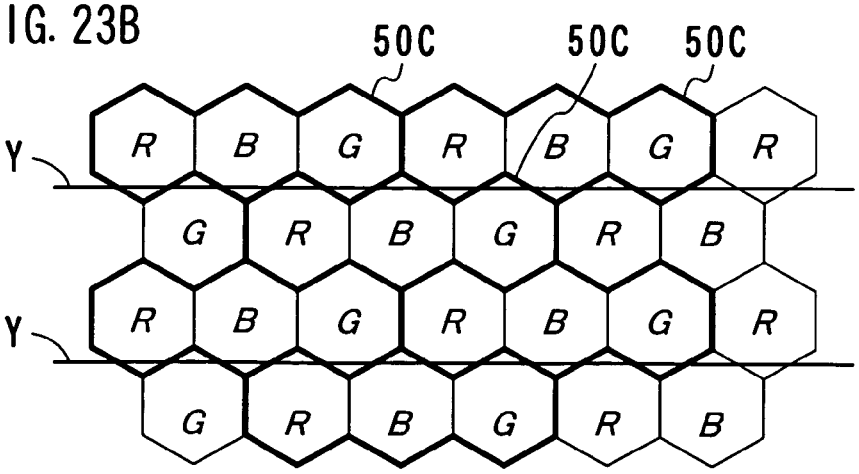

The dot arrangement in the screen 60 of the plasma display panel 1 is not limited to the example shown in FIG. 13. There is another embodiment shown in FIG. 23A in which dots 50A and 50B are arranged side by side, or another embodiment shown in FIG. 23B in which three cell are aligned to constitute a dot 50C.

Figure 24:
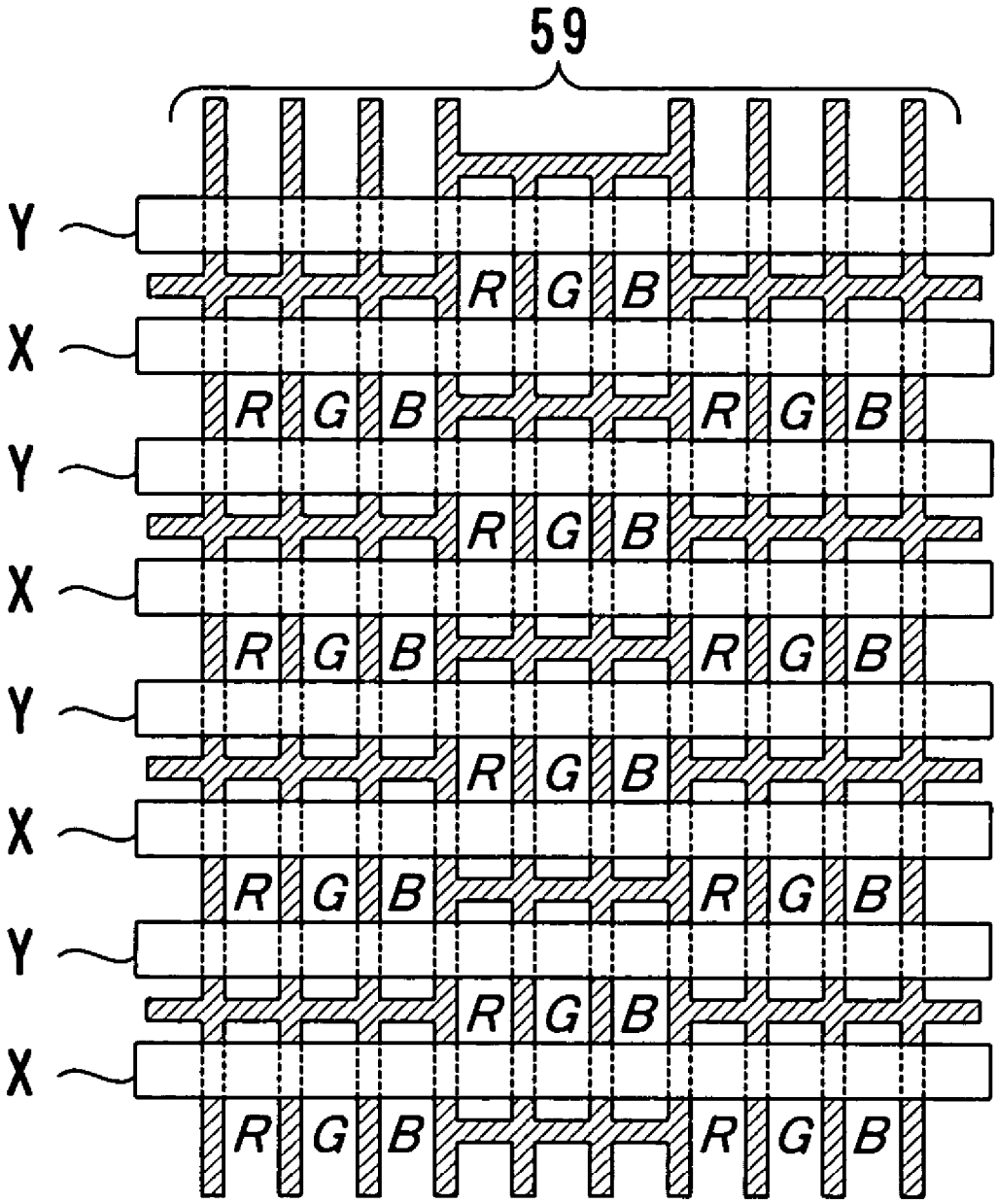
FIG. 24 is a diagram showing another example of the partition pattern.

In addition, the present invention can be applied to a display device having a partition 59 that is a set of linear band-like walls as shown in FIG. 24 for forming a screen having a delta arrangement type cells without being limited to the display device having the meandering partition. The number of terminals for an input image can be three or more.

Second Embodiment

In this embodiment, low pass filtering is performed, which includes band limitation in the diagonal direction for further improving display quality by a delta panel.

Figure 25:
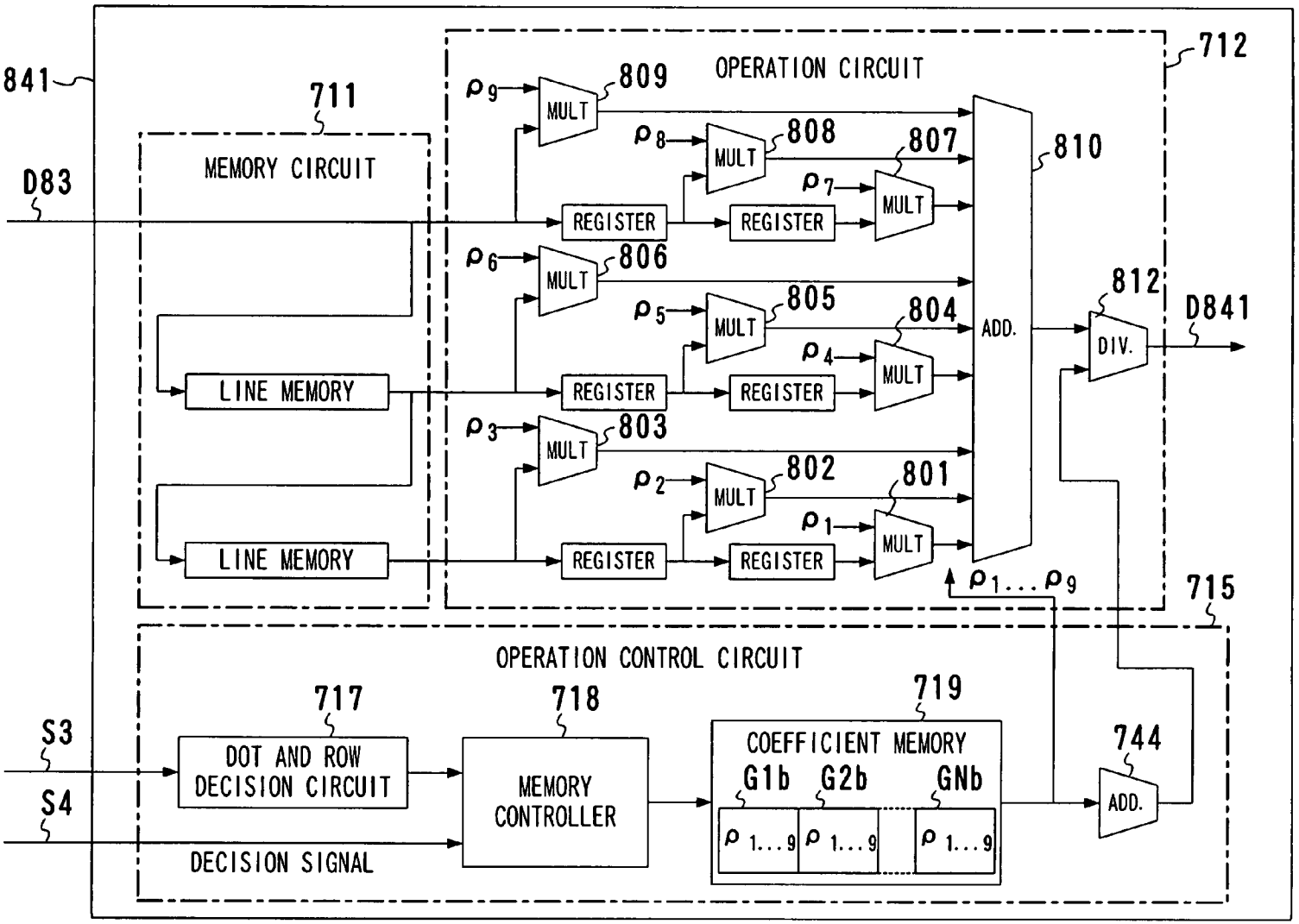
FIG. 25 is a diagram showing an example of a structure of a low pass filter.

FIG. 25 shows an example of a structure of a low pass filter. The image conversion circuit 84 includes a memory circuit 711, an operation circuit 712 and an operation control circuit 715. The memory circuit 711 includes a line memory having a two-stage structure for memorizing input data of two rows. Image data D83 entered in the order of the pixel arrangement become through outputs. The image data D83 with a delay time of one-line transmission time and the image data D83 with a delay time of two-line transmission time are delivered simultaneously. In this way, data of pixels of total three rows at the same position in the horizontal direction are given to the operation circuit 712 simultaneously. The operation circuit 712 includes nine multipliers, an adder 810, a divider 812 and six registers. The operation can be performed between dots neighboring in the horizontal direction. The register is an element for delaying data by one pixel period, which enables the operation of pixels neighboring in the horizontal direction. The two-stage line memory in the memory circuit 711 and three sets of registers connected in series by a unit of two in the operation circuit 712 enable the neighborhood operation in which a luminance value of one pixel is calculated in accordance with information of total nine data points, i.e., three in the horizontal direction and three in the vertical direction. In the operation circuit 712, the multipliers 801, 802, 803, 804, 805, 806, 807, 808 and 809 multiply the input data by coefficients $\rho_1$, $\rho_2$, $\rho_3$, $\rho_4$, $\rho_5$, $\rho_6$, $\rho_7$, $\rho_8$ and $\rho_9$, respectively. The adder 810 adds nine products obtained by the multipliers. The coefficient $\rho_1$, $\rho_2$, . . . $\rho_9$ are coefficients of the neighborhood operation and constitute one set of plural coefficient sets G1*b*, G2*b*, . . . GNb that are stored in the coefficient memory 719 of the operation control circuit 715 in advance. In the operation control circuit 415, the dot and row decision circuit 717 decides a row position and a data point position of the image data in accordance with the synchronizing signal S3 in response to the data input to the operation circuit 712. In accordance with a combination of the output of the dot and row decision circuit 717 and a mode designation signal S4 that is entered via the timing controller, the memory controller 718 reads out one set of the coefficients $\rho_1$, $\rho_2$, . . . $\rho_9$ from the coefficient memory 719. When the coefficients $\rho_1$, $\rho_2$, . . . $\rho_9$ are given to the multipliers, a sum of the coefficients $\rho_1$, $\rho_2$, . . . $\rho_9$ is calculated by the adder 744 and supplied to the divider 812. The image data D841 obtained by the operation is delivered to a post circuit.

Hereinafter, the low pass filtering will be explained in detail.

EXAMPLE 1

Figure 5:
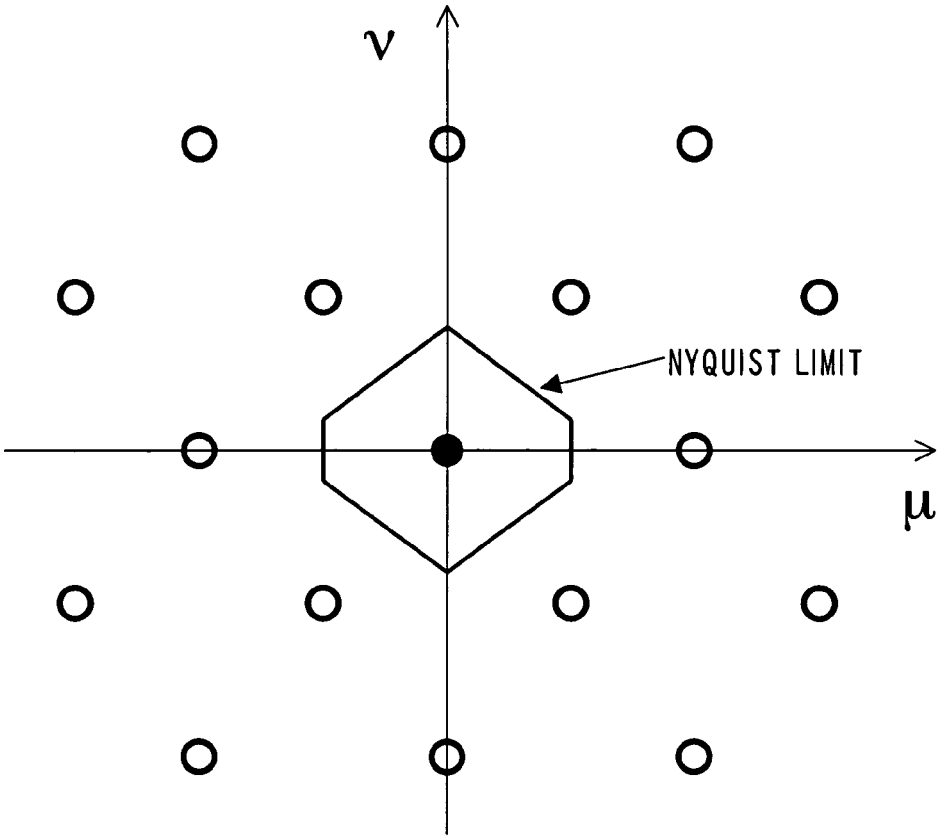
FIG. 5 is a diagram showing spectrum centers of an original signal and aliasing (in the delta arrangement).
Figure 6:
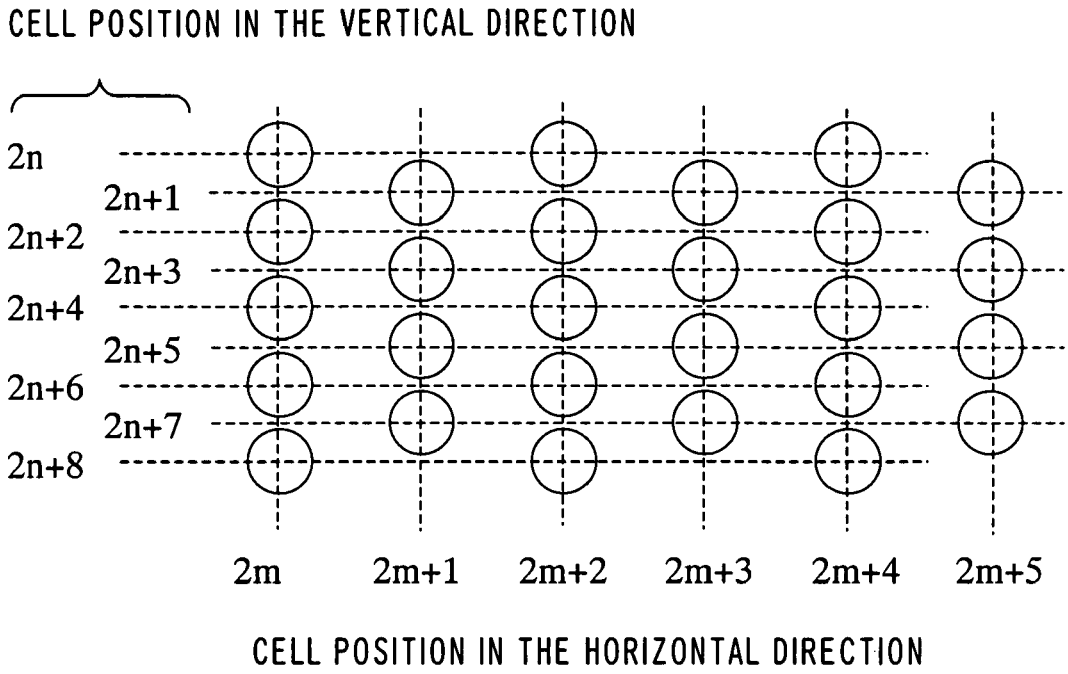
FIG. 6 is a diagram showing numbering of cell positions (for R and B).
Figure 7:
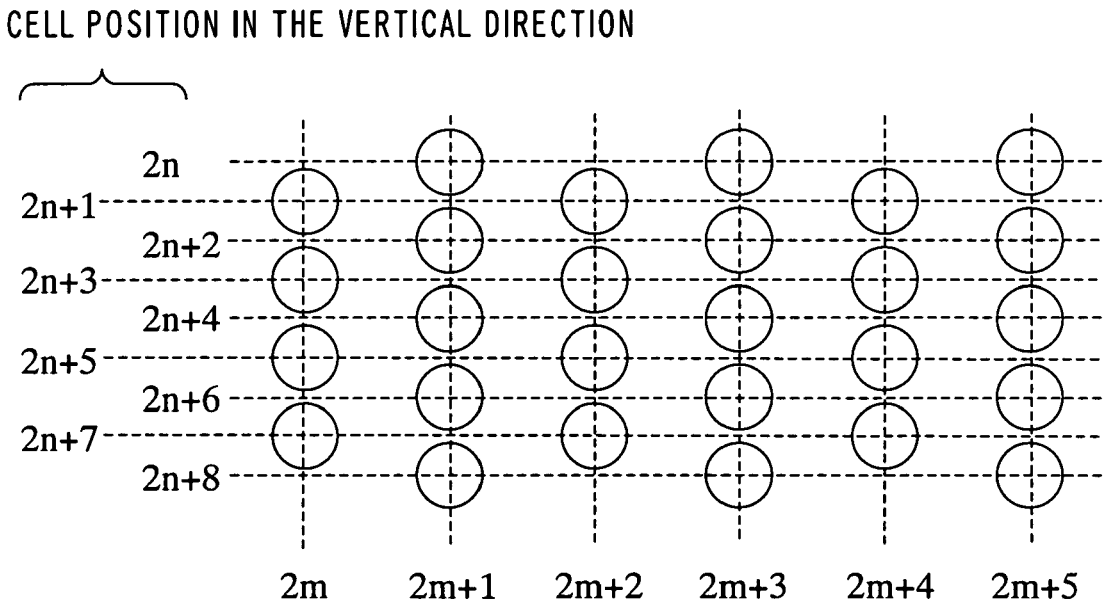
FIG. 7 is a diagram showing numbering of cell positions (for G).
Figure 8:
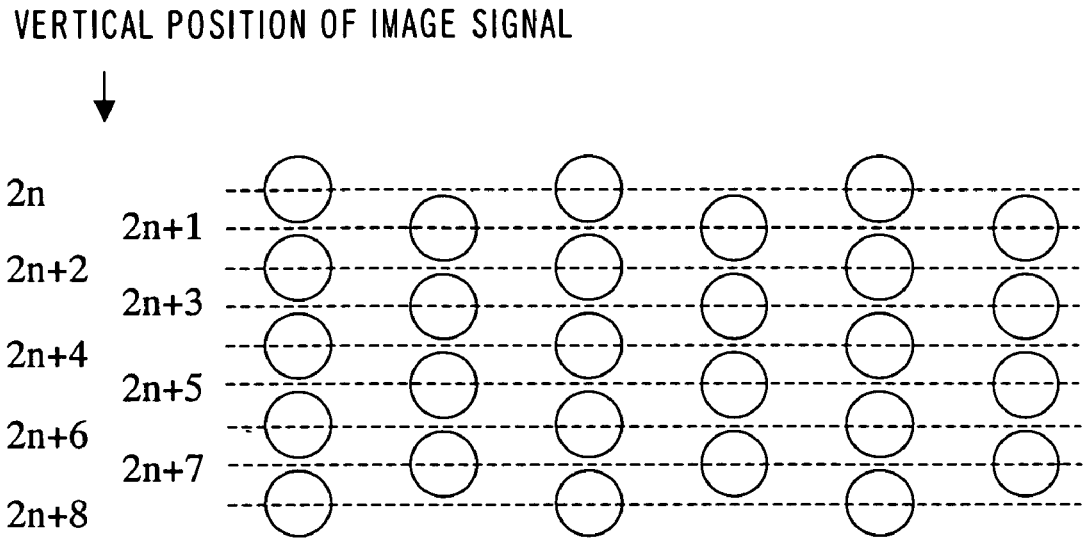
FIG. 8 is a diagram showing a relationship between positions of an image signal and cells.
Figure 8:
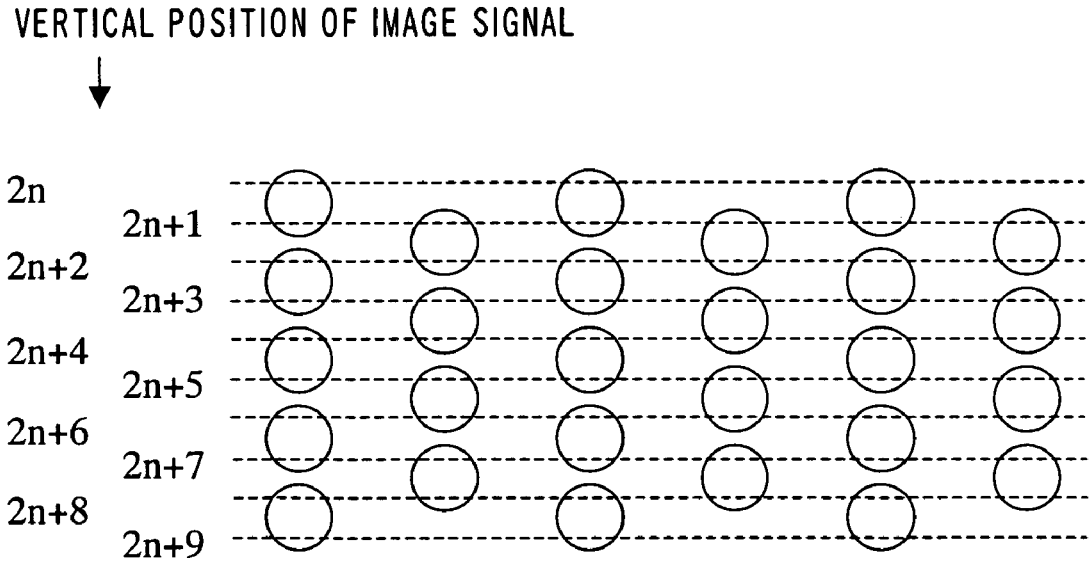

First, an ideal filter characteristic to be a target is that a space frequency component within the Nyquist limit shown in FIG. 5 passes the filter without attenuation, while a space frequency component outside the Nyquist limit is cut off completely.

Figure 26:
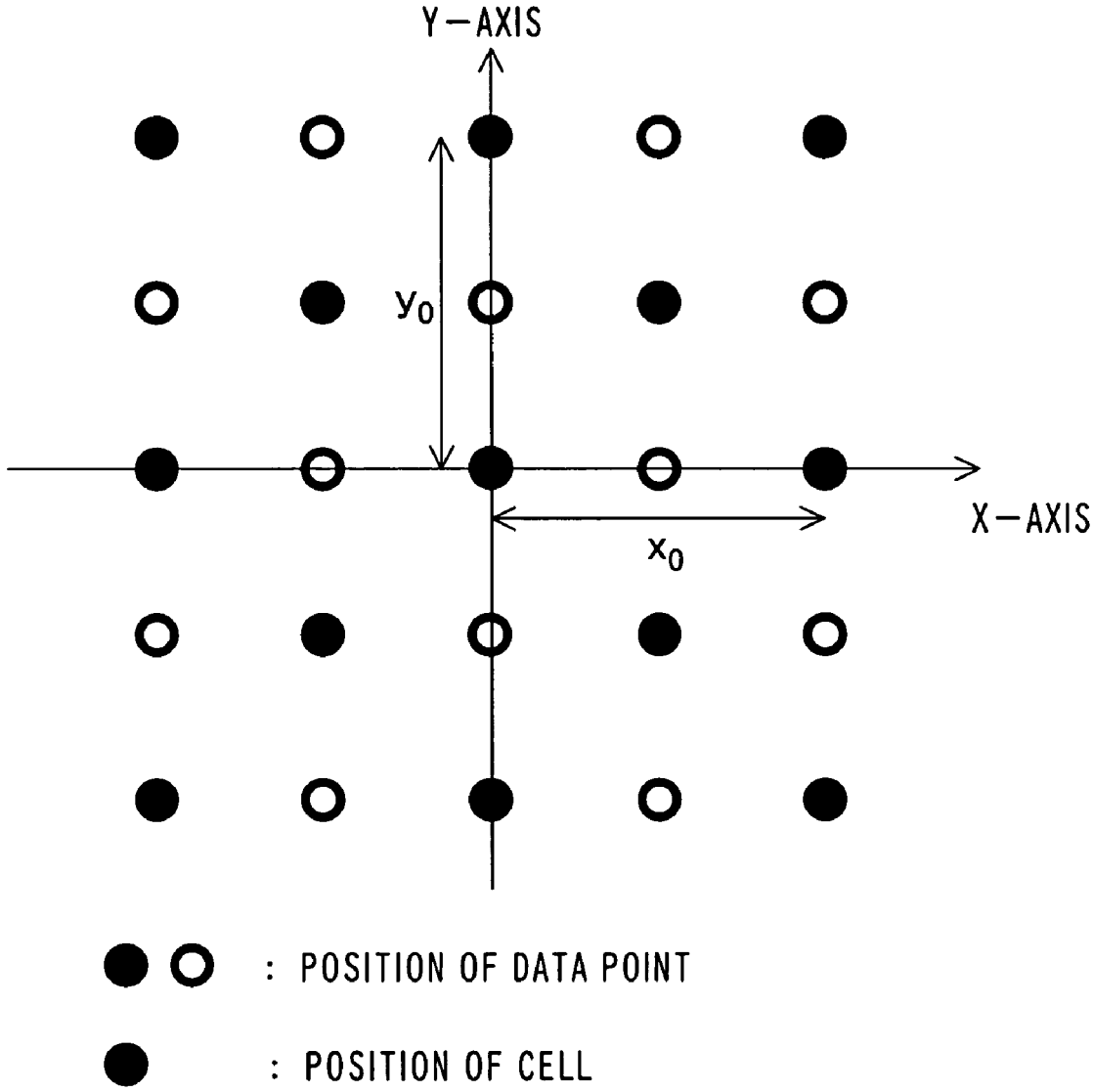
FIG. 26 is a diagram showing a position of a cell and a position of a data point (in Type A).
Figure 27:
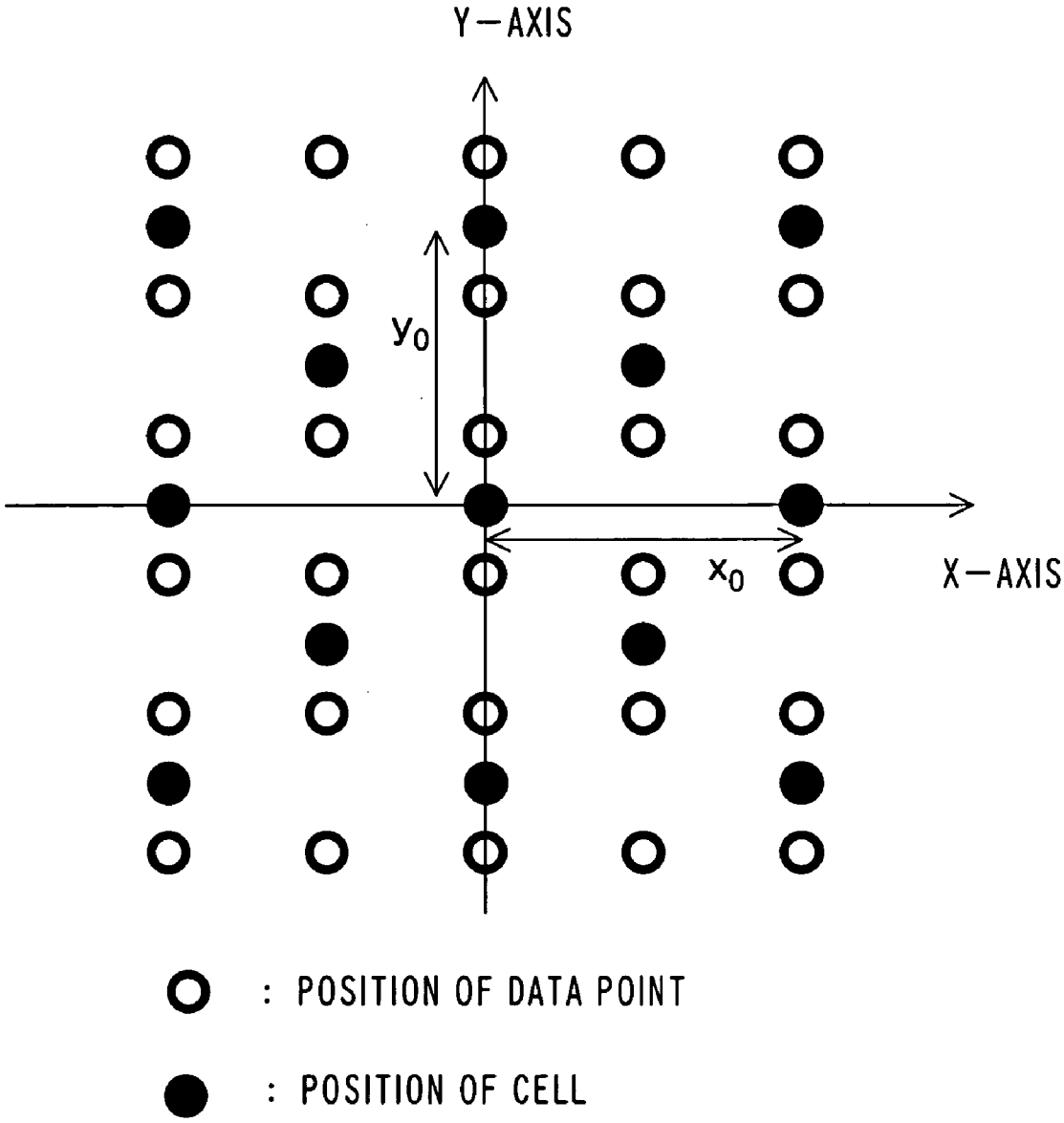
FIG. 27 is a diagram showing a position of a cell and a position of a data point (in Type B).

Next, relationship between a neighborhood operation that is called a neighborhood operation and low pass filter characteristics will be illustrated. FIG. 26 shows a position of a data point and a position of a cell. White circles and black circles indicate positions of data points, while black circles indicate cell positions. Namely, both a data point and a cell exist at a black circle position. The position relationship between the data point and the cell corresponds to the type A in the conventional structure, so it is called a type A in the present invention, too. In addition, a cell of one color (e.g., green color) is considered now. Moreover, a static image is considered. If the data are of interlace format, it is supposed that data points in both an even field and an odd field are considered. For example, it is supposed that data of an odd line are data of an odd field, while data of an even line are data of an even field.

First, an input image, i.e., an original image is represented by h(x,y), and the Fourier transform thereof is represented by H(μ,ν).

$$H(\mu,\nu)=\int h(x, y)\exp(2\pi i x\mu)\exp(2\pi i y\nu)dxdy \tag{11}$$

Here, μ is a coordinate of the X-axis direction (horizontal direction) in the frequency space, while ν is a coordinate of the Y-axis direction (vertical direction) in the frequency space.

Figure 28:
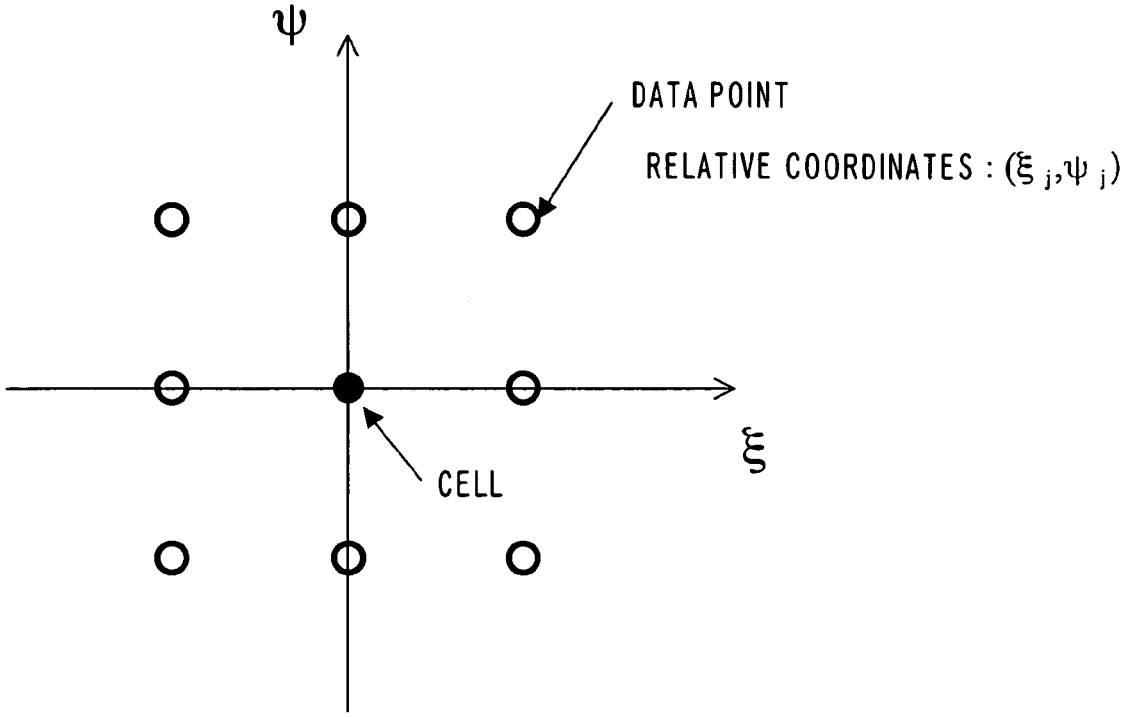
FIG. 28 is a diagram showing a cell and a neighboring data point (in Type A).

A set luminance value of each cell is derived from data of data points in the vicinity thereof. As shown in FIG. 28, when coordinates of data points in the vicinity that are used in the calculation are denoted by $(\xi_j,\psi_j)$ with respect to the cell position, an image that is displayed on the screen of the display apparatus is expressed as follows.

$$hc(x, y) = \sum_m \sum_n \sum_j \left\{\delta(x - mx_0, y - ny_0)\rho_j h(x + \xi_j, y + \psi_j) + \delta\left(x - \left(m + \frac{1}{2}\right)x_0, y - \left(n + \frac{1}{2}\right)y_0\right)\rho_j h(x + \xi_j, y + \psi_j)\right\} \tag{12}$$

Here, m and n are integers and indicate addresses of cell positions. Though the number of cells is finite, a sufficiently large screen is considered for approximation of infinite number of cells. The reference j denotes an address of a data point in the vicinity of a cell and is finite. In addition, $\rho_j$ denotes a weight that is used for adding data of points in the vicinity and is normalized by the following expression.

$$\sum_j \rho_j = 1 \tag{13}$$

Using the relationship as defined by the following expression (14), the expression (12) can be rewritten as shown in expression (15) below.

$$\sum_{m=-\infty}^{\infty} \delta(x - m) = \sum_{k=-\infty}^{\infty} \exp(-2\pi i k x) \tag{14}$$

$$hc(x, y) = \frac{1}{x_0 y_0} \sum_k \sum_l \sum_j \left\{(1 + \exp(k\pi i)\exp(l\pi i)) \exp\left(2\pi i \frac{kx}{x_0}\right)\exp\left(-2\pi i \frac{ly}{y_0}\right) \times \rho_j h(x + \xi_j, y + \psi_j)\right\} \tag{15}$$

Therefore, Fourier transform $H_c(\mu,\nu)$ of the image that is displayed on the screen can be expressed as below.

$$Hc(\mu,\nu)=\int \exp(2\pi i x\mu)\exp(2\pi i y\nu)hc(x,y)dxdy \tag{16}$$
$$=\frac{1}{x_0y_0}\sum_k\sum_l\sum_j\left\{(1+(-1)^{k+l})\rho_j \exp\left(-2\pi i\left(\mu-\frac{k}{x_0}\right)\xi_j\right)\exp\left(-2\pi i\left(\nu-\frac{l}{y_0}\right)\psi_j\right)\times H\left(\mu-\frac{k}{x_0},\nu-\frac{l}{y_0}\right)\right\}$$

Figure 1:
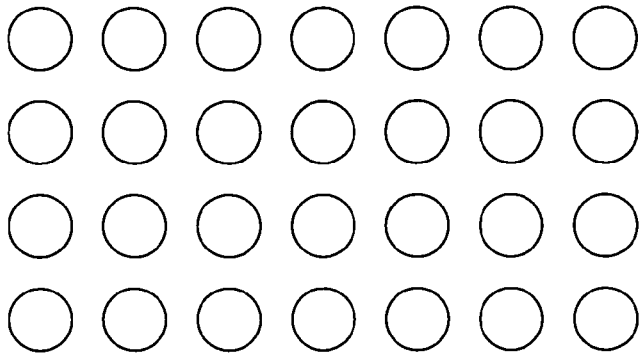
FIG. 1 is a diagram showing an orthogonal arrangement.
Figure 2:
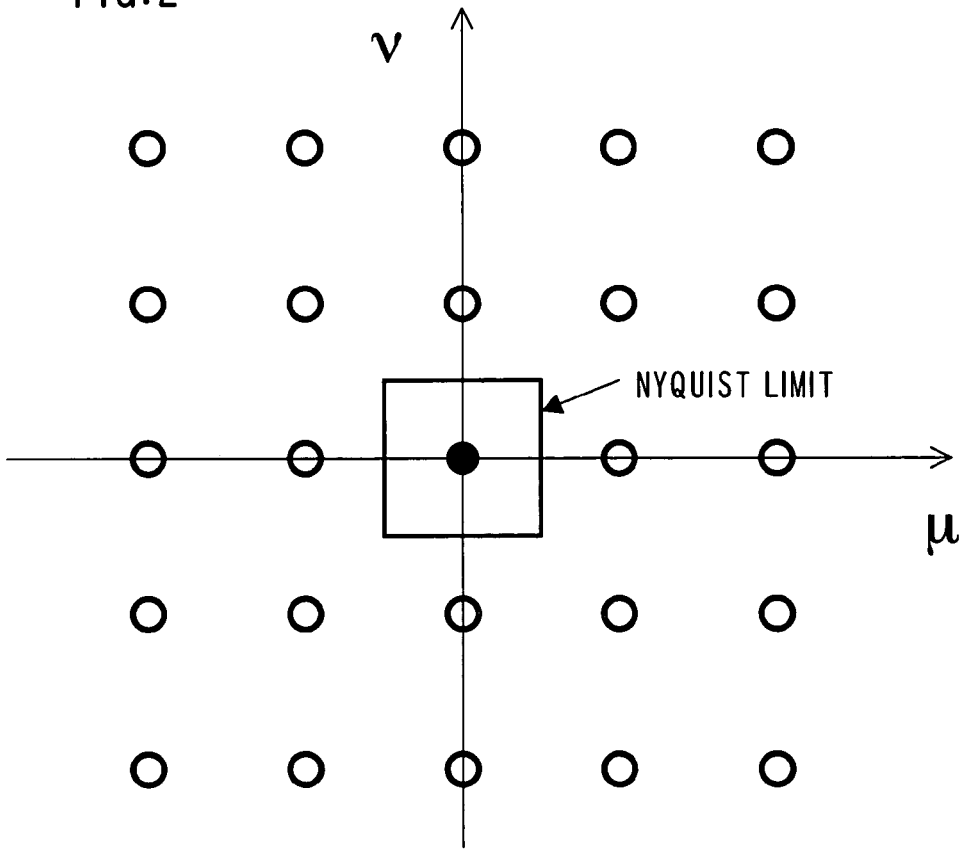
FIG. 2 is a diagram showing spectrum centers of an original signal and aliasing (in the orthogonal arrangement).
Figure 3:
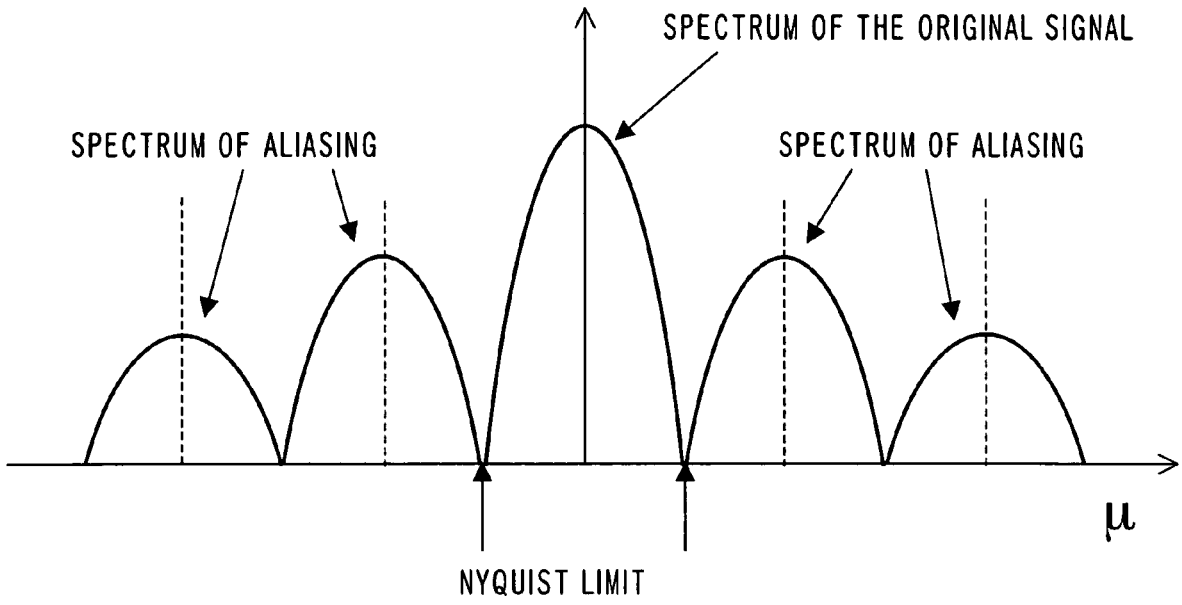
FIG. 3 is a diagram showing a spectrum distribution on a μ-axis.
Figure 4:
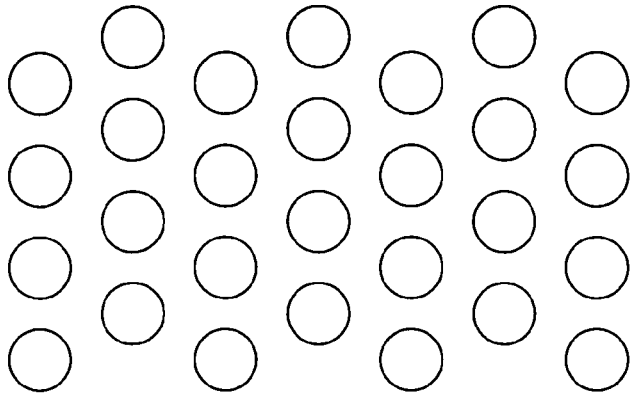
FIG. 4 is a diagram showing a delta arrangement.

In the expression (16), the term of (k,l)=(0,0) corresponds to an original signal spectrum, and other terms correspond to aliasing spectrums (see FIGS. 2 and 5). Furthermore, it is a characteristic of the aliasing spectrum in the delta arrangement that only a term in which k+l is even is not zero.

The term representing the low pass filter characteristics $F(\mu,\nu)$ is as follows.

$$F(\mu,\nu)=\frac{1}{x_0y_0}\sum_j(1+(-1)^{k+l})\rho_j\exp\left(-2\pi i\left(\mu-\frac{k}{x_0}\right)\xi_j\right)\exp\left(-2\pi i\left(\nu-\frac{l}{y_0}\right)\psi_j\right) \tag{17}$$

In the expression (17) too, the case where (k,l)=(0,0) represents the filter characteristics for the original signal spectrum. However, the filter characteristics of the expression (17) are the same for the spectrum and for the aliasing spectrum though a center of the spectrum is different. Hereinafter, the filter characteristics of the original signal spectrum will be handled as a type, and the expression (17) is rewritten as follows.

$$F(\mu,\nu)=\frac{2}{x_0y_0}\sum_j\rho_j\exp(-2\pi i\,\mu\xi_j)\exp(-2\pi i\,\nu\psi_j) \tag{18}$$

This expression is further rewritten as follows by normalizing like F(0,0)=1.

$$F(\mu,\nu)=\sum_j\rho_j\exp(-2\pi i\,\mu\xi_j)\exp(-2\pi i\,\nu\psi_j) \tag{19}$$

This normalized $F(\mu,\nu)$ is used for expressing an ideal low pass filter characteristics as follows.

$$F(\mu,\nu)=\begin{cases}1 & (\mu,\nu)\text{: inside of Nyquist limit}\\ 0 & (\mu,\nu)\text{: outside of Nyquist limit}\end{cases} \tag{20}$$

Figure 30:
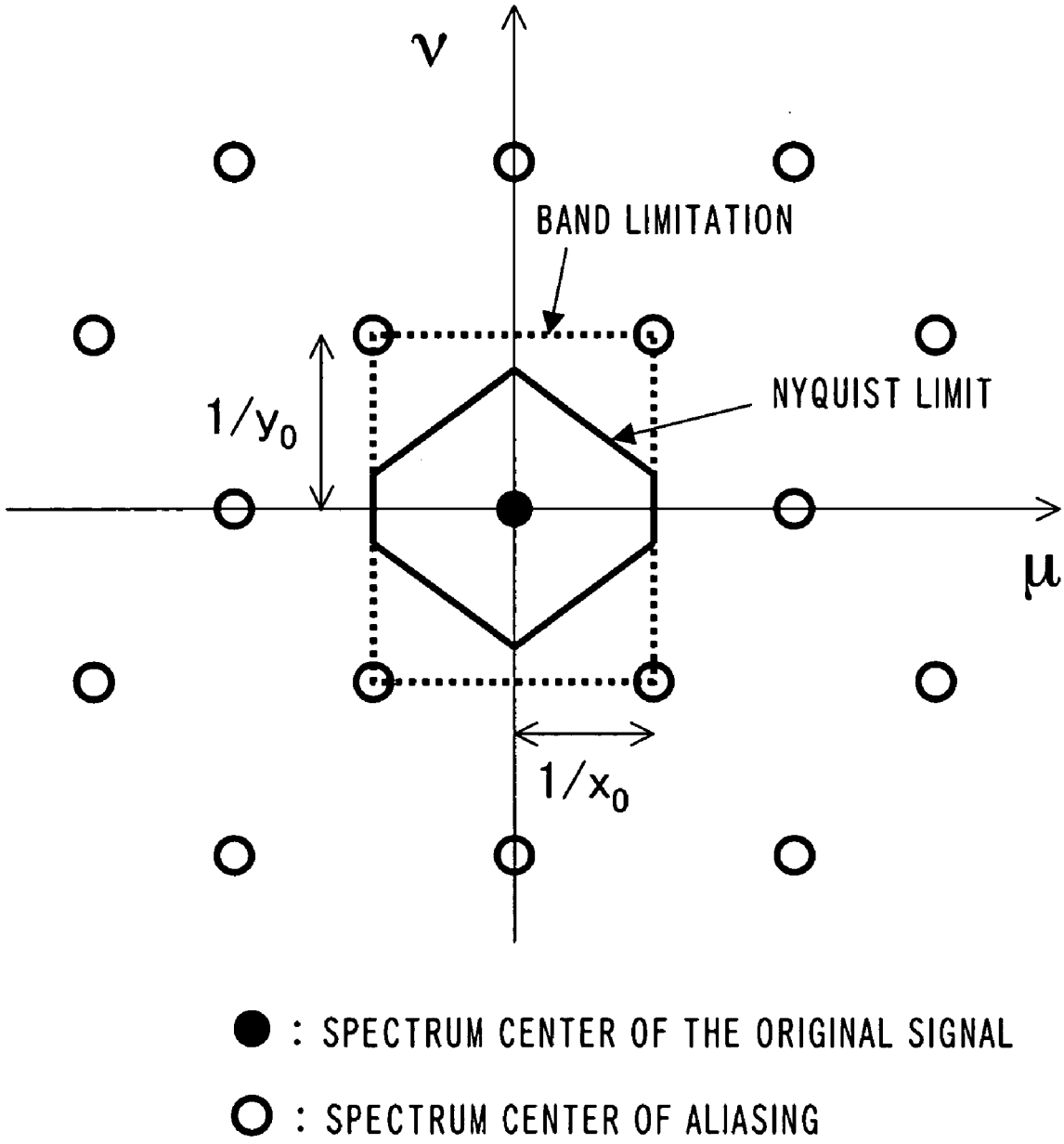
FIG. 30 is a diagram showing an example of band limitation.

Furthermore, the original signal itself usually has the band limitation in the vertical direction and in the horizontal direction. Therefore, the area outside the Nyquist limit as shown in (20) can be considered within the band limitation shown in FIG. 30. Therefore, in order to evaluate the filter characteristics, an error E from the ideal characteristics is evaluated by the following expression. The smaller the value of E is, the better the function is.

$$E=\int_\sigma\{F(\mu,\nu)-1\}^2d\mu d\nu+\int_\tau\{F(\mu,\nu)\}^2d\mu d\nu \tag{21}$$

Figure 31:
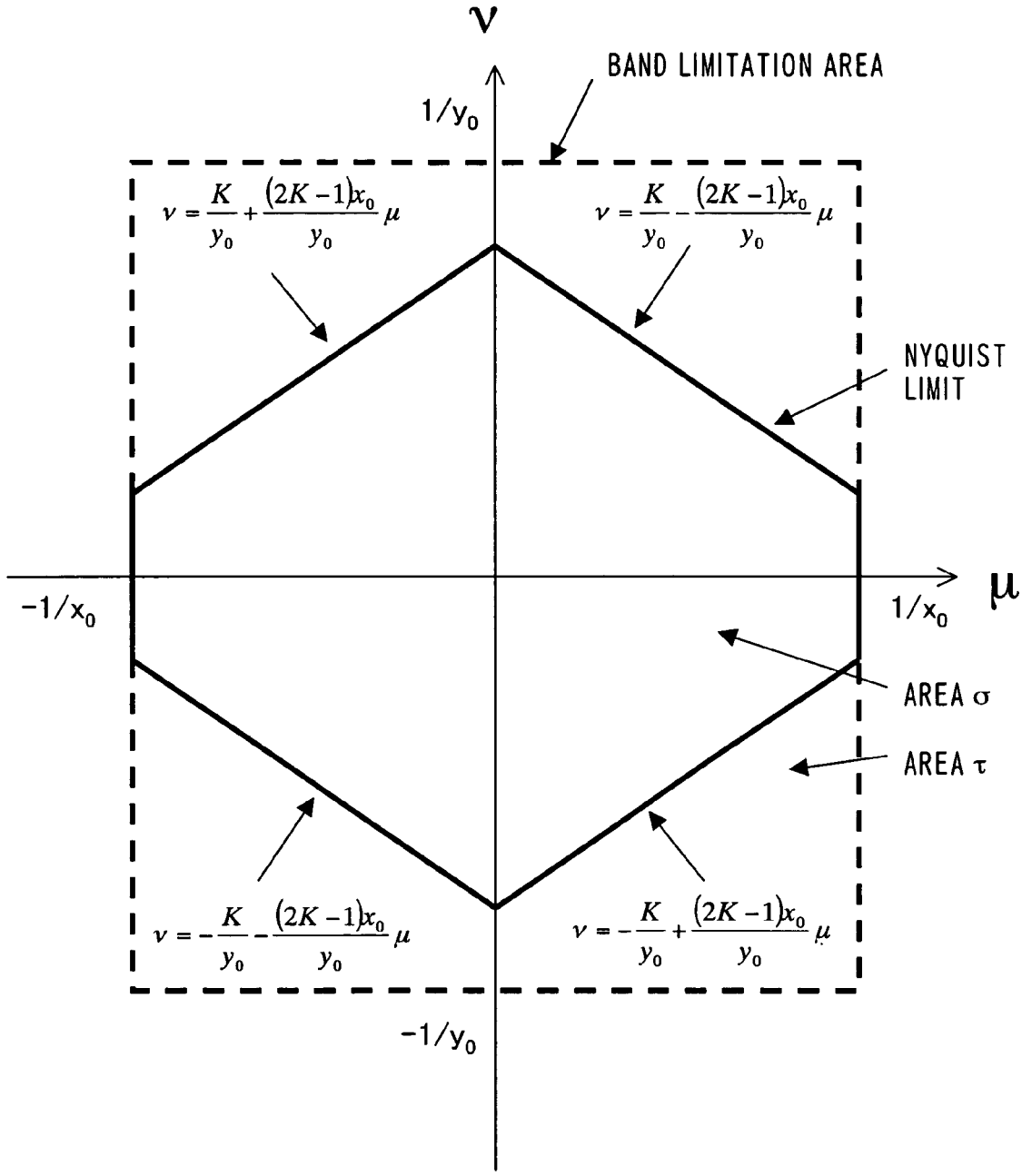
FIG. 31 is a diagram showing Nyquist limit (in detail).

Here, σ denotes an area inside the Nyquist limit, while τ denotes an area outside the Nyquist limit within the band limitation. The detail of the Nyquist limit is shown in FIG. 31. In the first quadrant shown in FIG. 31, the hypotenuse of the Nyquist limit is any line passing through a point of $(\frac{1}{2}x_0, \frac{1}{2}y_0)$. In other quadrants, the line passes the point of the object position. Therefore, using any constant K that is larger than ½, the hypotenuse of the Nyquist limit can be expressed as follows.

$$\left.\begin{aligned}\nu&=\frac{K}{y_0}-\frac{(2K-1)x_0}{y_0}\mu &(\mu>0,\nu>0)\\ \nu&=\frac{K}{y_0}+\frac{(2K-1)x_0}{y_0}\mu &(\mu<0,\nu>0)\\ \nu&=-\frac{K}{y_0}-\frac{(2K-1)x_0}{y_0}\mu &(\mu<0,\nu<0)\\ \nu&=-\frac{K}{y_0}+\frac{(2K-1)x_0}{y_0}\mu &(\mu>0,\nu<0)\end{aligned}\right\} \tag{22}$$

A set value of K is determined as a designing matter considering which should be given more priority the vertical direction or the horizontal direction. Usually, ½<K<1. In addition, the larger the value of K is, the higher the vertical resolution becomes. Designing the low pass filter means determining the coefficients $\rho_j$ that minimize the value of the expression (21). However, an area of the integral operation according to the expression (21) changes in accordance with the value of K, the optimal coefficients $\rho_j$ are naturally different for each value of K.

Figure 32:
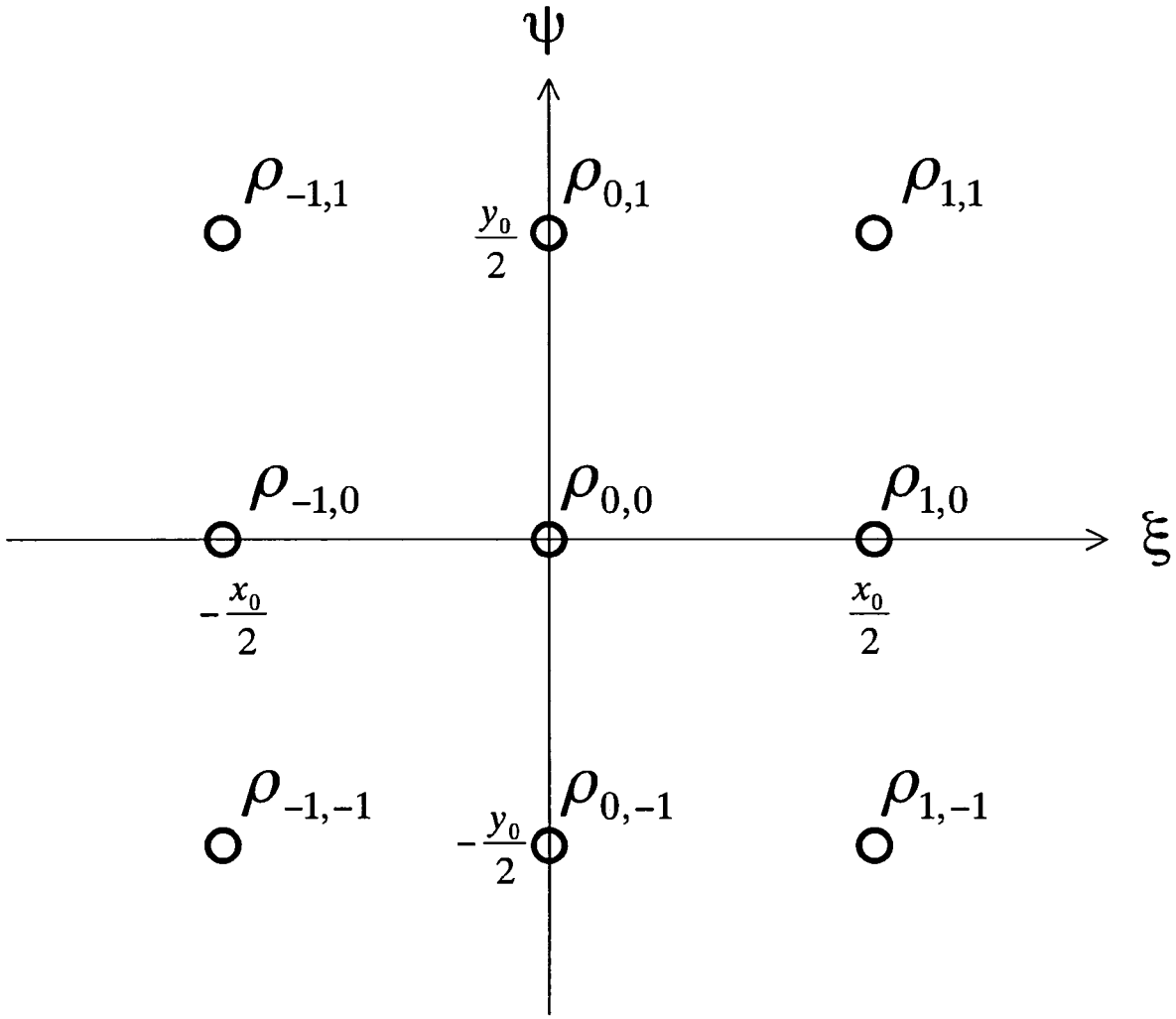
FIG. 32 is a diagram showing weights in a pixel operation (in Example 1).

In this example 1, a low pass filter is considered that is structured by operations of nine data in the vicinity of a cell. This corresponds to the operation according to the expression (9) in the conventional structure. FIG. 32 shows weights in the pixel operation according to this example. The indexes are indicated as $\rho_{r,s}$ from the coordinates of the pixel position. Since there is symmetry of location, the weights also have symmetry as follows.

$$\left.\begin{aligned}\rho_{1,0}&=\rho_{-1,0}\\ \rho_{0,1}&=\rho_{0,-1}\\ \rho_{1,1}&=\rho_{1,-1}=\rho_{-1,1}=\rho_{-1,-1}\end{aligned}\right\} \tag{23}$$

In accordance with this symmetry, the filter characteristics (the expression (19)) can be rewritten as follows.

$$F(\mu,\nu)=\rho_{0,0}+2\rho_{1,0}\cos(\pi x_0\mu)+2\rho_{0,1}\cos(\rho y_0\nu)+4\rho_{1,1}\cos(\rho x_0\mu)\cos(\rho y_0\nu) \tag{24}$$

Then, the expression (24) is assigned to the expression (21), and the integral operation is performed, so that the following expression is obtained.

$$E=\frac{4}{x_0y_0}\left\{6\rho_{1,0}^2+6\rho_{0,1}^2+20\rho_{1,1}^2+8\rho_{1,0}\rho_{0,1}+16\rho_{1,0}\rho_{1,1}+16\rho_{0,1}\rho_{1,1}-\left(\frac{8(2K-1)}{\pi^2}+2\right)\rho_{1,0}+\right. \tag{25}$$

-continued $$\left(\frac{8\cos(K\pi)}{(2K-1)\pi^2}-2\right)\rho_{0,1}-4\rho_{1,1}+\frac{1}{2}\Bigg\}$$

Furthermore, the expression (13) was considered here.

Next, in order to determine the weights that minimize the error E, the following simultaneous equations are solved.

$$\left.\begin{aligned}
0 &= \frac{\partial E}{\partial \rho_{1,0}} \\
&= \frac{4}{x_0 y_0}\left\{12\rho_{1,0}+8\rho_{0,1}+16\rho_{1,1}-\left(\frac{8(2K-1)}{\pi^2}+2\right)\right\} \\
0 &= \frac{\partial E}{\partial \rho_{0,1}} \\
&= \frac{4}{x_0 y_0}\left\{12\rho_{0,1}+8\rho_{1,0}+16\rho_{1,1}+\left(\frac{8\cos(K\pi)}{(2K-1)\pi^2}-2\right)\right\} \\
0 &= \frac{\partial E}{\partial \rho_{1,1}} \\
&= \frac{4}{x_0 y_0}\{40\rho_{1,1}+16\rho_{1,0}+16\rho_{0,1}-4\}
\end{aligned}\right\} \tag{26}$$

When the simultaneous equations are solved, the weights are determined as follows.

$$\left.\begin{aligned}
\rho_{0,0} &= \frac{5}{9}+\frac{4\cos(K\pi)}{9\pi^2(2K-1)}-\frac{4(2K-1)}{9\pi^2} \\
\rho_{1,0} &= \frac{1}{18}+\frac{4\cos(K\pi)}{9\pi^2(2K-1)}+\frac{14(2K-1)}{9\pi^2} \\
\rho_{0,1} &= \frac{1}{18}-\frac{14\cos(K\pi)}{9\pi^2(2K-1)}-\frac{4(2K-1)}{9\pi^2} \\
\rho_{1,1} &= \frac{1}{18}+\frac{4\cos(K\pi)}{9\pi^2(2K-1)}-\frac{4(2K-1)}{9\pi^2}
\end{aligned}\right\} \tag{27}$$

On the other hand, in the expression (9) of the conventional structure, the coefficients of the neighborhood operation, i.e., the weights are as follows.

$$\left.\begin{aligned}
\rho_{0,0} &= \frac{15}{32} \\
\rho_{1,0} &= \rho_{-1,0} = \frac{1}{64} \\
\rho_{0,1} &= \rho_{0,-1} = \frac{15}{64} \\
\rho_{1,1} &= \rho_{-1,1} = \rho_{1,-1} = \rho_{-1,-1} = \frac{1}{28}
\end{aligned}\right\} \tag{28}$$

Since the low pass filter characteristics are not considered in the conventional structure, the value of the expression (28) is different from the value of the expression (27), i.e., the optimal value even if K is set to any value.

Here, the error Ec of the coefficient is defined as follows.

$$Ec = \min_K\left(\sqrt{\frac{\sum_j\left(\rho_j-\rho_j^{opt}(K)\right)^2}{\sum_j\left(\rho_j^{opt}(K)\right)^2}}\right) \tag{29}$$

The reference $\rho^{opt}_j(K)$ is an optimal value of $\rho_j$ that is determined in accordance with the value of K, and it is the value of the expression (27) in this example, for example. In addition, $\rho_j$ in the expression (29) is a coefficient to be evaluated. Moreover, in the expression (29), the error is defined as a minimum value regarding K. The value of K that gives an optimal value that becomes closest to the value of the expression (28) is 0.64, while the error of the coefficient in the expression (28) in the conventional structure is 15.7%.

In a real display apparatus, in order to reduce the cost of means for performing the neighborhood operation or to shorten calculation time, the number of significant figures of the coefficient is decreased so that an approximate value is used. In this case, if the error from a true optimal value in the expression (29) is less than 15.7%, it can be said that it is more effective than the conventional structure.

Furthermore, if the data has an interlace format, when noting one cell, as shown in FIG. 32, data at data points $\rho_{-1,0}$, $\rho_{0,0}$, and $\rho_{1,0}$ that exist in the frame are used in the even field, for example. In the odd field, other data points are used. On this occasion, the value of the coefficient is doubled.

EXAMPLE 2

Figure 29:
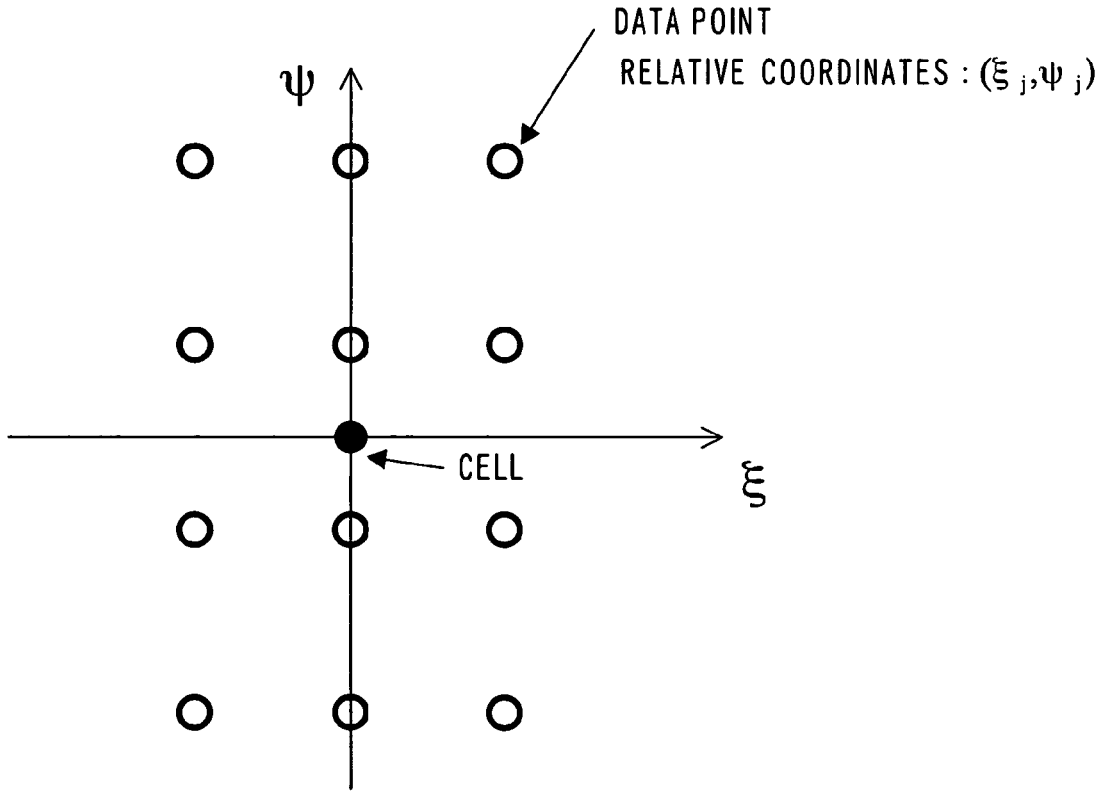
FIG. 29 is a diagram showing a cell and a neighboring data point (in Type B).

In this example, the case of type B will be explained in which a position relationship between the cell and the data point is shown in FIG. 29.

Figure 33:
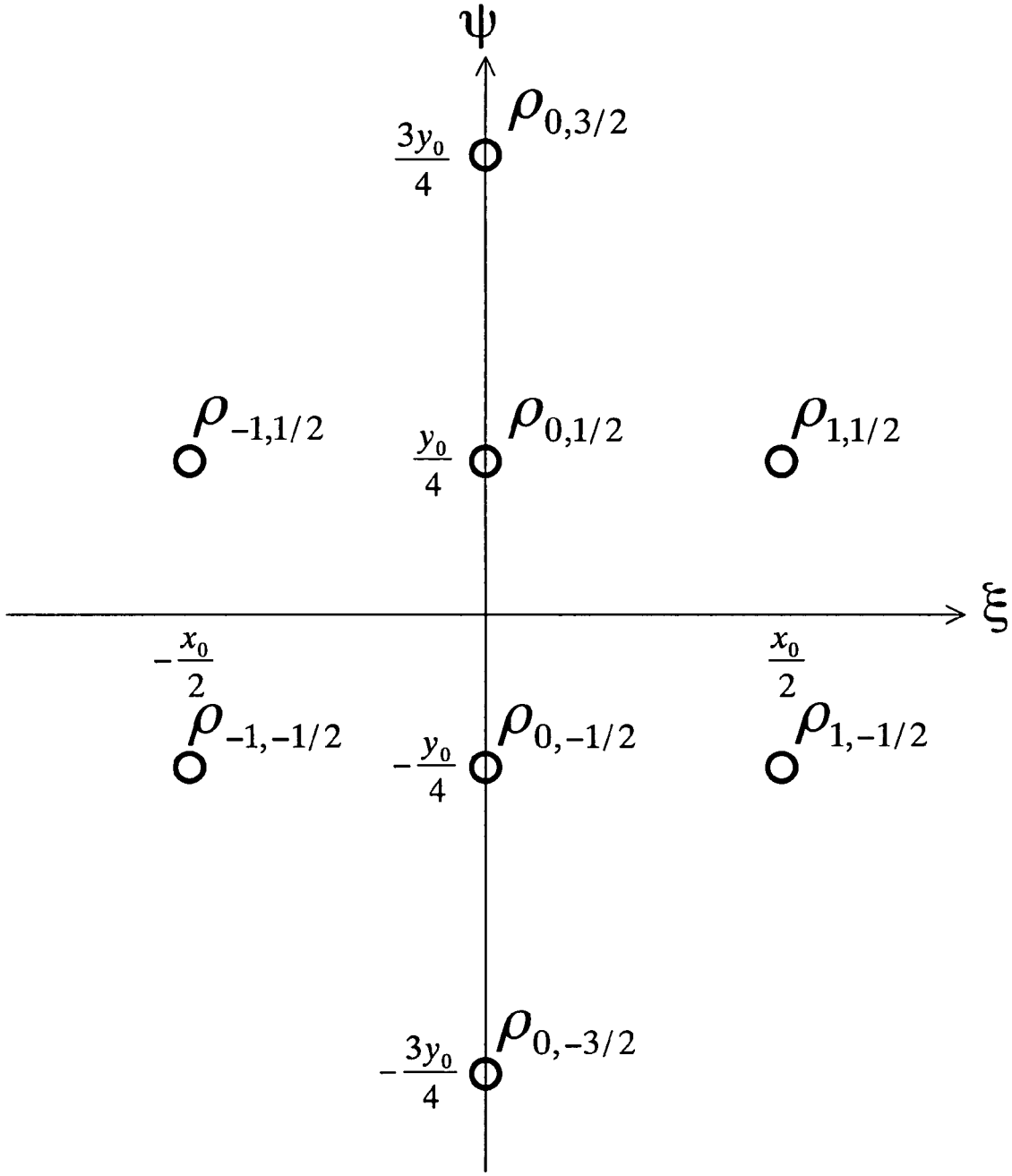
FIG. 33 is a diagram showing weights in the pixel operation (in Example 2).

The weights of the pixel operation are shown in FIG. 33. This corresponds to the expression (10) in the conventional structure. Also in this example, there is the following symmetry derived from the position relationship.

$$\left.\begin{aligned}
\rho_{0,1/2} &= \rho_{0,-1/2} \\
\rho_{0,3/2} &= \rho_{0,-3/2} \\
\rho_{1,1/2} &= \rho_{-1,1/2} = \rho_{1,-1/2} = \rho_{-1,-1/2}
\end{aligned}\right\} \tag{30}$$

The filter characteristics in this case are expressed as follows.

$$\begin{aligned}
F(\mu,\nu) = {} & 2\rho_{0,1/2}\cos\left(\frac{\pi y_0}{2}\nu\right)+2\rho_{0,3/2}\cos\left(\frac{3\pi y_0}{2}\nu\right)+ \\
& 4\rho_{1,1/2}\cos(\pi x_0\mu)\cos\left(\frac{\pi y_0}{2}\nu\right)
\end{aligned} \tag{31}$$

This expression (31) is assigned to the expression (21), and an integral operation is performed. Then, the following expression is obtained.

$$\begin{aligned}
E = \frac{1}{x_0 y_0}\Bigg[ & 3\rho_{0,1/2}^2+3\rho_{0,3/2}^2+2\rho_{0,1/2}\rho_{0,3/2}- \\
& \left\{\frac{16}{2K-1}\left(\sin\left(\frac{K\pi}{2}\right)-\cos\left(\frac{K\pi}{2}\right)\right)+\right. \\
& \left.8\left(\frac{1}{2K-3}+\frac{1}{2K+1}\right)\left(\sin\left(\frac{K\pi}{2}\right)+\cos\left(\frac{K\pi}{2}\right)\right)+1\right\}\rho_{0,1/2}+ \\
& \left\{\frac{16}{9(2K-1)}\left(\sin\left(\frac{3K\pi}{2}\right)+\cos\left(\frac{3K\pi}{2}\right)\right)-\right. \\
& \left.8\left(\frac{1}{2K-3}+\frac{1}{2K+1}\right)\left(\sin\left(\frac{K\pi}{2}\right)+\cos\left(\frac{K\pi}{2}\right)\right)-1\right\}\rho_{0,3/2}+
\end{aligned} \tag{32}$$

-continued $$\frac{4}{\pi^2}\left(\frac{1}{2K-3}+\frac{1}{2K+1}\right)\left(\sin\left(\frac{K\pi}{2}\right)+\cos\left(\frac{K\pi}{2}\right)\right)-\frac{1}{\pi^2}+\frac{1}{4}\Bigg]$$

Furthermore, the expression (13) was considered here.

Next, in order to determine the weights that minimize the error E, the following simultaneous equations are solved.

$$\left.\begin{aligned}
0 &= \frac{\partial E}{\partial \rho_{0,1/2}} \\
&= \frac{1}{x_0 y_0}\left\{6\rho_{0,1/2}+2\rho_{0,3/2}-\frac{16}{2K-1}\left(\sin\left(\frac{K\pi}{2}\right)-\cos\left(\frac{K\pi}{2}\right)\right)-\right. \\
&\quad \left.8\left(\frac{1}{2K-3}+\frac{1}{2K+1}\right)\left(\sin\left(\frac{K\pi}{2}\right)+\cos\left(\frac{K\pi}{2}\right)\right)-1\right\} \\
0 &= \frac{\partial E}{\partial \rho_{0,3/2}} \\
&= \frac{1}{x_0 y_0}\left\{6\rho_{0,3/2}+2\rho_{0,1/2}+\right. \\
&\quad \frac{16}{9(2K-1)}\left(\sin\left(\frac{3K\pi}{2}\right)+\cos\left(\frac{3K\pi}{2}\right)\right)- \\
&\quad \left.8\left(\frac{1}{2K-3}+\frac{1}{2K+1}\right)\left(\sin\left(\frac{K\pi}{2}\right)+\cos\left(\frac{K\pi}{2}\right)\right)-1\right\}
\end{aligned}\right\} \quad (33)$$

When the simultaneous equations are solved, the weights are determined as follows.

$$\left.\begin{aligned}
\rho_{0,1/2} &= \frac{1}{8}+\frac{3}{(2K-1)\pi^2}\left(\sin\left(\frac{K\pi}{2}\right)-\cos\left(\frac{K\pi}{2}\right)\right)+ \\
&\quad \frac{1}{\pi^2}\left(\frac{1}{2K-3}+\frac{1}{2K+1}\right)\left(\sin\left(\frac{K\pi}{2}\right)+\cos\left(\frac{K\pi}{2}\right)\right)+ \\
&\quad \frac{1}{9(2K-1)\pi^2}\left(\sin\left(\frac{3K\pi}{2}\right)+\cos\left(\frac{3K\pi}{2}\right)\right) \\
\rho_{0,3/2} &= \frac{1}{8}-\frac{1}{(2K-1)\pi^2}\left(\sin\left(\frac{K\pi}{2}\right)-\cos\left(\frac{K\pi}{2}\right)\right)+ \\
&\quad \frac{1}{\pi^2}\left(\frac{1}{2K-3}+\frac{1}{2K+1}\right)\left(\sin\left(\frac{K\pi}{2}\right)+\cos\left(\frac{K\pi}{2}\right)\right)- \\
&\quad \frac{1}{3(2K-1)\pi^2}\left(\sin\left(\frac{3K\pi}{2}\right)+\cos\left(\frac{3K\pi}{2}\right)\right) \\
\rho_{1,1/2} &= \frac{1}{8}-\frac{1}{(2K-1)\pi^2}\left(\sin\left(\frac{K\pi}{2}\right)-\cos\left(\frac{K\pi}{2}\right)\right)- \\
&\quad \frac{1}{\pi^2}\left(\frac{1}{2K-3}+\frac{1}{2K+1}\right)\left(\sin\left(\frac{K\pi}{2}\right)+\cos\left(\frac{K\pi}{2}\right)\right)+ \\
&\quad \frac{1}{9(2K-1)\pi^2}\left(\sin\left(\frac{3K\pi}{2}\right)+\cos\left(\frac{3K\pi}{2}\right)\right)
\end{aligned}\right\} \quad (34)$$

On the other hand, in the expression (10) of the conventional structure, the coefficients of the neighborhood operation, i.e., the weights are as follows.

$$\left.\begin{aligned}
\rho_{0,1/2} &= \rho_{0,-1/2} = \frac{23}{64} \\
\rho_{0,3/2} &= \rho_{0,-3/2} = \frac{7}{64} \\
\rho_{1,1/2} &= \rho_{-1,1/2} = \rho_{1,-1/2} = \rho_{-1,-1/2} = \frac{1}{64}
\end{aligned}\right\} \quad (35)$$

The error between the coefficient in the expression (35) of the conventional structure and the optimal solution, i.e., the coefficient in the expression (34) is 11.3%. Furthermore, the optimal solution that is closest to the expression (35) was the case of K=0.69.

In this example 2, if an approximate solution having an error less than 11.3% from the optimal solution is obtained, it can be said that it is more effective than the conventional structure.

Furthermore, if the data has an interlace format, when noting one cell, as shown in FIG. 33, data at data points $\rho_{-1,1/2}$, $\rho_{0,1/2}$, $\rho_{1,1/2}$, and $\rho_{1,-3/2}$ that exist in the frame are used in the even field, for example. In the odd field, other data points are used. On this occasion, the value of the coefficient is doubled.

EXAMPLE 3

Although the difference of the relative position between the data point and the cell depending on a color of the cell is handled approximately in the example 1 and in the example 2, this difference of the relative position can be dealt with more precisely.

Figure 34:
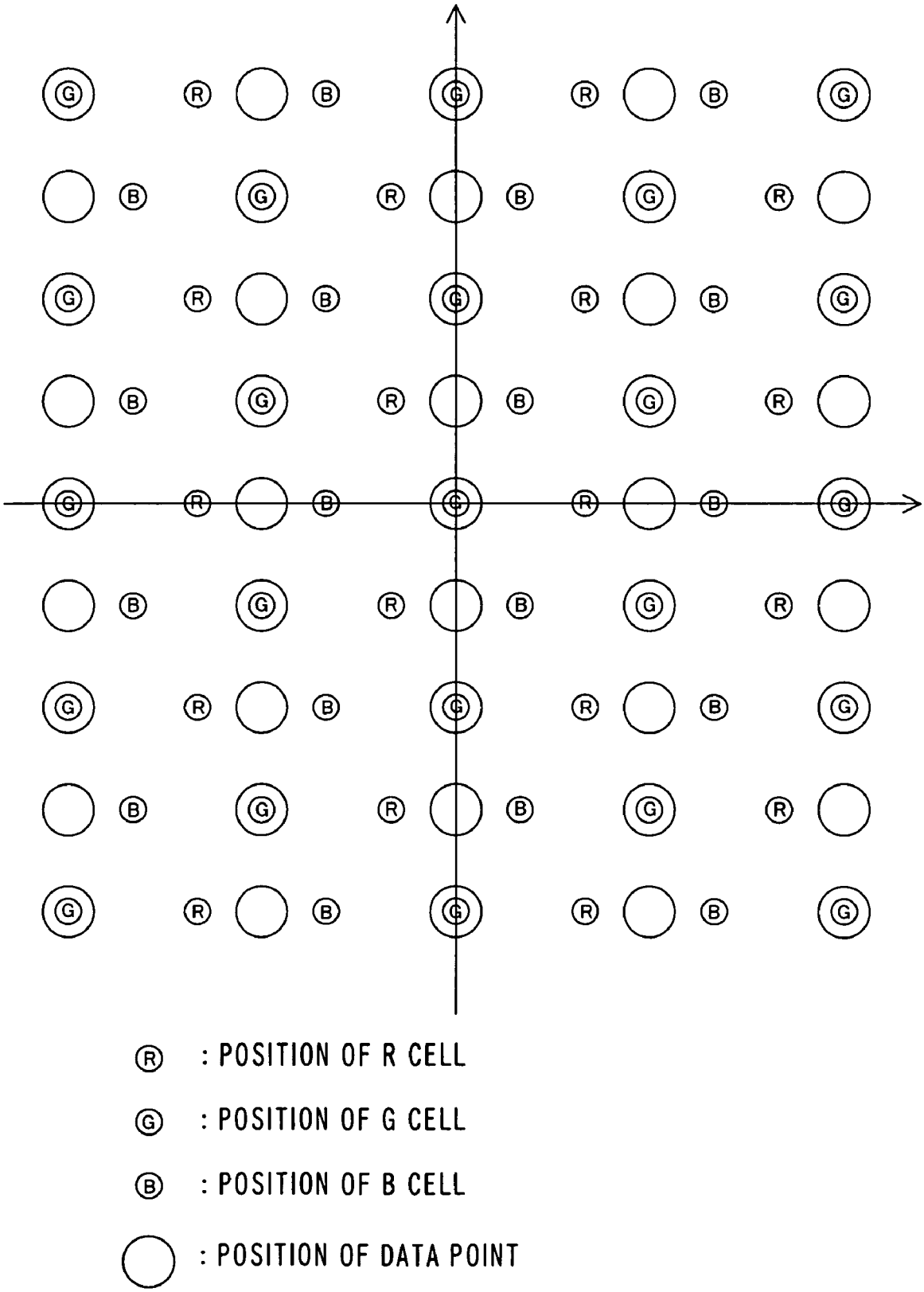
FIG. 34 is a diagram showing cell positions of each color and positions of data points (in Type A).
Figure 35:
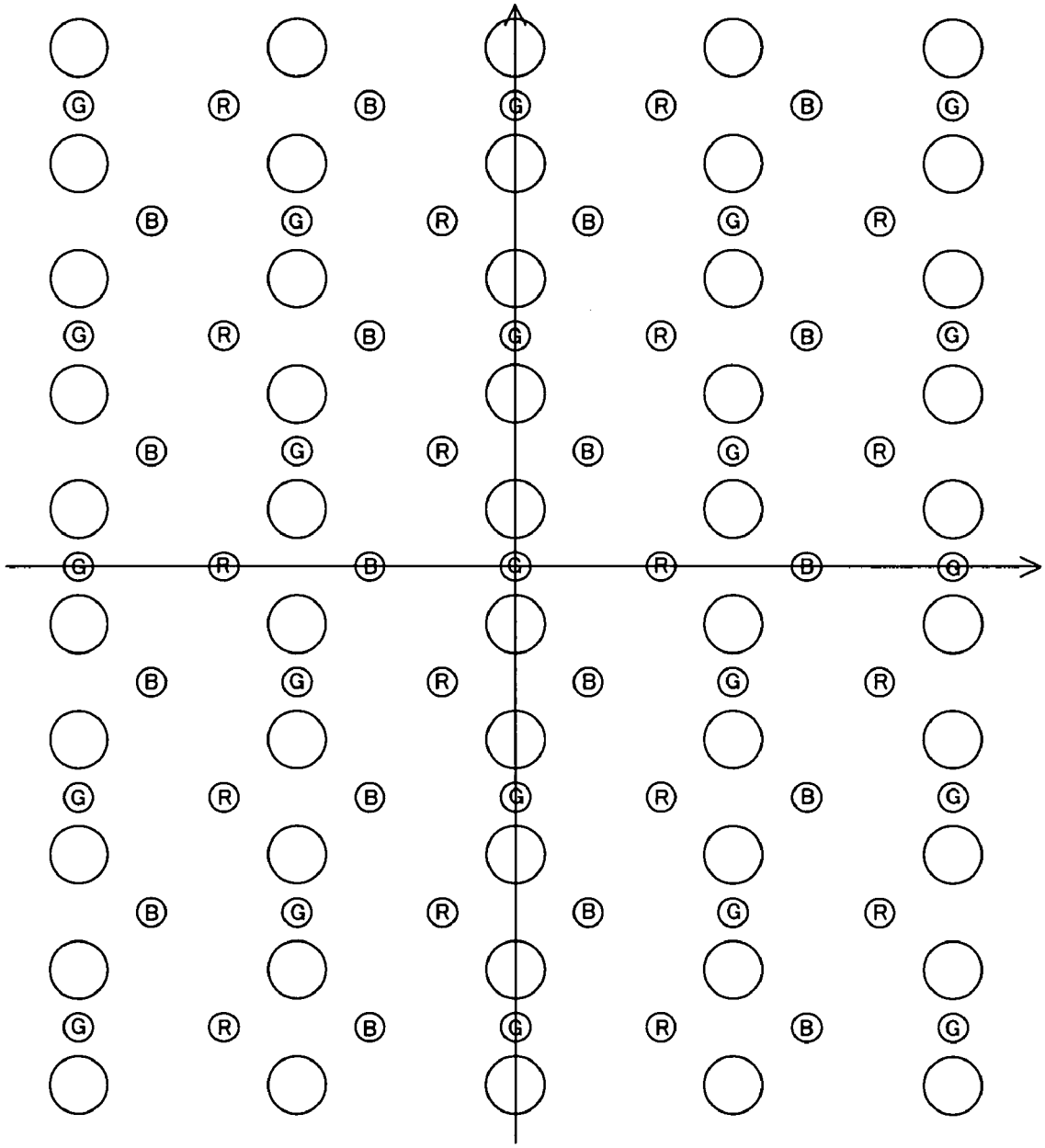
FIG. 35 is a diagram showing cell positions of each color and positions of data points (in Type B).
Figure 36:
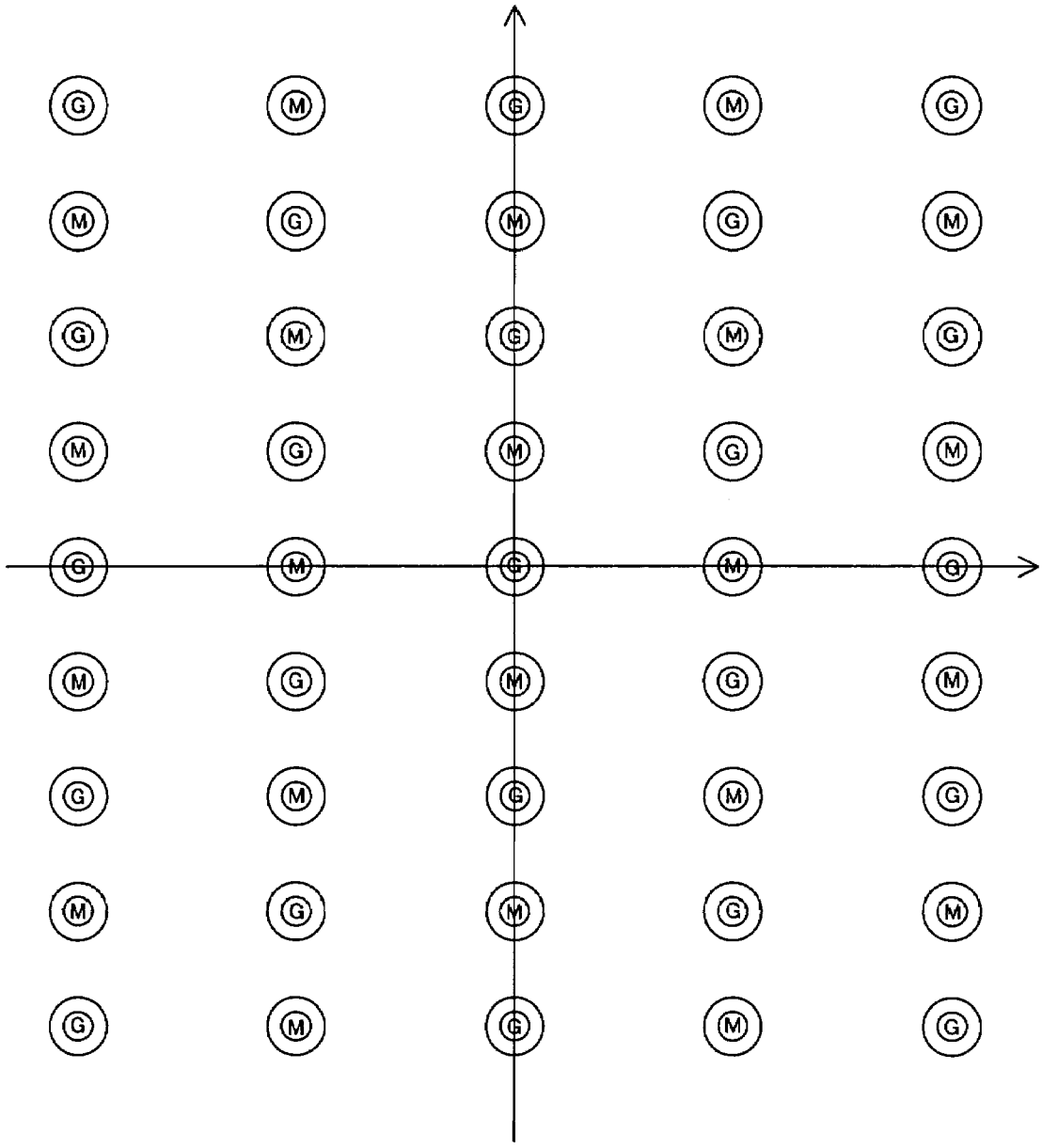
FIG. 36 is a diagram showing cell positions of each color and positions of data points upon approximate calculation (in Type A).
Figure 37:
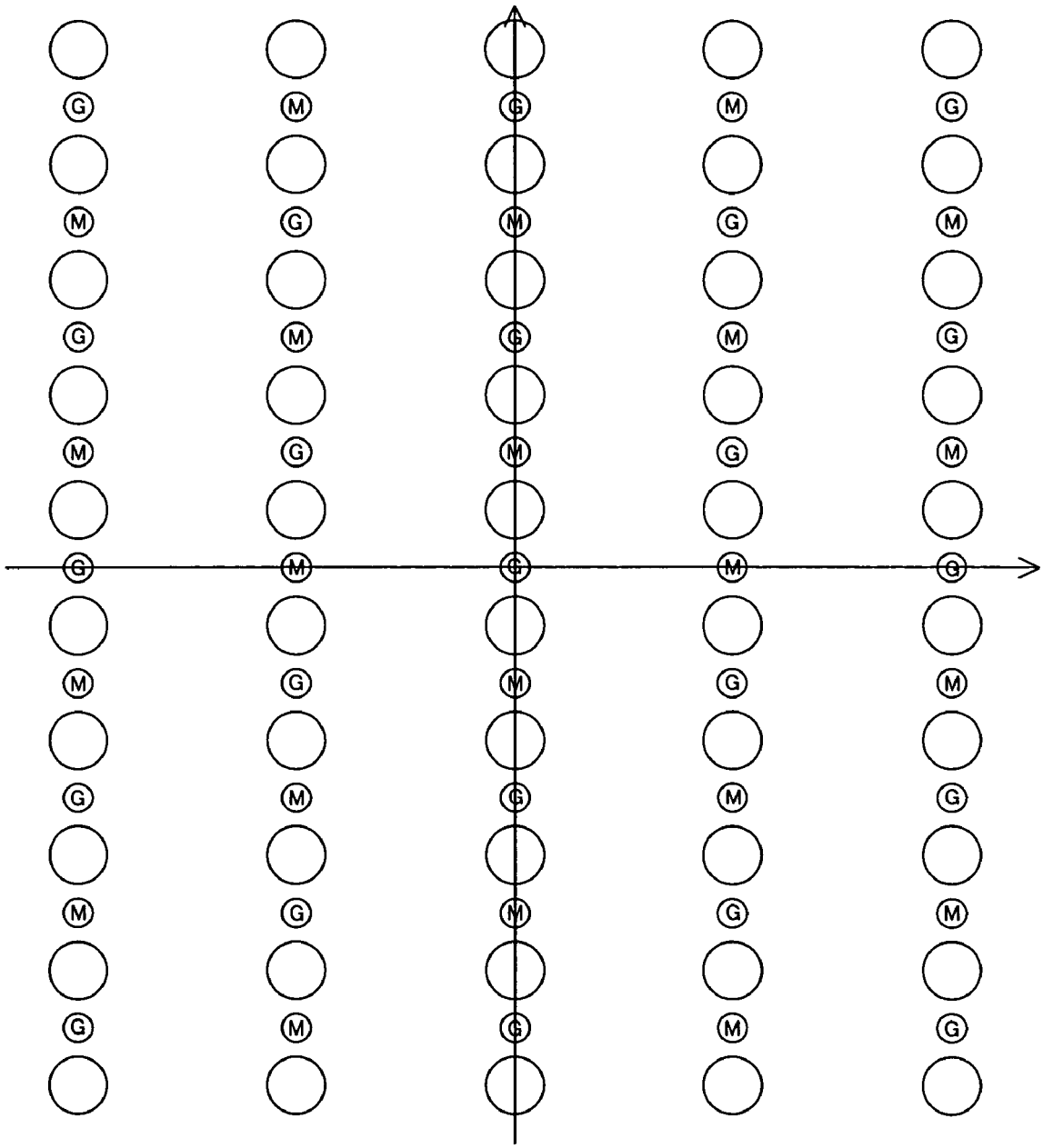
FIG. 37 is a diagram showing cell positions of each color and positions of data points upon approximate calculation (in Type B).

First, FIGS. 34 and 35 show the difference of the relative position between the data point and the cell depending on a color of the cell in the type A and the type B, respectively. As understood from FIGS. 34 and 35, positions of green cells are matched to data positions thereof in the horizontal direction, but positions of red cells and blue cells are not matched to data positions thereof in the horizontal direction. The difference between them is neglected in the example 1 and the example 2 so that the red cells and the blue cells are regarded to be located at the data point positions in the horizontal direction. FIGS. 36 and 37 show imaginary positions M of blue and red cells for performing the approximate calculation.

However, since a cell does not exist at the true point strictly, a defect occurs that the contour is slightly colored. In this example, a method for dealing with the position relationship between the cell and the data point precisely will be explained.

First, a general expression of the optimal coefficients of the neighborhood operation is determined. Furthermore, in this example, the case where a data point pitch is an integral multiple of a half of the cell pitch is handled. Here, the cell pitch is denoted by $x_0$ in the X-direction and by $y_0$ in the Y-direction.

First, in accordance with the expression (21), an error of the filter characteristics is determined. However, F(μ,ν) is generalized as a complex function.

$$\begin{aligned}
E &= \int_{\sigma}\left|F(\mu,\nu)-1\right|^2 d\mu d\nu+\int_{\tau}\left|F(\mu,\nu)\right|^2 d\mu d\nu \\
&= \int_{\sigma+\tau}F(\mu,\nu)F^*(\mu,\nu)d\mu d\nu- \\
&\quad \int_{\sigma}\left\{F(\mu,\nu)+F^*(\mu,\nu)\right\}d\mu d\nu+\frac{2}{x_0 y_0}
\end{aligned} \quad (36)$$

The first term of the expression (36) can be rewritten as follows.

$$\begin{aligned}
\int_{\sigma+\tau}F(\mu,\nu)F^*(\mu,\nu)d\mu d\nu &= \int_{-1/y_0}^{1/y_0}\int_{-1/x_0}^{1/x_0}\sum_{j,k}\rho_j\rho_k\exp\left(2\pi i\mu(\xi_k-\xi_j)\right) \\
&\quad \exp\left(2\pi i\nu(\psi_k-\psi_j)\right)d\mu d\nu
\end{aligned} \quad (37)$$

Here, $\chi_{jk}$ is defined as below.

$$\chi_{jk} = \frac{x_0 y_0}{4} \int_{-1/y_0}^{1/y_0} \int_{-1/x_0}^{1/x_0} \exp(2\pi i \mu(\xi_k - \xi_j)) \exp(2\pi i \nu(\psi_k - \psi_j)) d\mu d\nu \tag{38}$$

Then, the expression (37) can be rewritten as follows.

$$\chi_{jk} = P\left(\frac{2\pi(\xi_k - \xi_j)}{x_0}\right) P\left(\frac{2\pi(\psi_k - \psi_j)}{y_0}\right) \tag{39}$$

Here, $P(\chi)$ is defined as below.

$$P(x) = \begin{cases} \frac{\sin(x)}{x} & (x \neq 0) \\ 1 & (x = 0) \end{cases} \tag{40}$$

In this case, the pitch of the data points is an integral multiple of a half of the cell pitch. Therefore, if $\xi_j$ is not identical to $\xi_k$, n is defined as an integer that is not zero as below.

$$\frac{2\pi(\xi_k - \xi_j)}{x_0} = n\pi \tag{41}$$

Then, the following expression is derived.

$$P\left(\frac{2\pi(\xi_k - \xi_j)}{x_0}\right) = \begin{cases} 0 & (\xi_k \neq \xi_j) \\ 1 & (\xi_k = \xi_j) \end{cases} \tag{42}$$

In the same way, the following expression is derived.

$$P\left(\frac{2\pi(\psi_k - \psi_j)}{y_0}\right) = \begin{cases} 0 & (\psi_k \neq \psi_j) \\ 1 & (\psi_k = \psi_j) \end{cases} \tag{43}$$

Therefore, the following expression is derived.

$$\chi_{jk} = \delta_{jk} \tag{44}$$

Here, $\delta_{jk}$ denotes a Kronecker delta. Finally, the first term of the expression (36) is expressed as follows.

$$\int_{\sigma+\tau} F(\mu, \nu) F^*(\mu, \nu) d\mu d\nu = \frac{4}{x_0 y_0} \sum_j \rho_j^2 \tag{45}$$

Next, the second term of the expression (36) is expressed as follows.

$$-\int_{\sigma} \{F(\mu, \nu) + F^*(\mu, \nu)\} d\mu d\nu = -2 \int_{\sigma} \sum_j \rho_j \exp(-2\pi i \mu \xi_j) \exp(-2\pi i \nu \psi_j) d\mu d\nu \tag{46}$$

Here, $\omega_j$ is defined as below.

$$\omega_j = -\frac{x_0 y_0}{2} \int_{\sigma} \exp(-2\pi i \mu \xi_j) \exp(-2\pi i \nu \psi_j) d\mu d\nu \tag{47}$$

A specific expression of this $\omega_j$ will be determined later. First, an optimal value of $\rho_j$ will be determined using $\omega_j$. First, error E is rewritten as follows.

$$E = \frac{4}{x_0 y_0} \left\{ \sum_j \rho_j^2 + \sum_j \omega_j \rho_j + \frac{1}{2} \right\} \tag{48}$$

Then, a value of $\rho_j$ that minimizes this error E will be determined under the constraint condition that is expressed as follows.

$$\sum_j \rho_j - 1 = 0 \tag{49}$$

Here, Lagrange's undetermined coefficient method is used. The undetermined coefficient is denoted by $\lambda$. The following expression is defined.

$$\begin{aligned} E' &= \frac{x_0 y_0}{4} E + \lambda \left( \sum_j \rho_j - 1 \right) \\ &= \sum_j \rho_j^2 + \sum_j \omega_j \rho_j + \lambda \left( \sum_j \rho_j - 1 \right) + \frac{1}{2} \end{aligned} \tag{50}$$

An equation to be solved is as follows.

$$\frac{\partial E'}{\partial \rho_j} = 2\rho_j + \omega_j + \lambda = 0 \tag{51}$$

The constraint condition of the expression (49) is considered to solve the equation (51). The solution is as follows.

$$\rho_j = -\frac{1}{2}\omega_j + \frac{1}{2N} \left\{ \sum_k \omega_k + 2 \right\} \tag{52}$$

Here, N is the number of data points that are used for the calculation.

Next, a specific expression of $\omega_j$ is determined. In order to simplify the expression, in the same way as FIG. 32, the suffixes are replaced with coordinate values that use a half of the cell pitch as a unit. The following expression is used as a condition.

$$(\xi_j, \psi_j) = \left(\frac{x_0}{2} r, \frac{y_0}{2} s\right) \tag{53}$$

Then, the following expression is obtained.

$$\omega_j=\omega_{rs} \tag{54}$$

First, if ½<K≦1, the area inside the Nyquist limit, i.e., the integral area becomes as shown in FIG. 31. When the integral operation of the expression (47) is performed, the following expression is obtained.

$$\omega_{rs}=\begin{cases} -1 & (r=0,\ s=0) \\ 2\sin(r\pi)\dfrac{K-1}{r\pi}+2(\cos(r\pi)-1)\dfrac{2K-1}{r^2\pi^2} & (r\neq 0,\ s=0) \\ -\dfrac{1}{s\pi}\sin(sK\pi)-\dfrac{1}{s(r+s(2K-1))\pi^2}\{\cos((r+s(K-1))\pi)-\cos(sK\pi)\} & (r-s(2K-1)=0,\ s\neq 0) \\ -\dfrac{1}{s\pi}\sin(sK\pi)+\dfrac{1}{s(r-s(2K-1))\pi^2}\{\cos((r-s(K-1))\pi)-\cos(sK\pi)\} & (r+s(2K-1)=0,\ s\neq 0) \\ \dfrac{1}{s\pi^2}\left[\dfrac{1}{r-s(2K-1)}\{\cos((r-s(K-1))\pi)-\cos(sK\pi)\}-\dfrac{1}{r+s(2K-1)}\{\cos((r+s(K-1))\pi)-\cos(sK\pi)\}\right] & (r-s(2K-1)\neq 0,\ r+s(2K-1)\neq 0,\ s\neq 0) \end{cases} \tag{55}$$

Figure 38:
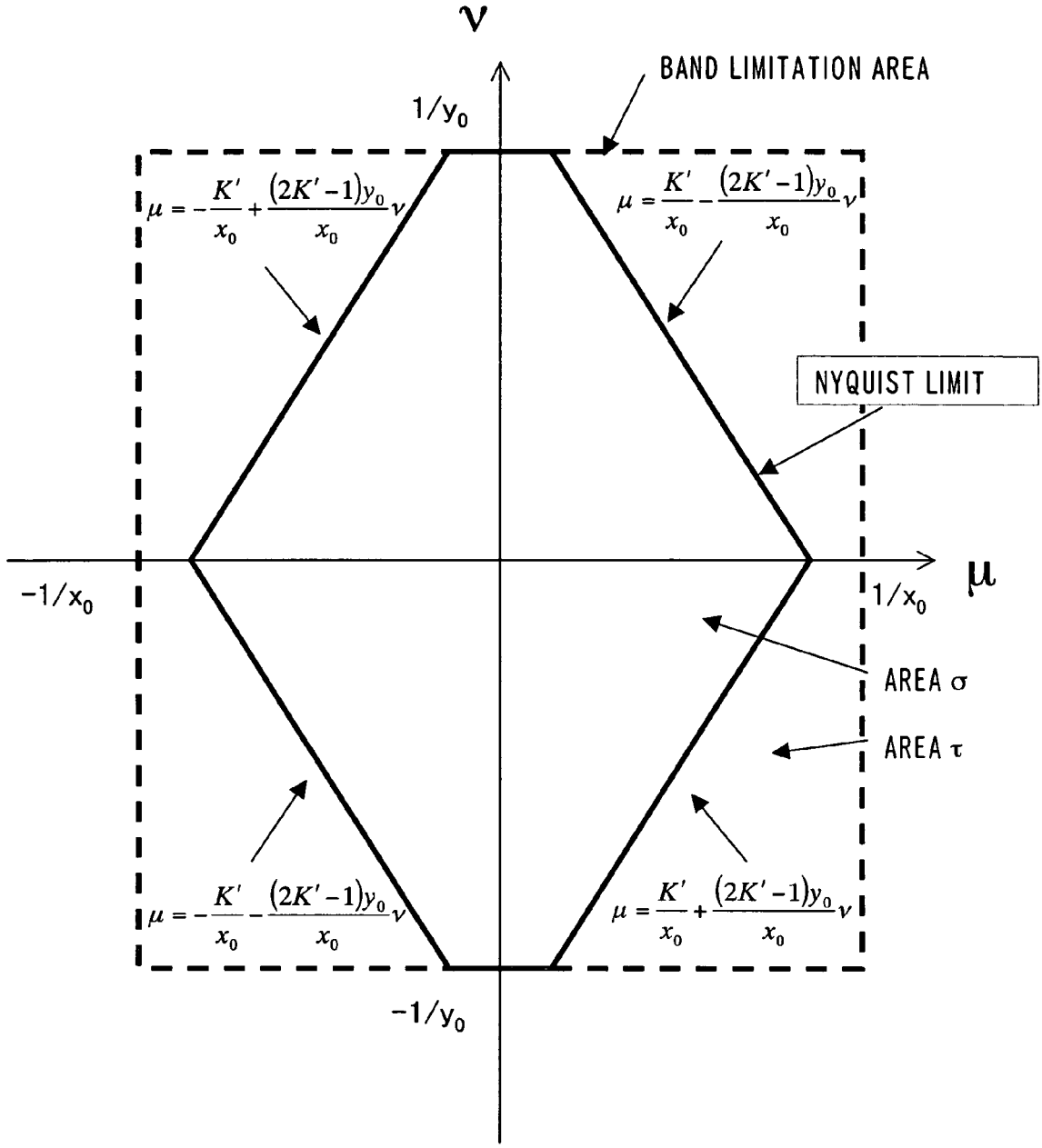
FIG. 38 is a diagram showing the Nyquist limit (when 1<K).

Next, the case where 1<K is considered. In this case, the area inside the Nyquist limit, i.e., an area of the integral operation becomes as shown in FIG. 38, and the hypotenuse of the boundary is expressed by the following expression.

$$\left.\begin{aligned} \mu &= \frac{K'}{x_0}-\frac{(2K'-1)y_0}{x_0}\nu & (\mu>0,\ \nu>0) \\ \mu &= -\frac{K'}{x_0}+\frac{(2K'-1)y_0}{x_0}\nu & (\mu<0,\ \nu>0) \\ \mu &= -\frac{K'}{x_0}-\frac{(2K'-1)y_0}{x_0}\nu & (\mu<0,\ \nu<0) \\ \mu &= \frac{K'}{x_0}+\frac{(2K'-1)y_0}{x_0}\nu & (\mu>0,\ \nu<0) \end{aligned}\right\} \tag{56}$$

Here, the following expression is considered.

$$K'=\frac{K}{2K-1} \tag{57}$$

When the integral operation of the expression (47) is performed, $\omega_{rs}$ is determined as below.

$$\omega_{rs}=\begin{cases} -1 & (s=0,\ r=0) \\ 2\sin(s\pi)\dfrac{K'-1}{s\pi}+2(\cos(s\pi)-1)\dfrac{2K'-1}{s^2\pi^2} & (s\neq 0,\ r=0) \\ -\dfrac{1}{r\pi}\sin(rK'\pi)-\dfrac{1}{r(s+r(2K'-1))\pi^2}\{\cos((s+r(K'-1))\pi)-\cos(sK'\pi)\} & (s-r(2K'-1)=0,\ r\neq 0) \\ -\dfrac{1}{r\pi}\sin(rK'\pi)+\dfrac{1}{r(s-r(2K'-1))\pi^2}\{\cos((s-r(K'-1))\pi)-\cos(rK'\pi)\} & (s+r(2K'-1)=0,\ r\neq 0) \\ \dfrac{1}{r\pi^2}\left[\dfrac{1}{s-r(2K'-1)}\{\cos((s-r(K'-1))\pi)-\cos(rK'\pi)\}-\dfrac{1}{s+r(2K'-1)}\{\cos((s+r(K'-1))\pi)-\cos(rK'\pi)\}\right] & (s-r(2K'-1)\neq 0,\ s+r(2K'-1)\neq 0,\ r\neq 0) \end{cases} \tag{58}$$

Thus, the expression of $\rho_j$ is determined.

Figure 39:
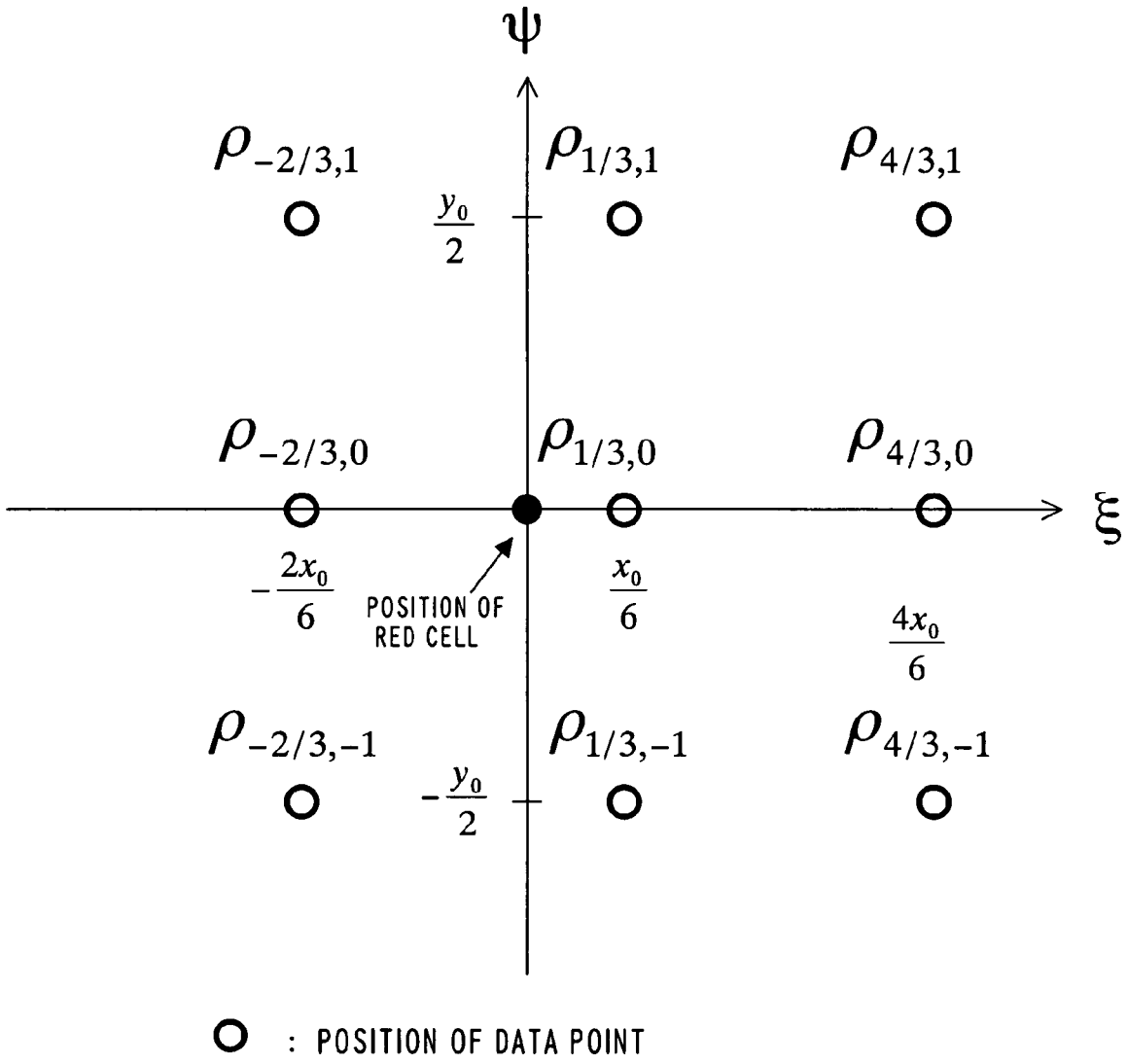
FIG. 39 is a diagram showing an example of coefficients for a red cell (in Type A).

Next, the coefficients of the neighborhood operation for a red cell are given. First, in the case of the type A, in the same way as FIG. 32, positions of the data points and the coefficients when the red cell is a center are shown in FIG. 39. Compared with a green cell, positions of data points are relatively shifted in the X-direction by $x_0/6$. When the value of K that is designing matter is determined, a value of $\rho_{rs}$ is determined by the expression (52), the expression (55), or the expression (58).

Figure 40:
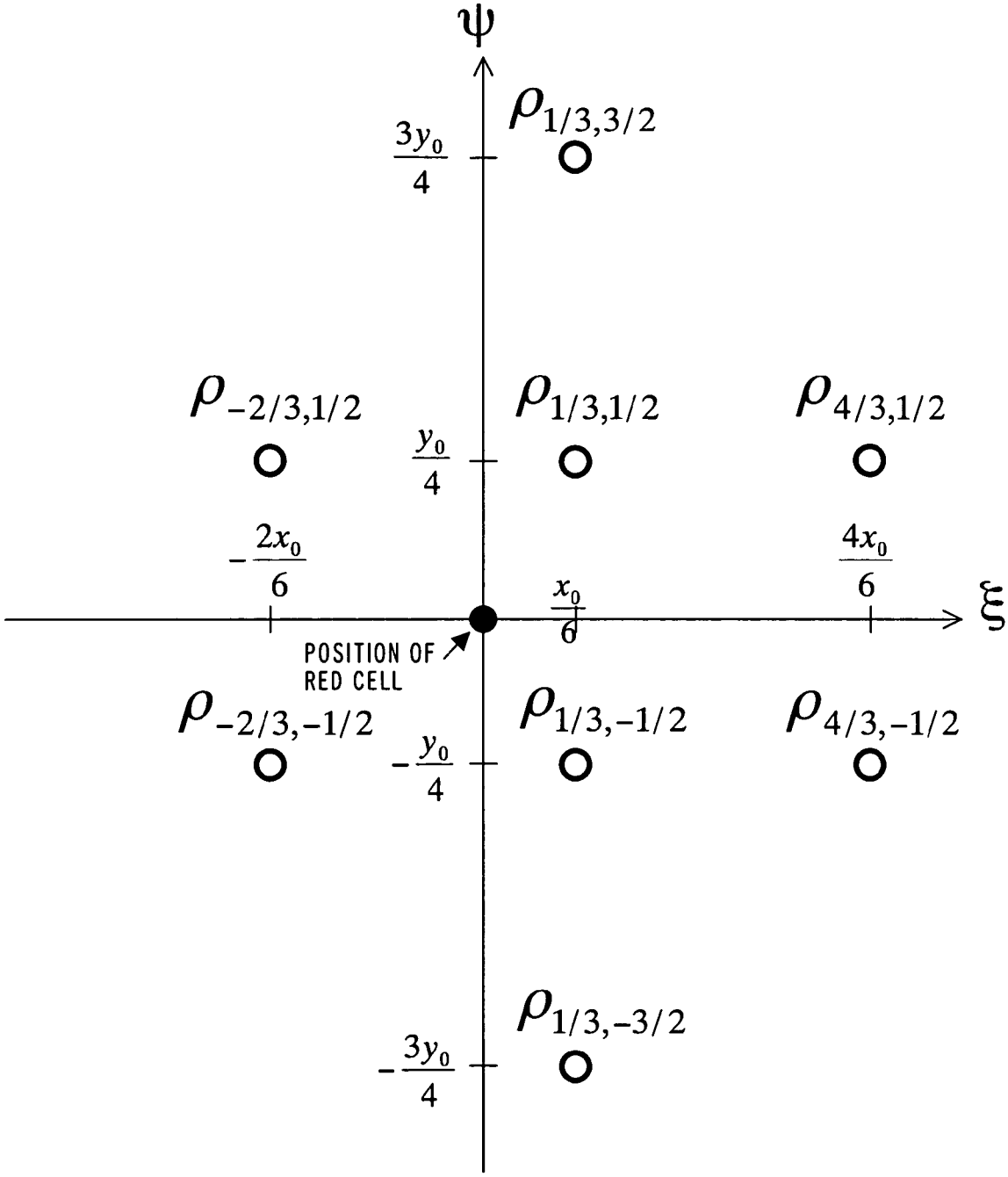
FIG. 40 is a diagram showing an example of coefficients for a red cell (in Type B).

In the case of the type B, it is as shown in FIG. 40.

Figure 41:
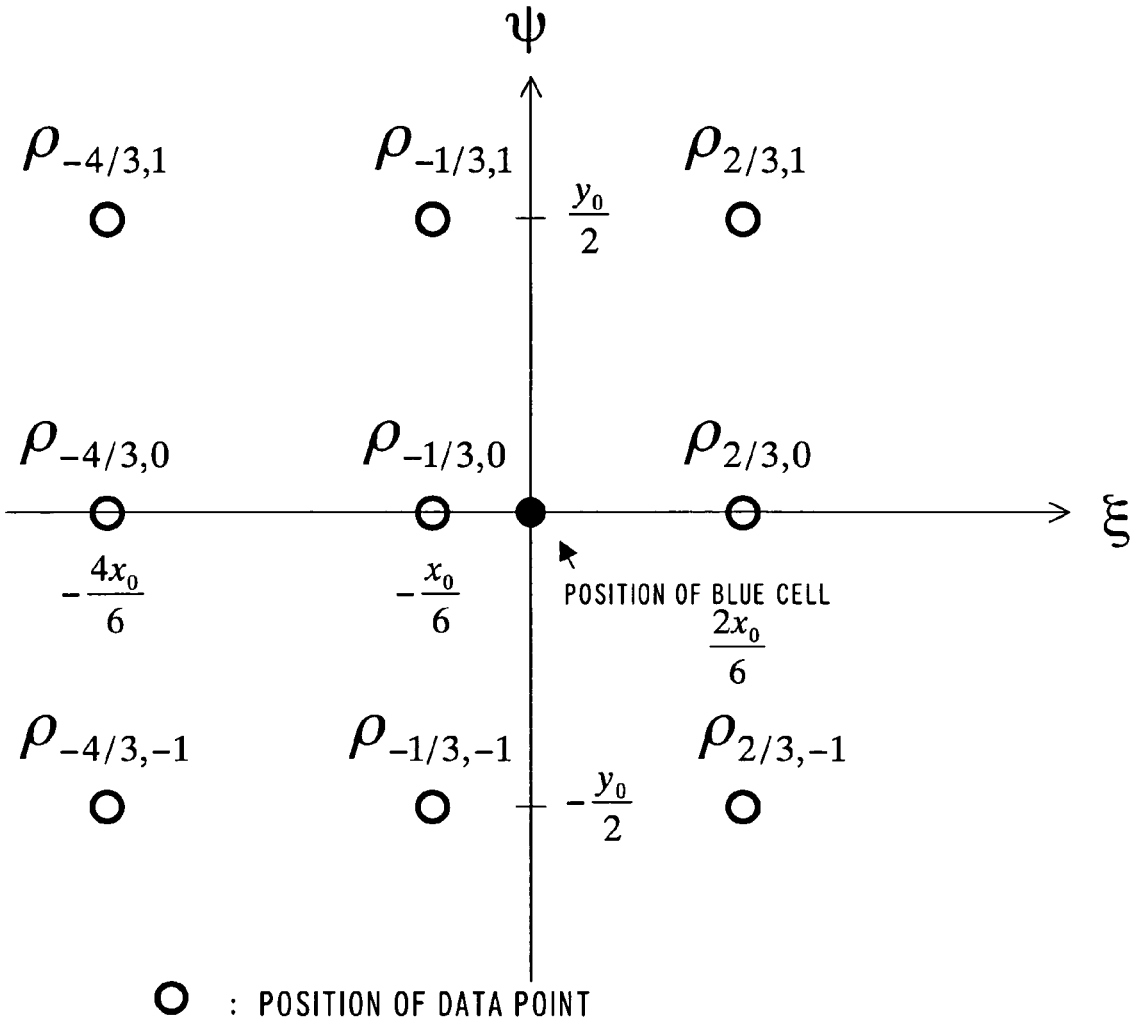
FIG. 41 is a diagram showing an example of coefficients for a blue cell (in Type A).
Figure 42:
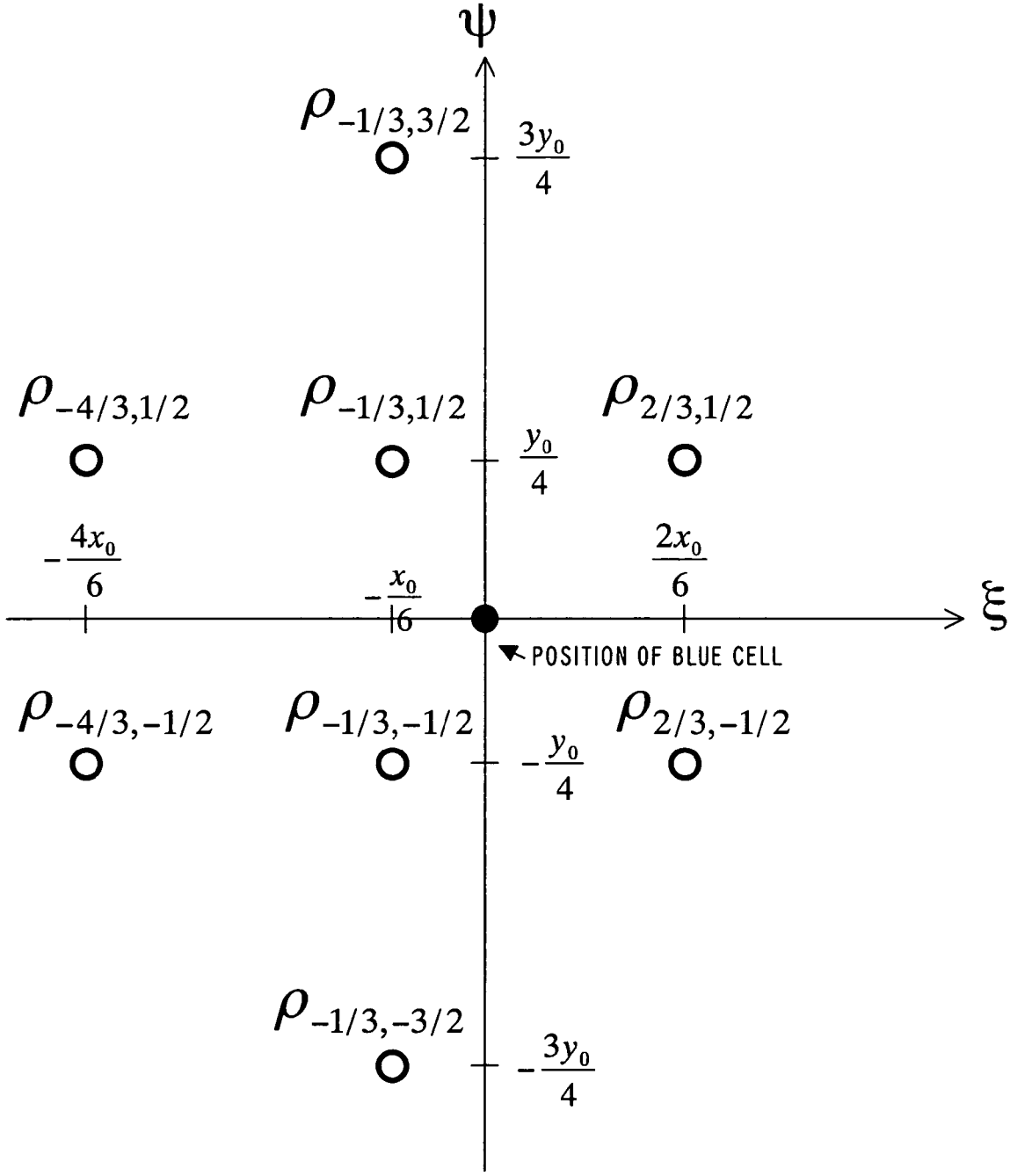
FIG. 42 is a diagram showing an example of coefficients for a blue cell (in Type B).
Figure 43:
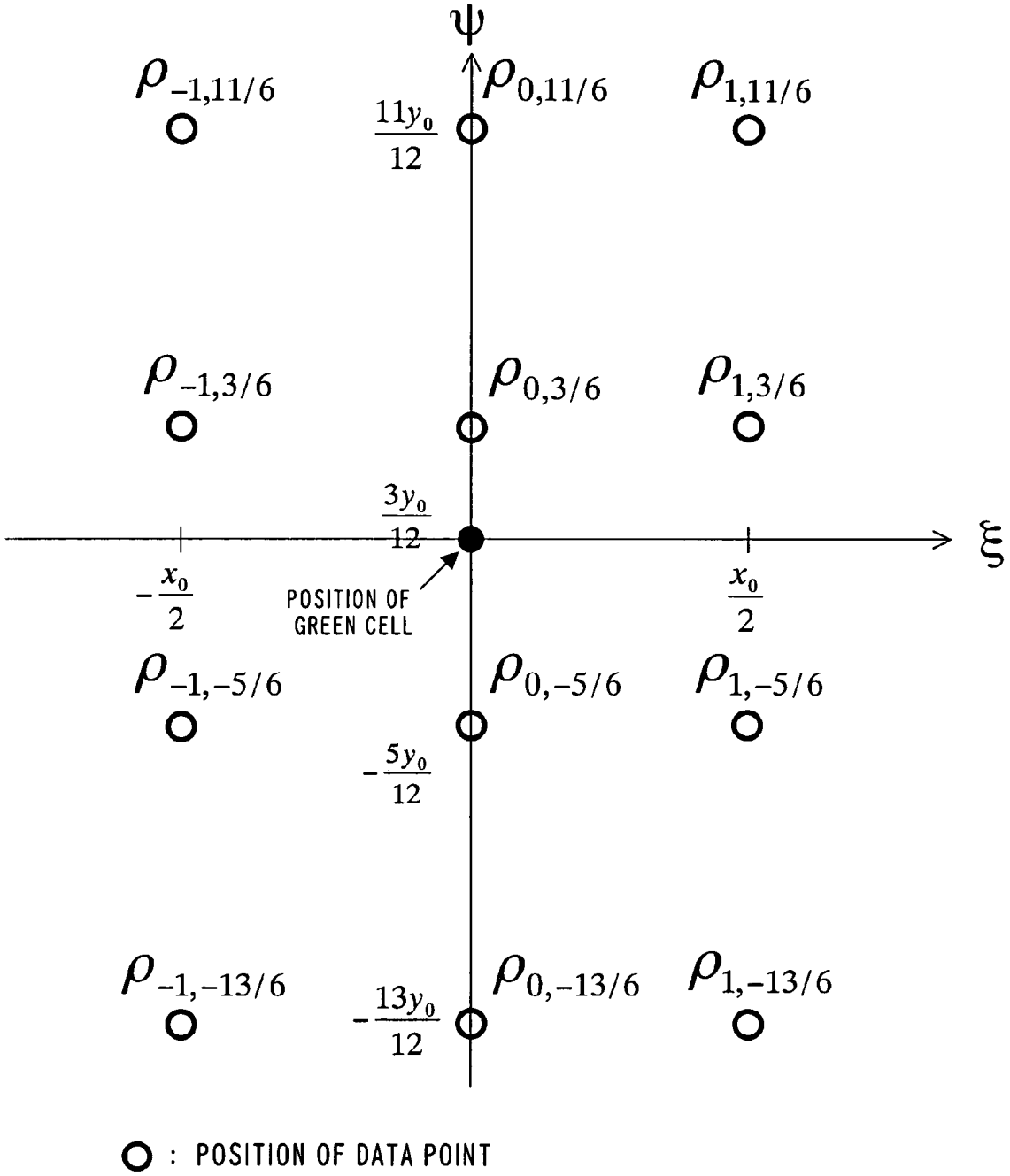
FIG. 43 is a diagram showing an example that also works for format conversion (in Type 1).
Figure 44:
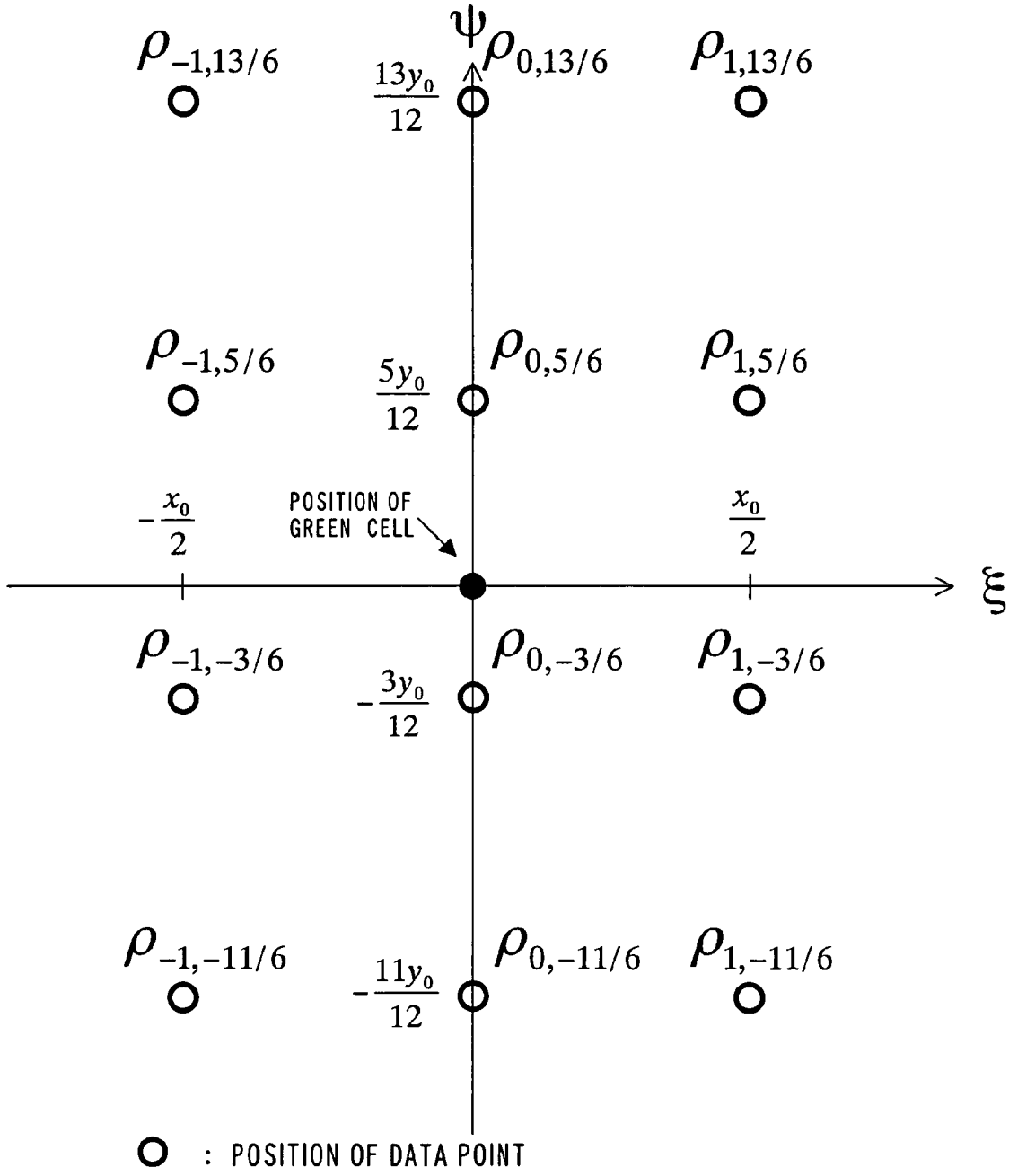
FIG. 44 is a diagram showing an example that also works for format conversion (in Type 2).
Figure 45:
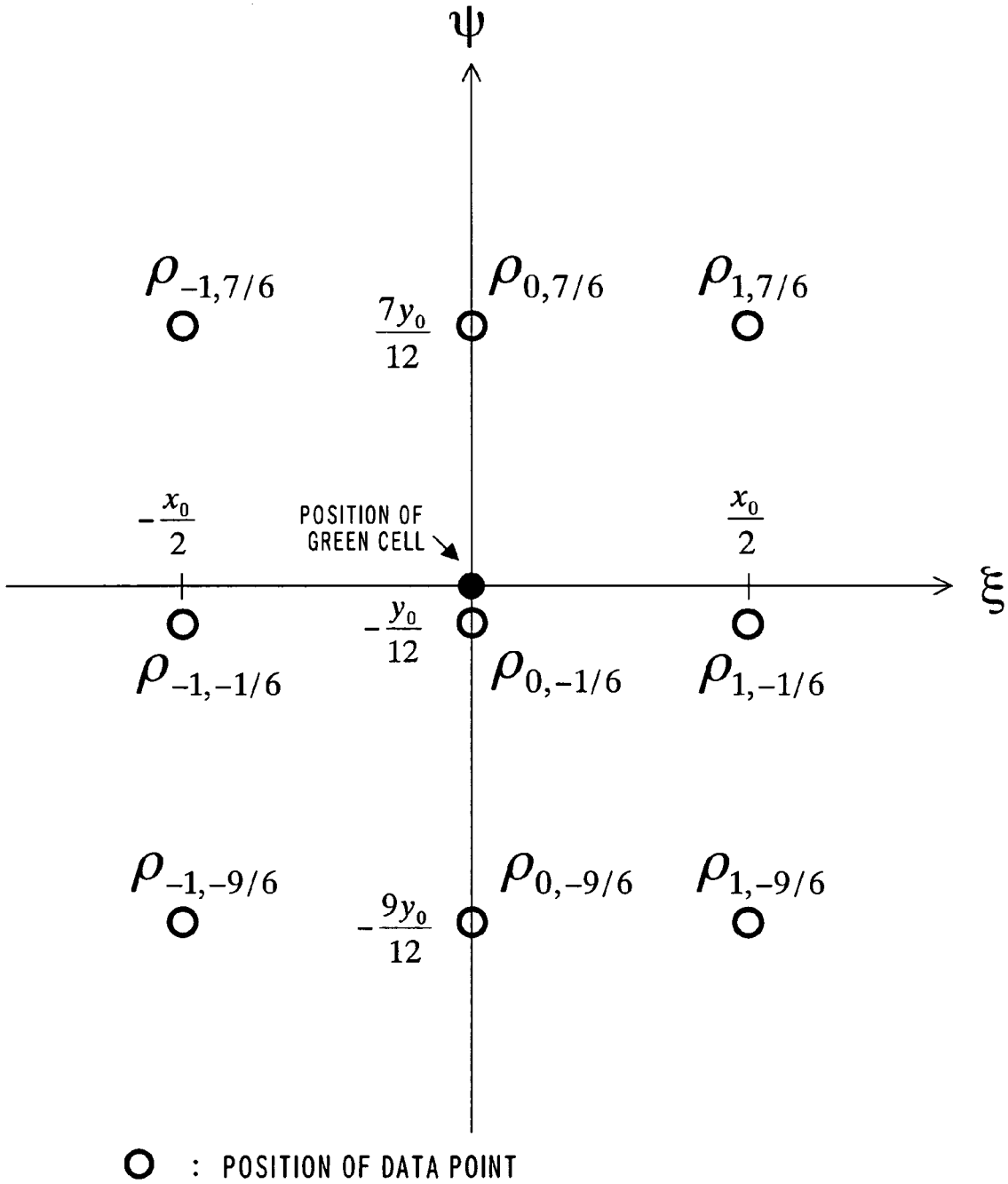
FIG. 45 is a diagram showing an example that also works for format conversion (in Type 3).
Figure 46:
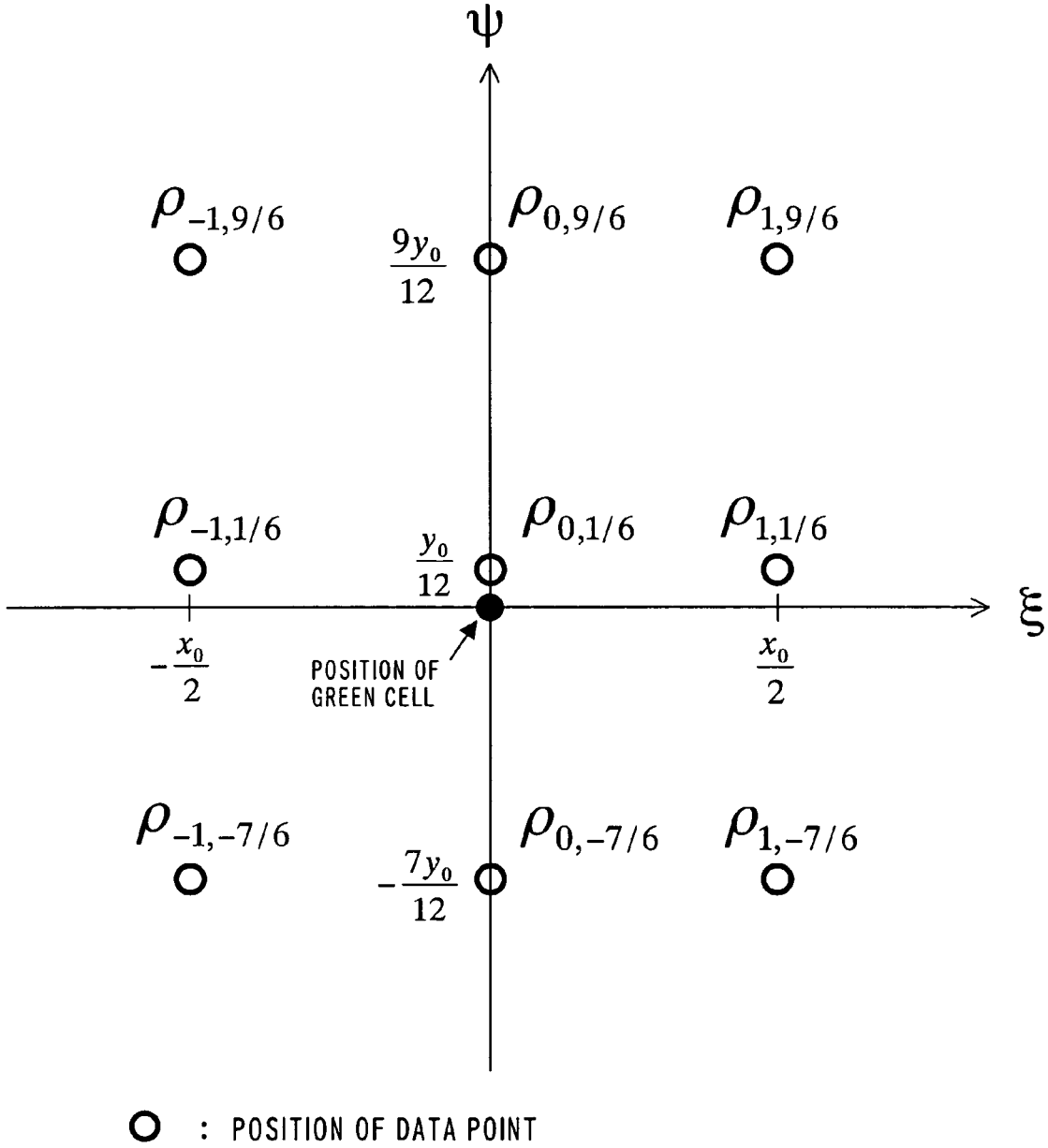
FIG. 46 is a diagram showing an example that also works for format conversion (in Type 4).
Figure 47:
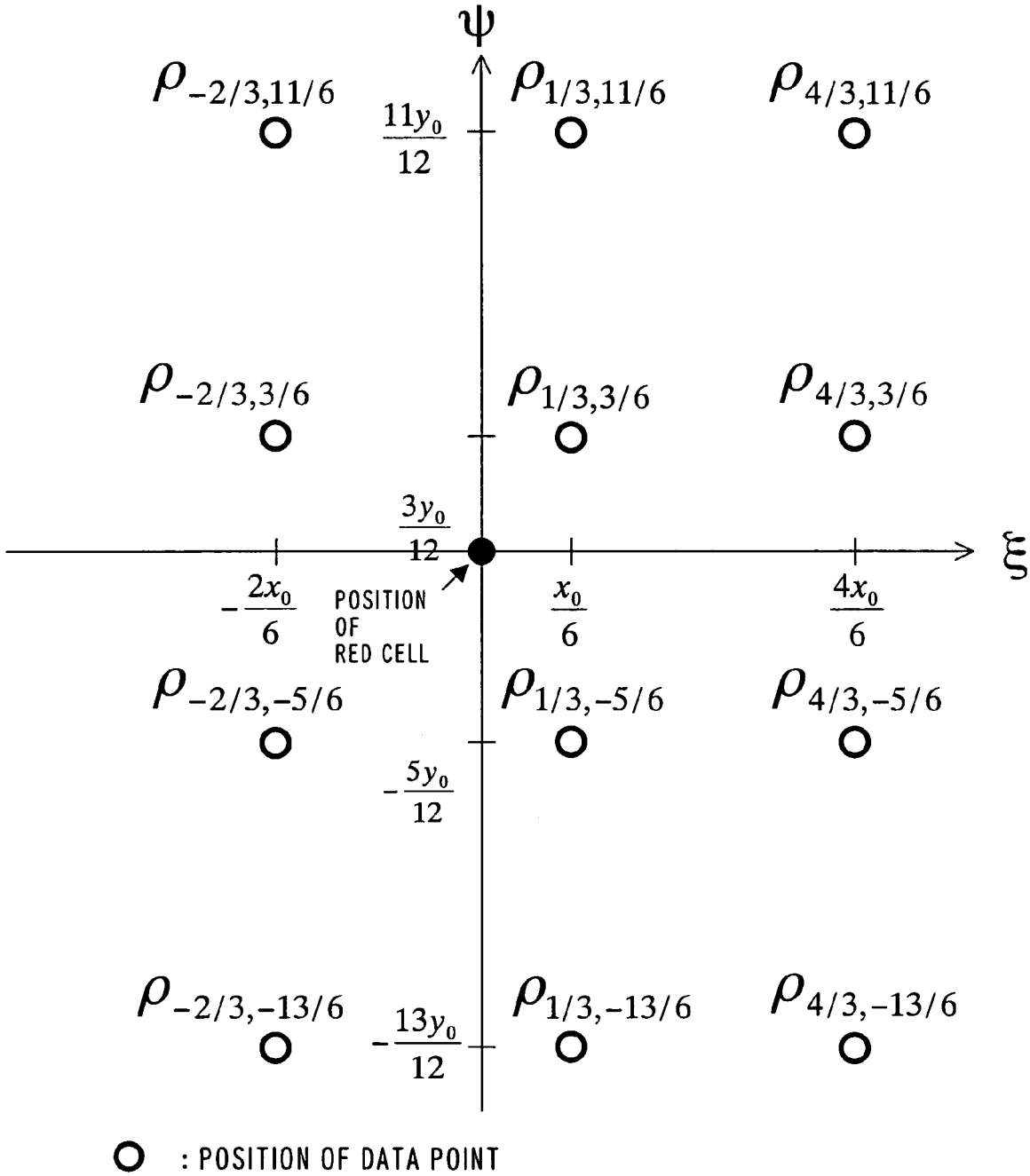
FIG. 47 is a diagram showing an example that also works for format conversion in the case of a red cell (in Type 1).
Figure 48:
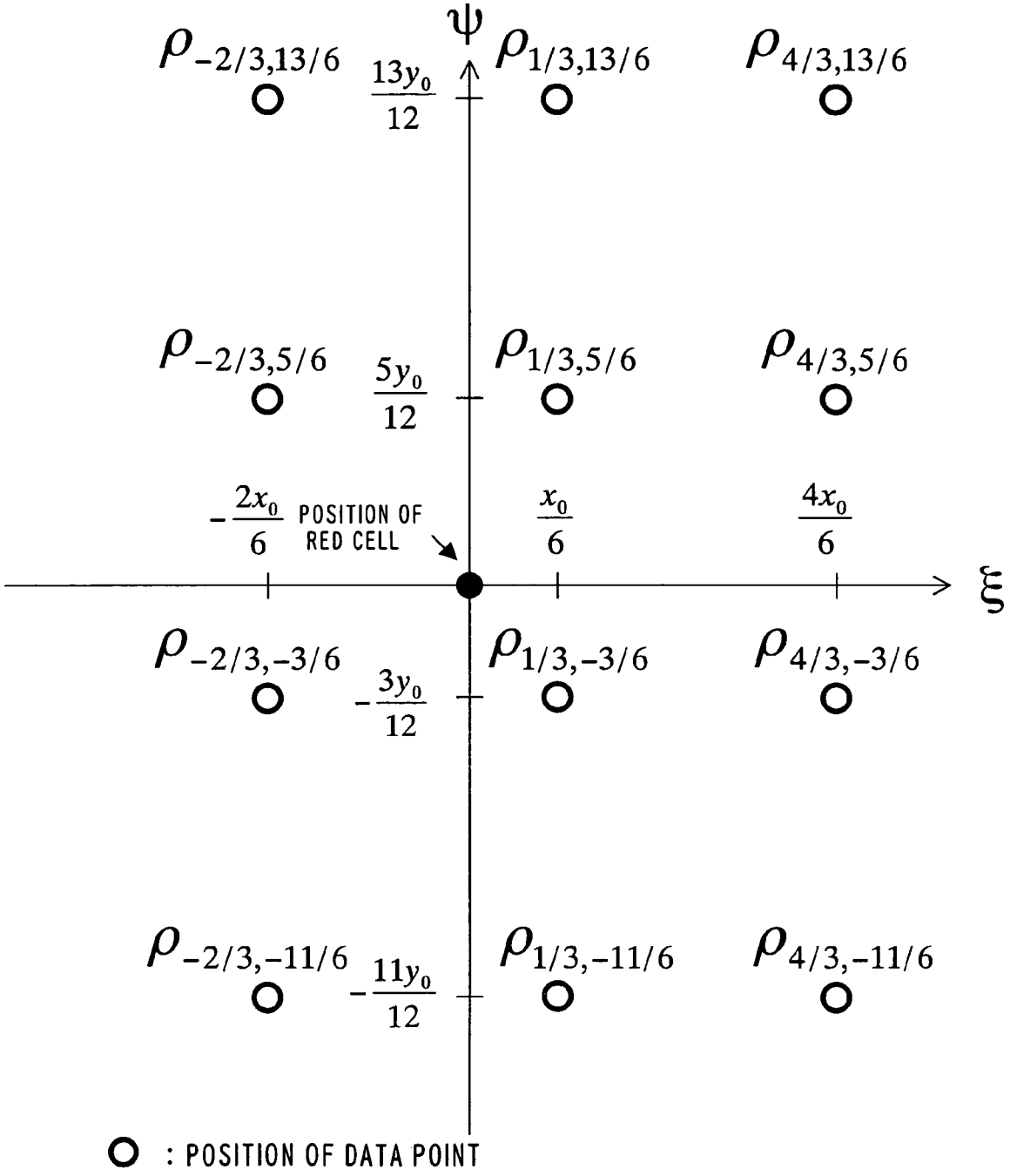
FIG. 48 is a diagram showing an example that also works for format conversion in the case of a red cell (in Type 2).
Figure 49:
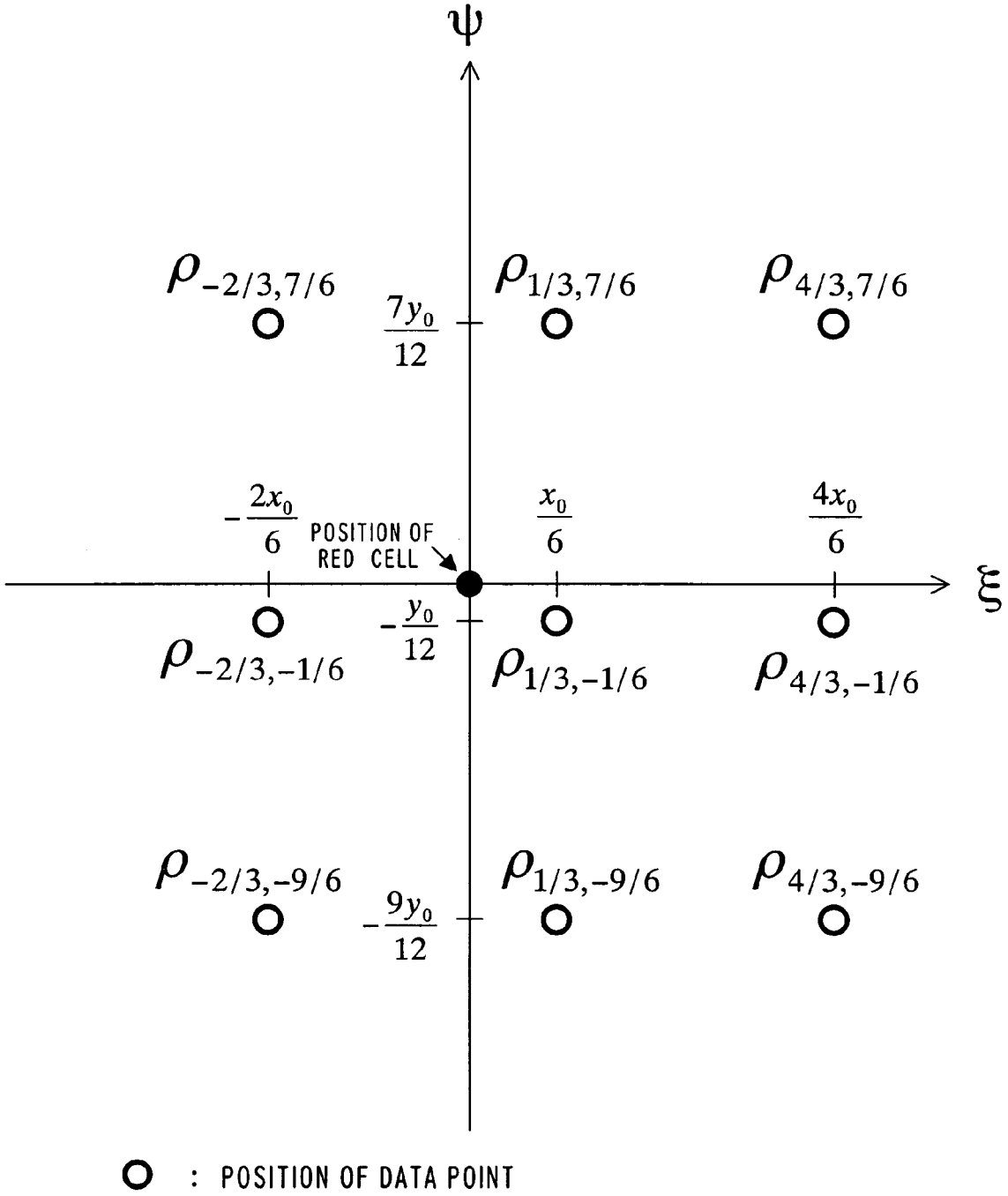
FIG. 49 is a diagram showing an example that also works for format conversion in the case of a red cell (in Type 3).
Figure 50:
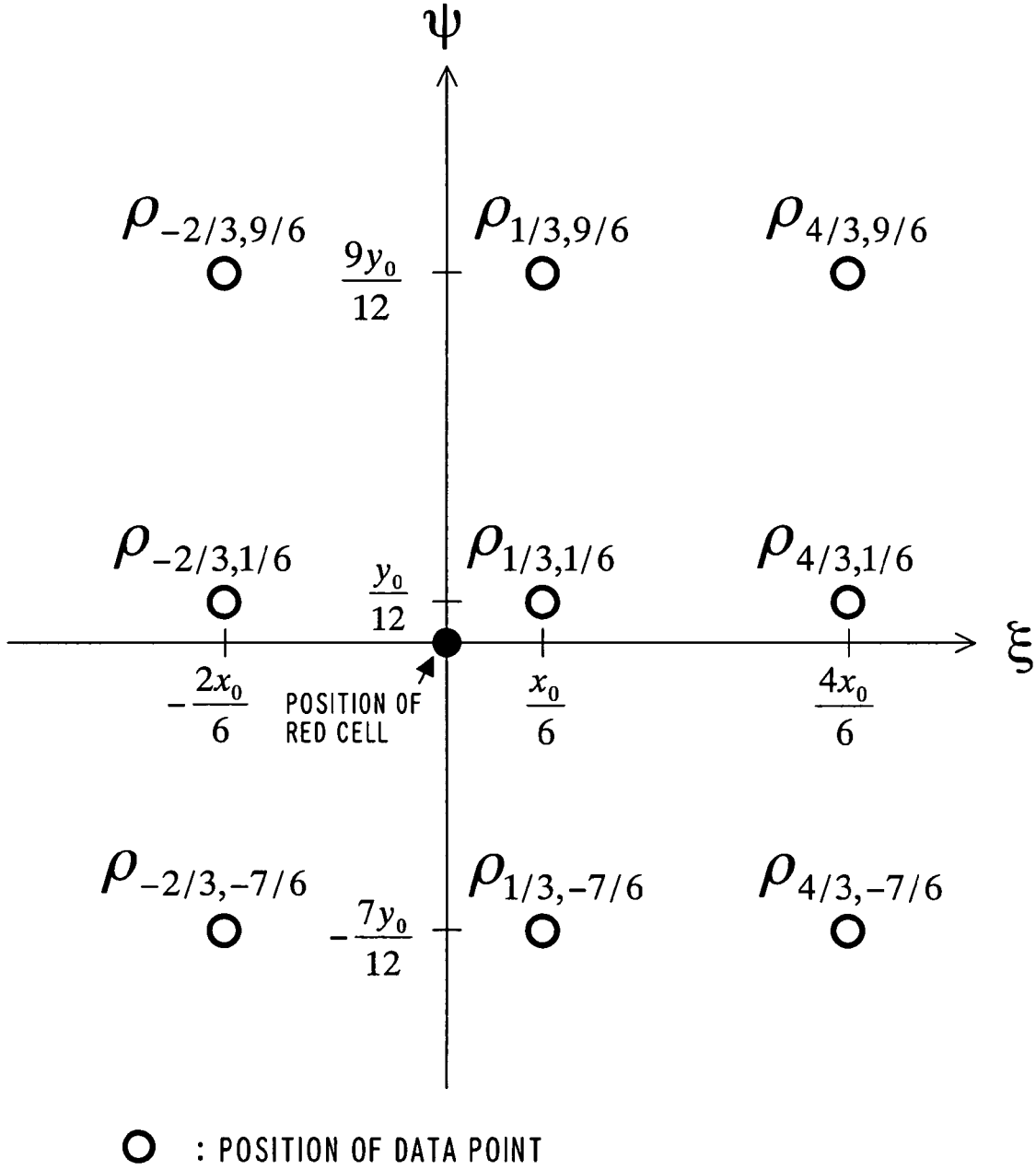
FIG. 50 is a diagram showing an example that also works for format conversion in the case of a red cell (in Type 4).

The blue cell is similar to the red cell except that the direction of the position shift is opposite. FIGS. 41 and 42 show this example.

According to this example, a pixel operation can be performed with considering the difference due to the cell color difference.

Furthermore, the method of selecting data points that are used for calculation is not limited to the above example. It can be different for each cell. Any selecting method can determine the coefficients by the expression (52), the expression (55) or the expression (58).

EXAMPLE 4

Though the pitch of the data points is a half of the cell pitch on the screen in the example 1, the example 2 and the example 3, another example of structure will be explained in which the pitch of the data points is not match the pitch on the screen. Namely, if the screen format is different from the data format like the case where the screen format is 1024 lines×1024 lines while the data format is 1280 lines×768 lines, a low pass filter operation that also works for format conversion is structured.

It is different from the example 3 that since the pitch of the data points is not an integral multiple of a half of the cell pitch, the expression (42) and the expression (43) are not satisfied. Therefore, the expression of E becomes as follows.

$$E = \frac{4}{x_0 y_0}\left\{\sum_{j,k} \chi_{jk}\rho_j\rho_k + \sum_j \omega_j\rho_j + \frac{1}{2}\right\} \tag{59}$$

Here, the expression of $\omega_j$ is not changed, which is given by the expression (55) or the expression (58). In addition, $\chi_{jk}$ is given by the expression (39) and the expression (40).

The first term in parentheses in the expression (59) is an expression of a quadratic form, and its value is given by the following expression.

$$\sum_{j,k} \chi_{jk}\rho_j\rho_k = \frac{x_0 y_0}{4}\int_{-1/y_0}^{1/y_0}\int_{-1/x_0}^{1/x_0} |F(\mu, \nu)|^2 d\mu d\nu \geq 0 \tag{60}$$

In addition, the value of this expression having the quadratic form becomes zero only when $F(\mu,\nu)=0$, i.e., when all coefficients $\rho_j$ are zero. Therefore, the quadratic form is positive definite, and the matrix $\chi_{jk}$ has an inverse matrix $\chi^{-1}_{jk}$.

Next, values of $\rho_j$ that minimize the error E of the expression (59) will be determined under the constraint condition of the expression (49). In the same way as in the example 3, Lagrange's undetermined coefficient method is used. The undetermined coefficient is denoted by $\lambda$. The following expression is defined.

$$\begin{aligned} E' &= \frac{x_0 y_0}{4}E + \lambda\left(\sum_j \rho_j - 1\right) \\ &= \sum_{j,k} \chi_{jk}\rho_j\rho_k + \sum_j \omega_j\rho_j + \lambda\left(\sum_j \rho_j - 1\right) + \frac{1}{2} \end{aligned} \tag{61}$$

An equation to be solved is as follows.

$$\frac{\partial E'}{\partial \rho_j} = 2\sum_k \chi_{jk}\rho_k + \omega_j + \lambda = 0 \tag{62}$$

Since $\chi_{jk}$ has an inverse matrix, the expression (62) can be solved for $\rho_j$, which is expressed as follows.

$$\rho_l = -\frac{1}{2}\sum_j \chi^{-1}_{lj}\omega_j - \frac{\lambda}{2}\sum_j \chi^{-1}_{lj} \tag{63}$$

Next, sums about 1 are calculated for both sides of the expression (63), and the following expression is obtained while considering the expression (49).

$$1 = -\frac{1}{2}\sum_{l,j} \chi^{-1}_{lj}\omega_j - \frac{\lambda}{2}\sum_{l,j} \chi^{-1}_{lj} \tag{64}$$

Here, noting that $\chi_{jk}$ is positive definite, $\lambda^{-1}_{jk}$ is also positive definite. On the other hand, a vector in which all elements are one as expressed below is used.

$$p_j = 1(\forall j) \tag{65}$$

Then, the expression (64) can be rewritten as below.

$$\sum_{l,j} \chi^{-1}_{lj} = \sum_{l,j} \chi^{-1}_{lj} p_l p_j > 0 \tag{66}$$

Therefore, since the expression (66) becomes the positive definite quadratic form for a vector that is not zero, the value thereof becomes a positive value. Then, the value of $\lambda$ can be determined from the expression (64). The value is assigned to the expression (63), and then the value of $\rho_1$ is determined as follows.

$$p_l = \frac{\sum_j \chi^{-1}_{lj}}{\sum_{j,k} \chi^{-1}_{jk}}\left\{\frac{1}{2}\sum_{j,k} \chi^{-1}_{jk}\omega_k + 1\right\} - \frac{1}{2}\sum_j \chi^{-1}_{lj}\omega_j \tag{67}$$

In each case where the number of vertical lines is the same between the screen and the original image while the number of horizontal lines is different between them, a relationship among the cell, the data points and the coefficients is shown in FIGS. 43, 44, 45 and 46, respectively. This is the case where the number of horizontal lines on the screen is 1024 lines while the number of horizontal lines of the original image is 768 lines. The horizontal line pitch of the screen is $y_0/2$, while the horizontal line pitch of the original image is $2y_0/3$ (Furthermore, the line pitch on the screen is a half of the cell pitch). There are four cases of the position relationship between the cell and the data point.

FIGS. 47, 48, 49 and 50 shows a case of a red cell. In the same way as the example 3, the data point positions are shifted in the horizontal direction by $x_0/6$ compared with the case of a green cell. In the case of a blue cell, only the direction of the shift becomes opposite, so a drawing is omitted.

Furthermore, though the value of the coefficient is normalized by the expression (49) in the above-explained examples, a coefficient that is a product of the determined coefficient and a constant can be used so as to obtain the same effect of the filter.

As explained above, the present invention is useful for improving display quality of a display apparatus that has a delta arrangement type screen. An original image can be reproduced faithfully by the delta arrangement type plasma display panel.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An image display apparatus for displaying an input image whose pixel arrangement is an orthogonal arrangement by converting the image into an image in a non-orthogonal arrangement, the apparatus comprising:

a display device having a non-orthogonal arrangement type screen on which an electrode matrix for controlling a display is arranged;

a band limitation filter for performing an operation for narrowing a space frequency range of image data that represent the input image;

an arrangement conversion circuit for performing an operation for converting a pixel arrangement of an output of the band limitation filter from the orthogonal arrangement into a cell arrangement of the screen; and a driving circuit for applying a drive voltage to the electrode matrix in accordance with an output of the arrangement conversion circuit.

2. The image display apparatus according to claim 1, wherein the arrangement conversion circuit performs an operation that works both for conversion of the pixel arrangement and for conversion of a resolution.

3. An image display apparatus for displaying an input image whose pixel arrangement is an orthogonal arrangement by converting the image into an image in a non-orthogonal arrangement, the apparatus comprising:

a display device having a non-orthogonal arrangement type screen on which an electrode matrix for controlling a display is arranged;

an image conversion circuit for performing an add operation with weighting that is for narrowing a space frequency range of image data that represent the input image and is for converting the pixel arrangement from the orthogonal arrangement into a cell arrangement of the screen; and a driving circuit for applying a drive voltage to the electrode matrix in accordance with an output of the image conversion circuit.

4. The image display apparatus according to claim 3, wherein the image conversion circuit performs the add operation with weighting that works for limiting the space frequency, for converting the pixel arrangement and for converting a resolution.

5. The image display apparatus according to claim 3, wherein the screen includes three types of cells having different light emission colors, a cell position in the column direction is shifted between the neighboring cell columns having the same light emission color of cells that constitute each column of the matrix display on the screen, and the image conversion circuit performs the add operation with weighting on the image data so that the space frequency range of at least one light emission color is different from that of the other light emission color.

6. The image display apparatus according to claim 3, further comprising a controller for switching a process of the image conversion circuit, and the image conversion circuit performs the add operation with weighting for limiting the space frequency of the image data when a first mode is designated by the controller and performs the add operation with weighting without limiting the space frequency of the image data when a second mode is designated by the controller.

7. An image filter that is used for a display by a delta arrangement type screen including a plurality of pixels, wherein the filter converts an input image into an image suppressing a space frequency component that exceeds a Nyquist limit determined by three elements including a pixel pitch of the screen in the vertical direction, a pixel pitch of the screen in the horizontal direction and weights that are preset in the vertical direction and in the horizontal direction.

8. An image filter that is used for a display by a delta arrangement type screen including a plurality of pixels, comprising:

a multiplying portion for multiplying a data value of an input image by a coefficient; and an adding portion for adding N products obtained by the multiplying portion, wherein the image filter performs a neighborhood operation for calculating display luminance values of the pixels on the screen from luminance values of N data points in the input image, and delivers an image whose space frequency is suppressed outside a Nyquist limit that is determined by a pixel pitch of the screen in the vertical direction, a pixel pitch of the screen in the horizontal direction and weights that are preset in the vertical direction and in the horizontal direction.

9. An image conversion method that is used for a display by a delta arrangement type screen including a plurality of pixels, the method comprising:

performing a neighborhood operation for calculating display luminance values of the pixels on the screen from luminance values at N data points in the input image as an operation for converting an input image into an image whose space frequency is limited;

making a data point pitch in the vertical direction of the input image be a half of a pixel pitch $y_0$ in the vertical direction of the screen and a data point pitch in the horizontal direction of the input image be a half of a pixel pitch $x_0$ in the horizontal direction of the screen; and multiplying a luminance value at the data point of the input image by a coefficient $\rho_j$ in the neighborhood operation, the coefficient $\rho_j$ being defined by the following expression $$\rho_j = \frac{1}{N}\left\{\frac{1}{2}\sum_j \omega_j + 1\right\} - \frac{1}{2}\omega_j$$

where $\omega_j$ is an integral value within an area $\sigma$ of a preset Nyquist limit, which is defined by the following expression $$\omega_j = -\frac{x_0 y_0}{2}\int_\sigma \exp(-2\pi i\mu\xi_j)\exp(-2\pi i\nu\psi_j)d\mu d\nu$$

where $\xi_j$ and $\psi_j$ are components of coordinates $(\xi_j,\psi_j)$ of a position of the coefficient $\rho_j$ with respect to a pixel whose intensity is to be calculated, while $\mu$ and $\nu$ are components of coordinates $(\mu,\nu)$ in a frequency space.

10. The image conversion method according to claim 9, wherein in the neighborhood operation, the coefficient $\rho_j$ is replaced with an approximate coefficient having an error less than 11.3% to the coefficient $\rho_j$, so that the luminance value at the data point of the input image is multiplied by the approximate coefficient.

11. The image conversion method according to claim 10, wherein the input image is one of plural fields that constitute a frame of an interlace format.

12. The image conversion method according to claim 10, wherein the screen includes plural pixels having different display colors, and in the neighborhood operation the coefficient that is used for multiplying the luminance value at the data point of the input image is changed for each display color of the pixel.

13. The image conversion method according to claim 10, wherein in the neighborhood operation a coefficient set including plural coefficients are used repeatedly in accordance with a regularity of the pixel arrangement on the screen.

14. The image conversion method according to claim 10, wherein the coefficient has a value obtained by a calculation assuming a pixel position on the screen is shifted from a real position.

15. An image conversion method that is used for a display by a delta arrangement type screen including a plurality of pixels, the method comprising:

performing a neighborhood operation for calculating display luminance values of the pixels on the screen from luminance values at N data points in the input image as an operation for converting an input image into an image whose space frequency is limited;

making a data point pitch in the vertical direction of the input image be not a half of a pixel pitch $y_0$ in the vertical direction of the screen or a data point pitch in the horizontal direction of the input image be not a half of a pixel pitch $x_0$ in the horizontal direction of the screen; and multiplying a luminance value at the data point of the input image by a coefficient $\rho_j$ in the neighborhood operation, the coefficient $\rho_j$ being defined by the following expression $$p_l = \frac{\sum_j \chi_{lj}^{-1}}{\sum_{j,k} \chi_{jk}^{-1}} \left\{ \frac{1}{2} \sum_{j,k} \chi_{jk}^{-1} \omega_k + 1 \right\} - \frac{1}{2} \sum_j \chi_{lj}^{-1} \omega_j$$

where $\omega_j$ is an integral value within an area $\sigma$ of a preset Nyquist limit, which is defined by the following expression $$\omega_j = -\frac{x_0 y_0}{2} \int_\sigma \exp(-2\pi i \mu \xi_j) \exp(-2\pi i \nu \psi_j) d\mu d\nu$$

where $\xi_j$ and $\psi_j$ are components of coordinates $(\xi_j, \psi_j)$ of a position of the coefficient $\rho_j$ with respect to a pixel whose intensity is to be calculated, while $\mu$ and $\nu$ are components of coordinates $(\mu,\nu)$ in a frequency space, while $\chi^{-1}_{jk}$ is an inverse matrix of a matrix $\chi_{jk}$ that is defined by an integral value within an integral area determined by $\omega_j$ and a pixel pitch and $$\chi_{jk} = \frac{x_0 y_0}{4} \int_{-1/y_0}^{1/y_0} \int_{-1/x_0}^{1/x_0} \exp(2\pi i \mu(\xi_j - \xi_k)) \exp(2\pi i \nu(\psi_j - \psi_k)) d\mu d\nu$$

16. The image conversion method according to claim 15, wherein in the neighborhood operation, the coefficient $\rho_j$ is replaced with an approximate coefficient having an error less than 11.3% to the coefficient $\rho_j$, so that the luminance value at the data point of the input image is multiplied by the approximate coefficient.

17. The image conversion method according to claim 16, wherein the input image is one of plural fields that constitute a frame of an interlace format.

18. The image conversion method according to claim 16, wherein the screen includes plural pixels having different display colors, and in the neighborhood operation the coefficient that is used for multiplying the luminance value at the data point of the input image is changed for each display color of the pixel.

19. The image conversion method according to claim 16, wherein in the neighborhood operation a coefficient set including plural coefficients are used repeatedly in accordance with a regularity of the pixel arrangement on the screen.

20. The image conversion method according to claim 16, wherein the coefficient has a value obtained by a calculation assuming a pixel position on the screen is shifted from a real position.

* * * * *